US007410752B2

(12) United States Patent
Fujiwara

(10) Patent No.: US 7,410,752 B2
(45) Date of Patent: Aug. 12, 2008

(54) METHOD OF PRODUCING ORGANIC SILVER SALT DISPERSION, AND PHOTOTHERMOGRAPHIC MATERIAL

(75) Inventor: Itsuo Fujiwara, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 218 days.

(21) Appl. No.: 11/230,499

(22) Filed: Sep. 21, 2005

(65) Prior Publication Data

US 2006/0068343 A1 Mar. 30, 2006

(30) Foreign Application Priority Data

Sep. 27, 2004 (JP) ..... 2004-280533

(51) Int. Cl.
*G03C 5/18* (2006.01)
*G03C 5/26* (2006.01)
*G03C 1/00* (2006.01)

(52) U.S. Cl. ..... 430/449; 430/450; 430/493; 430/617; 430/618; 430/619; 430/620

(58) Field of Classification Search ..... 430/449–450, 430/493, 617–620
See application file for complete search history.

(56) References Cited

U.S. PATENT DOCUMENTS

2006/0035179 A1* 2/2006 Oyamada ..... 430/619

FOREIGN PATENT DOCUMENTS

JP A 2000-007683 1/2000

* cited by examiner

*Primary Examiner*—Geraldina Visconti
(74) *Attorney, Agent, or Firm*—Margaret A. Burke; Sheldon J. Moss

(57) ABSTRACT

A method of producing an organic silver salt dispersion, the method comprising: mixing a first aqueous solution including a water-soluble silver ion supplier and a second aqueous solution including an alkali metal salt of an organic acid to form an organic silver salt dispersion; wherein, the mixing is conducted in the presence of at least one compound selected from polyacrylamide and derivatives of polyacrylamide, and at least 10 mass % (in terms of silver quantity) of the organic silver salt in the organic silver salt dispersion is formed by simultaneous addition of the first aqueous solution and the second aqueous solution to an aqueous medium followed by mixing.

16 Claims, No Drawings

METHOD OF PRODUCING ORGANIC SILVER SALT DISPERSION, AND PHOTOTHERMOGRAPHIC MATERIAL

CROSS-REFERENCE TO RELATED APPLICATION

This application claims priority under 35 USC 119 from Japanese patent Application No. 2004-280533, the disclosure of which is incorporated by reference herein.

BACKGROUND OF THE INVENTION

1. Field of the Invention

The invention is related to a method of producing an organic silver salt particle dispersion and to a high-quality photothermographic material with excellent coated surface state.

2. Description of the Related Art

Reduction of waste solutions to be treated has been strongly desired in recent years in the medical field from the viewpoints of environmental protection and space saving. Under such circumstances, technologies on photosensitive photothermographic photographic materials for medical diagnosis and photography which can be exposed to light efficiently with a laser image setter or a laser imager, and can form a clear black image having high resolution and sharpness have been demanded. With these photosensitive photothermographic photographic materials, it is possible to supply to customers a heat development treatment system which has eliminated the necessity of using solvent system processing chemicals, and is simpler and does not impair the environment.

Similar requirements also exist in the field of general image forming materials. However, the image for medical use is required to have a high image quality excellent in sharpness and graininess, because fine details of the image are required. In addition, the medical image is characterized by preferably exhibiting a blue black image tone from the viewpoint of ease of medical diagnosis. Currently, various hard copy systems utilizing pigments or dyes such as inkjet printers and apparatuses for electrophotography are prevailing as general image forming systems. However, there is no system which is satisfactory as a medical image-output system.

A thermal image formation system utilizing an organic silver salt is described in a large number of documents. In particular, the photothermographic material generally has an image-forming layer in which a catalytically active amount of a photocatalyst (e.g., silver halide), a reducing agent, a reducible silver salt (e.g., organic silver salt), and, if required, a toning agent for controlling the color tone of silver are dispersed in a binder matrix. The photothermographic materials are, after being imagewise exposed, heated to a high temperature (for example, to 80° C. or higher) to form black silver images through the oxidation-reduction reaction between the silver halide or the reducible silver salt (which functions as an oxidizing agent) and the reducing agent therein. The oxidation-reduction reaction is accelerated by the catalytic action of the latent image of the silver halide generated through exposure. For this reason, the black silver images are formed in the exposed areas. Fuji Medical Dry Imager FM-DP L has been distributed as a medical image formation system using a photothermographic material.

In the production of a thermal image-forming system using an organic silver salt, the following exemplary methods can be conducted: in a method, the image-forming material is formed by coating operations using a solvent; in another method, a coating liquid is coated and dried which contains polymer fine particles as a main binder dispersed in water. The latter method is advantageous because: processes for collecting solvents or the like are unnecessary and the production facility can be simple, the latter method imposes less environmental burden, and the latter method is suitable for large-scale production. However, the coating liquid used in the latter method does not have setting property. Therefore, the film is affected by the drying wind after application of the coating liquid, and drying unevenness easily occurs.

It has been proposed (for example in U.S. Pat. Nos. 6,630,291 and 6,713,241, the disclosures of which are incorporated herein by reference) to use a hydrophilic binder such as gelatin as the binder. However, the resultant image-forming material has poor thermal development activity and fogging inevitably occurs when the activity is heightened to obtain a sufficient image. The image-forming material of this type has not been put into practical use.

In a photothermographic material, the film has to contain chemical components necessary for image formation even before image formation. Accordingly, the chemical components affect the storage stability of the photothermographic material before use. In addition, after image formation through thermal development, the chemical components remain in the film in the form of an unreacted substance or a reaction product. Accordingly, the chemical components affect the transparency of the film and the tone of the image, and adversely affect the storage stability of the image. The problems related to the storage stability are more remarkable when the image-forming layer contains a hydrophilic binder, whereby methods for improving such properties have been desired.

SUMMARY OF THE INVENTION

The present invention has been made in consideration of the above problems of conventional techniques. The invention provides a method of producing an organic silver salt dispersion containing organic silver salt particles with a uniform size distribution. The invention further provides a high-quality photothermographic material having a superior coated surface state.

The invention provides a method of producing an organic silver salt dispersion, the method comprising: mixing an aqueous solution A of a water-soluble silver ion supplier and an aqueous solution B of an alkali metal salt of an organic acid to form an organic silver salt dispersion. In the method, the mixing is conducted in the presence of at least one compound selected from polyacrylamide and derivatives of polyacrylamide. For example, the aqueous solution B may further comprise at least one compound selected from polyacrylamide and derivatives of polyacrylamide. At least 10 mass % (in terms of silver quantity) of the organic silver salt in the organic silver salt dispersion is formed by simultaneous addition of the aqueous solution A and the aqueous solution B to an aqueous medium followed by mixing (first addition).

In the method, at least one compound selected from polyacrylamide and derivatives of polyacrylamide may be added (second addition) to the aqueous medium after the addition and mixing of the aqueous solution A and the aqueous solution B.

The compound (used in the first addition or the second addition or both) selected from polyacrylamide and derivatives of polyacrylamide may be a compound represented by the following formula (W1) or (W2).

Formula (W1)

Formula (W2)

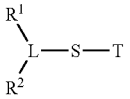

In the above formulae, R represents a hydrophobic group. $R_1$ and $R_2$ each independently represent a hydrogen atom or a hydrophobic group. At least one of $R_1$ and $R_2$ is a hydrophobic group. L represents a divalent connecting group. T represents an oligomer moiety. The hydrophobic group may be selected from a saturated or unsaturated alkyl group, an arylalkyl group, or an alkylaryl group.

The polyacrylamide-based compound used in the first addition and the polyacrylamide-based compound used in the second addition may be the same as each other or different from each other. The polyacrylamide-based compound used in the first addition, or the polyacrylamide-based compound used in the second addition, or both may be selected from compounds each represented by formula (W1) or (W2).

The organic silver salt particles may be nano particles. The average particle diameter of the nano particles may be 5 nm to 400 nm. The standard deviation of the particle size distribution of the organic silver salt particles may be 10% to 30%. Desalination may be conducted by an ultrafiltration method or by an electrodialysis method after formation of the particles of the organic silver salt.

The invention further provides a photothermographic material comprising a support and an image-forming layer provided on at least one side of the support. The image-forming layer includes a photosensitive silver halide, a reducing agent, a binder, and the non-photosensitive organic silver salt produced by the above method. The photothermographic material may include a compound represented by formula (I) or (II).

Formula (I)

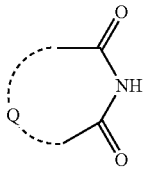

In the formula (I), Q represents an atomic group required for forming a 5- or 6-membered imide ring.

Formula (II)

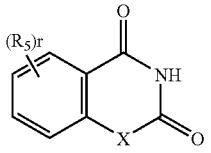

In the formula (II), $R_5$ represents a hydrogen atom, an alkyl group, a cycloalkyl group, an alkoxy group, an alkylthio group, an arylthio group, a hydroxy group, a halogen group, or $N(R_8R_9)$. $R_8$ and $R_9$ each independently represent a hydrogen atom, an alkyl group, an aryl group, a cycloalkyl group, an alkenyl group, or a heterocyclyl group, and r represents 0, 1, or 2. $R_8$ and $R_9$ may be bonded to each other to form a substituted or unsubstituted 5- to 7-membered heterocyclic ring. When there are two $R_5$s, they may be the same as each other or different from each other, and they may be bonded to each other to form an aromatic, heteroaromatic, alicyclic, or heterocyclic condensed ring. X represents O, S, Se, or $N(R_6)$, and $R_6$ represents a hydrogen atom, an alkyl group, an aryl group, a cycloalkyl group, an alkenyl group, or a heterocyclyl group.

In the photothermographic material, at least 30 mass % of the binder of the image-forming layer may be a hydrophilic binder. The hydrophilic binder may be gelatin or a derivative of gelatin. In the photothermographic material, a non-photosensitive layer may be further provided and at least 30 mass % of the binder of the non-photosensitive layer may be a hydrophilic binder. The hydrophilic binder in the non-photosensitive layer may be gelatin or a derivative of gelatin.

In the image-forming layer, the ratio of non-photosensitive organic silver salt to hydrophilic binder may be in the range of 1.0 to 2.5.

In order to obtain organic silver salt fine particles with a uniform size distribution, the present inventor has sought a new preparation method thereof. Generally, an organic silver salt is prepared by mixing a water-soluble silver ion supplier and an organic acid or an alkali metal salt of an organic acid in an aqueous medium. While the water-soluble silver ion supplier such as silver nitrate is highly soluble in water, the organic acid is scarcely soluble in water and even an alkali metal salt of the organic acid has low solubility in water. Therefore, the mixing is conducted generally in a non-homogeneous system in which the organic acid or the alkali metal salt of the organic acid is partially dissolved and partially precipitated. Accordingly, the particle size is not uniform and particles with a wide particle size distribution were formed. It has been known to prepare an organic silver salt in a homogeneous system using a mixed solvent of water and an organic solvent (for example, n-butyl alcohol) (see, for example, Japanese Patent Application Laid-Open (JP-A) No. 2000-007683, the disclosure of which is incorporated herein by reference). However, it has been difficult even with such an improvement to obtain a desired organic silver salt dispersion having uniform particle size distribution.

As a result of earnest study, the present inventor has found that a desired organic silver salt dispersion can be obtained by simultaneously adding a water-soluble silver ion supplier and an alkali metal salt of an organic acid to an aqueous medium and mixing them in the presence of at least one compound selected from polyacrylamide and derivatives of polyacrylamide; as the result, the inventor has made the invention.

Further, the inventor has found that it is effective to form organic silver salt particles in the process for preparing the organic silver salt such that at least 10% of the organic silver salt is formed by the simultaneous addition and mixing, and to add at least one compound selected from polyacrylamide and derivatives thereof after the simultaneous addition and mixing. Further, the inventor has found the preferable conditions. The inventor has further reached the organic silver salt prepared by the method of the invention, and has reached a photothermographic material using the organic acid silver salt. Further, the inventor has found preferable constitutions of the photothermographic material.

DESCRIPTION OF THE PRESENT INVENTION

The present invention is to be described specifically.

1. Method of Preparing Organic Silver Salt Dispersion

The organic silver salt of the invention is prepared in the form of an organic silver salt dispersion which is prepared by mixing an aqueous solution of a water-soluble silver ion supplier (hereinafter sometimes referred to as solution A) and an aqueous solution of alkali metal salt of an organic acid (hereinafter sometimes referred to as solution B). The organic silver salt dispersion is prepared in the presence of at least one compound selected from polyacrylamide and derivatives thereof. For example, the solution B may comprise polyacrylamide or a derivative of polyacrylamide. At least 10% of the organic silver salt is formed by simultaneous addition of the solution A and the solution B to an aqueous medium and mixing. Further, at least one compound selected from polyacrylamide and derivatives thereof may be added to the aqueous medium after the simultaneous addition and mixing.

The compound selected from polyacrylamide and derivatives thereof is preferably a compound represented by the following formula (W1) or (W2).

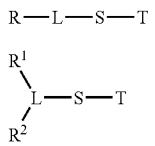

Formula (W1)

Formula (W2)

In the formulae, R represents a hydrophobic group. At least one of $R_1$ and $R_2$ represent a hydrophobic group. L represents a bivalent connecting group. T represents an oligomer moiety.

The number of hydrophobic groups is determined based on the connecting group L. Each hydrophobic group is selected from a saturated or unsaturated alkyl group, an arylalkyl group, and an alkylaryl group. The alkyl moiety of the hydrophobic group may be linear or branched. The number of carbon atoms in the hydrophobic group (R, $R_1$, or $R_2$) is preferably 8 to 21. The bond between the connecting group L and the hydrophobic group is a simple chemical bond, and the bond between the connecting group L and the oligomer moiety T is a thio bond (—S—).

The resultant organic silver salt particles have an average particle size of preferably 5 nm to 400 nm. The distribution of the average particle size is preferably 10 to 40% in terms of the standard deviation value.

The organic silver salt dispersion in the invention may be desalted by a well-known centrifugal filtration method. However, the organic silver salt dispersion is desalted preferably by an ultra-filtration method or by an electric dialysis method.

The organic silver salt is described in detail.

1) Composition

The non-photosensitive organic silver salt used in the invention is an organic silver salt which is relatively stable to light and which supplies a silver ion when heated to 80° C. or higher under the presence of the exposed photosensitive silver halide and the reducing agent, to form a silver image. The organic silver salt may be any organic substance that can be reduced by the reducing agent to provide a silver ion. Such non-photosensitive organic silver salts are described, for example, in JP-A No. 10-62899, Paragraph 0048 to 0049, EP-A No. 0803764A1, Page 18, Line 24 to Page 19, Line 37, EP-A No. 0962812A1, JP-A Nos. 11-349591, 2000-7683, and 2000-72711, the disclosures of which are incorporated herein by reference. The organic silver salt is preferably a silver salt of an organic acid, more preferably a silver salt of a long-chain aliphatic carboxylic acid having 10 to 30 carbon atoms, still more preferably a silver salt of a long-chain aliphatic carboxylic acid having 15 to 28 carbon atoms. Examples of the fatty acid silver salts include silver lignocerate, silver behenate, silver arachidate, silver stearate, silver oleate, silver laurate, silver caproate, silver myristate, silver palmitate, silver erucate, and mixtures thereof. In the invention, the proportion of the amount of silver behenate to the total amount of the organic silver salt is preferably 50 to 100 mol %, more preferably 85 to 100 mol %, still more preferably 95 to 100 mol %. Further, the ratio of the amount of silver erucate to the total amount of the organic silver salts is preferably 2 mol % or less, more preferably 1 mol % or less, further preferably 0.1 mol % or less.

Further, the ratio of the amount of silver stearate to the total amount of the organic silver salts is preferably 1 mol % or lower so as to obtain a photothermographic material with a low Dmin, high sensitivity, and excellent image storability. The ratio of the amount of silver stearate to the total amount of the organic silver salts is more preferably 0.5 mol % or lower. In a preferable embodiment, the organic silver salts include substantially no silver stearate.

When the organic silver salts include silver arachidate, the ratio of the amount of silver arachidate to the total amount of the organic silver salts is preferably 6 mol % or lower from the viewpoint of achieving a low Dmin and excellent image storability. The ratio of the amount of silver arachidate to the total amount of the organic silver salts is more preferably 3 mol % or lower.

2) Shape

The organic silver salt in the invention is preferably nanoparticles. The average particle diameter of the organic silver salt particles is preferably 5 nm to 400 nm, more preferably 10 nm to 200 nm.

When the average particle diameter is smaller than the above range, the particle shape may change during storage owing to dissolution in water, whereby stable particles are unlikely to be obtained.

When the average particle diameter is larger than the above range, the developed silver particles are likely to be coarse and non-homogenous, and the particle properties are likely to be deteriorated.

The shape of the grains of the organic silver salt is not particularly restricted. The organic silver salt grains may be in a needle shape, a rod shape, a tabular shape, or a flaky shape.

In the invention, the organic silver salt grains are preferably in a flaky shape. It is also preferable to use organic silver salt grains in a short needle-shape, a rectangular shape, a cubic shape, or a potato-like shape, wherein each shape has a ratio of the longer axis to the shorter axis of lower than 5. Such organic silver salt grains cause less fogging which develops on the resultant photothermographic material in the heat development than long needle-shaped grains having a length ratio of the longer axis to the shorter axis of 5 or higher. The ratio of the longer axis to the shorter axis is more preferably 3 or lower, since the mechanical stability of the coating film is improved when organic silver salt grains having such a shape are used. In the invention, organic silver salt grains in a flaky shape are defined as follows. Organic silver salt grains are observed by an electron microscope, and the shape of each grain is approximated by a rectangular parallelepiped shape. The lengths of the three sides of the rectangular parallelepiped shape are respectively represented by a, b, and c in the ascending order (wherein c and b may be the same values), and a value x is calculated from the smaller values a and b using the following equation: x=b/a. The values x of approximately 200 grains are calculated in the above-described manner to obtain an average x (the average of the values x). The organic silver salt grains in a flaky shape are defined as grains with an average x of 1.5 or larger. The average x is preferably 1.5 to 30, more preferably 1.5 to 15. In contrast, the organic silver salt grains in a needle-shape are defined as grains with an average x of 1 or larger but smaller than 1.5.

In the flaky grains (grains in a flaky shape), the length a may be considered as the thickness of a tabular grain having a main plane defined by the sides with the lengths b and c. The average of the lengths a of the grains is preferably 10 nm to 500 nm, more preferably 20 nm to 300 μm. The average of values c/b of the grains is preferably 1 to 9, more preferably 1 to 6, furthermore preferably 1 to 4, most preferably 1 to 3.

In the invention, the equivalent sphere diameter is measured by: directly photographing a sample using an electron microscope, and then image-processing the negative.

The aspect ratio of the flaky grain is defined as the value of the equivalent sphere diameter/a. The aspect ratio of the flaky grain is preferably 1.1 to 30, more preferably 1.1 to 15, so as to prevent the aggregation of the grains in the photosensitive material, thereby improving the image storability.

The grain size distribution of the organic silver salt grains is preferably monodisperse distribution. In the monodisperse distribution, the percentage obtained by dividing the standard deviation of the length of the longer axis by the length of the longer axis and the percentage obtained by dividing the standard deviation of the length of the shorter axis by the length of the shorter axis are preferably 100% or lower, more preferably 60% or less, further preferably 40% or less. In order to observe the shape of the organic silver salt grain, a transmission electron microscope may be used to give a micrograph of the organic silver salt dispersion. Alternatively, the monodisperse distribution may be evaluated based on the standard deviation of the volume-weighted average diameter of the organic silver salt grains, and the percentage (the variation coefficient) obtained by dividing the standard deviation by the volume-weighted average diameter is preferably 100% or lower, more preferably 60% or lower, further preferably 40% or lower. For example, the grain size (the volume-weighted average diameter) may be measured by: dispersing the organic silver salt grains in a liquid, and exposing the dispersion to a laser light and obtaining the autocorrelation function of fluctuation of the scattering light to time.

3) Preparation

The organic silver salt in the invention is prepared in the form of an organic silver salt dispersion. The organic silver salt dispersion is prepared by: mixing an aqueous solution of a water-soluble silver ion supplier (hereinafter referred to as a solution A) and an aqueous solution of an alkali metal salt of an organic acid (hereinafter referred to as a solution B). The organic silver salt dispersion is prepared in the presence of at least one compound selected from polyacrylamide and derivatives thereof. For example, the solution B may comprise polyacrylamide or a derivative of polyacrylamide. At least 10% of the organic silver salt is formed by simultaneous addition of the solution A and the solution B to an aqueous medium followed by mixing. Further, at least one compound selected from polyacrylamide and derivatives thereof is added to the aqueous medium after the simultaneous addition and mixing.

(Description of Simultaneous Mixing of Solution A and Solution B with an Aqueous Medium)

In conventional techniques, when at least 10 mass % of the organic silver salt particles is formed by simultaneous addition of the solution A and the solution B to an aqueous medium and mixing, it is necessary to use an alcohol such as t-butanol for achieving homogenous mixing. However, since the solubility of the organic silver salt is increased in this method, it is difficult to maintain the particle size small. The inventor has found that when the simultaneous addition and mixing are conducted in the presence of at least one compound selected from polyacrylamide and derivatives thereof according to the invention, homogenous and remarkably small organic silver salt particles are formed. Further, the inventor has, surprisingly, found that uniform graininess can be obtained when the method of the invention is applied to photothermographic materials, and that highly-sensitive photothermographic materials with low Dmin can be obtained advantageously.

The solution A used in the invention, which is an aqueous solution containing silver ions, is an acidic solution. Specifically, the solution A may have a pH of 6 or less, preferably 2 to 6, more preferably 3.5 to 6.

Any acid or alkali can be added to the solution A for pH control.

The silver ion concentration in the solution A is not particularly limited, and the molar concentration of silver ion is preferably 0.03 mol/L to 6.5 mol/L, more preferably 0.1 mol/L to 5 mol/L.

The fatty acid used in the solution B, which is an aqueous solution of an alkali metal salt of a fatty acid, is capable of forming an organic silver salt which is relatively stable to light and which supplies a silver ion when heated to 80° C. or higher in the presence of exposed photocatalyst (such as a latent image of photosensitive silver halide) and a reducing agent, to form a silver image. The fatty acid is preferably a long-chain aliphatic carboxylic acid having 10 to 30 (more preferably 12 to 26) carbon atoms. Preferable examples of the long-chain aliphatic carboxylic acid include cerotic acid, lignoserinic acid, behenic acid, erucic acid, arachidic acid, stearic acid, oleic acid, lauric acid, caproic acid, mirystic acid, palmitic acid, maleic acid, fumaric acid, tartaric acid, linolic acid, butyric acid, camphoric acid and mixtures of some of the above organic acids.

The alkali metal salt used in the invention may be a salt of Na or K. The alkali metal salt of a fatty acid is prepared by adding NaOH or KOH to the fatty acid. In the preparation of the alkali metal salt of a fatty acid, it is preferable to set the amount of alkali at an amount which is not more than the equivalent amount to the fatty acid, thereby partially leaving unreacted fatty acid. The residual amount of the (unreacted) fatty acid is, based on the total amount of the fatty acid, preferably 3 mol % to 50 mol %, more preferably, 3 mol % to 30 mol %. In an embodiment, in the preparation of the alkali metal salt of a fatty acid, alkali is added in an amount which is not smaller than the desired amount, and then an acid such as nitric acid or sulfuric acid is added to neutralize the excess alkali.

The pH of the solution B can be determined based on the required characteristics of the fatty acid silver salt. The pH can be controlled with an arbitrary acid or alkali.

To the solution A and solution B or the solution in the reaction vessel to which the solution A and the solution B are to be added, compounds such as the following may be added: compounds represented by the formula (1) in JP-A No. 62-65035 (the disclosure of which is incorporated herein by reference), nitrogen-containing heterocyclic compound having water-soluble groups such as described in JP-A No. 62-150240 (the disclosure of which is incorporated herein by reference), inorganic peroxides such as described in JP-A No. 50-101019 (the disclosure of which is incorporated herein by reference), sulfur compounds such as described in JP-A No. 51-78319 (the disclosure of which is incorporated herein by reference), disulfide compounds such as described in JP-A No. 57-643 (the disclosure of which is incorporated herein by reference), and hydrogen peroxide.

The concentration of the alkali metal salt of the fatty acid in the solution B may be 5 mass % to 50 mass %, preferably 7 mass % to 45 mass %, more preferably 10 mass % to 40 mass %. A concentration of lower than 5 mass % is not preferable from the viewpoint of performance since the photothermographic material obtained by using a fatty acid silver salt prepared by using a solution B having such a concentration tends to develop fogging during storage. Further, when the concentration exceeds 50 mass %, the viscosity of the solution B is excessively high and the high viscosity causes problems related to transfer of the liquid. Such problems are not preferable from the viewpoint of production process.

In the invention, a desired fatty acid silver salt is prepared by simultaneously adding the solution A and the solution B to an aqueous medium. In the invention, during the period in which the solution A and the solution B are simultaneously added, at least 10 mass % (preferably at least 25 mass %, more preferably at least 50 mass %) of the total addition amount of silver is added. Similarly, during the period in which the solution A and the solution B are simultaneously added, at least 10 mass % (preferably at least 25 mass %, more preferably at least 50 mass %) of the total addition amount of organic acid is added. When addition of one of the solutions A and B is initiated before start of the addition of the other solution, it is preferable to start the addition of the solution A first.

The temperatures of the solution A and of the solution B may be set at an appropriate temperature so as to control the required characteristics of the fatty acid silver salt, such as the particle size. The temperature of the solution B is preferably 5° C. to 80° C., more preferably 10° C. to 50° C. for the purpose of ensuring the liquid stability. The solution B is preferably kept at 30° C. to 90° C., more preferably 60° C. to 85° C. for the purpose of keeping the temperature at which the crystallization and solidification of the alkali soap are prevented.

(Polyacrylamide and Derivatives Thereof)

Polyacrylamide and derivatives thereof used in the invention are to be described.

The compound selected from polyacrylamide and derivatives thereof is preferably a compound represented by the following formula (W1) or (W2).

Formula (W1)

Formula (W2)

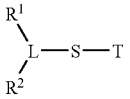

In the formulae, R represents a hydrophobic group. At least one of $R_1$ and $R_2$ represent a hydrophobic group. L represents a bivalent connecting group. T represents an oligomer moiety.

The number of hydrophobic groups is determined based on the connecting group L. Each hydrophobic group is selected from a saturated or unsaturated alkyl group, an arylalkyl group, and an alkylaryl group. The alkyl moiety of the hydrophobic group may be linear or branched. The number of carbon atoms in the hydrophobic group (R, $R_1$, or $R_2$) is preferably 8 to 21. The bond between the connecting group L and the hydrophobic group is a simple chemical bond, and the bond between the connecting group L and the oligomer moiety T is a thio bond (—S—). Typical examples of a connecting group bound to one hydrophobic group is indicated in an italic form in the following formulae:

Formula (Wa)

Formula (Wb)

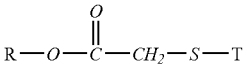

Formula (Wc)

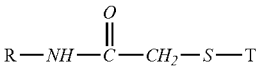

Typical examples of a connecting group bound to two hydrophobic groups are indicated in an italic form in the following formulae.

Formula (Wd)

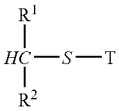

Formula (We)

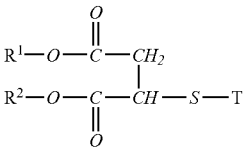

Formula (Wf)

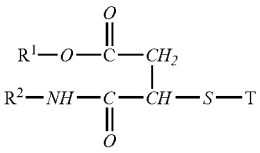

The oligomer group T is introduced by oligomerization of a vinyl monomer having an amide functional group. The vinyl moiety enables oligomerization, and the amide moiety provides a non-ionic polar group which constitutes a hydrophilic functional group (after oligomerization). The oligomer group T may be formed from one type of monomer. Alternatively, the oligomer group T may be formed from a mixture of monomers so long as the formed oligomer chain is sufficiently hydrophilic to dissolve or disperse the resultant surface active material in water. Examples of the monomer used to form the oligomer chain T include acrylamide, methacylamide, acrylamide derivatives, methacrylamide derivatives, and 2-vinylpyrrolidone.

The monomers can be represented by the following two types of formulae:

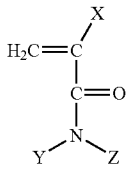

Acrylamide, methacrylamide, a derivative of acrylamide, or a derivative of methacrylamide

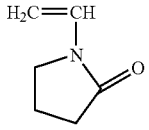

2-vinylpyrrolidone

X represents a hydrogen atom or an alkyl group having 1 to 10 carbon atoms, preferably a hydrogen atom or a methyl group. Y and Z each independently represent a hydrogen atom, an alkyl group having 1 to 10 carbon atoms, or a substituted alkyl group having 1 to 10 carbon atoms. Y and Z each preferably represent a hydrogen atom, a methyl group, an ethyl group, or —$C(CH_2OH)_3$. X and Y may be the same as or different from each other.

The number of repeating units in the oligomer group T is 20 or fewer, preferably 5 to 15. Specific examples of the compound selected from polyacrylamide and derivatives thereof used in the invention are shown below without intention to limit the invention.

BUN-1

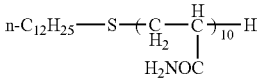

BUN-2

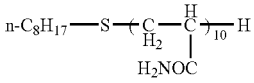

BUN-3

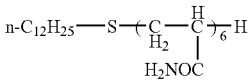

BUN-4

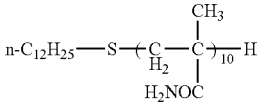

BUN-5

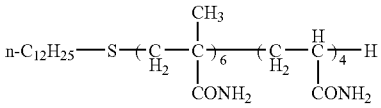

BUN-6

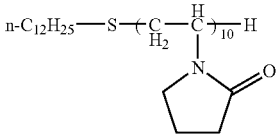

-continued

BUN-7

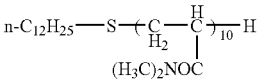

BUN-8

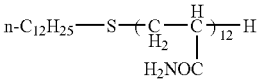

BUN-9

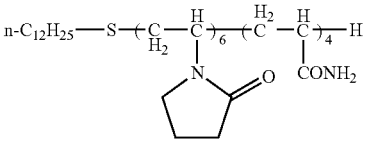

BUN-10

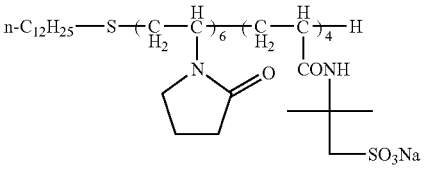

The oligomer surfactant comprising the vinyl polymer having an amide functional group described above as the main component can be prepared by a method known in the technical field of the art.

When the solution B contains at least one compound selected from polyacrylamide and derivatives thereof, the amount of the at least one compound selected from polyacrylamide and derivatives thereof contained in the solution B is generally 1 to 20 mass % based on the amount of the organic acid, preferably 5 to 15 mass % based on the amount of the organic acid.

In an embodiment, at least one compound selected from polyacrylamide and derivatives of polyacrylamide is further added (second addition) to the mixture obtained by the addition of the aqueous solution A and the aqueous solution B to the aqueous medium. In this embodiment, the amount of the at least one compound selected from polyacrylamide and derivatives of polyacrylamide to be further added is generally 1 to 20 mass % based on the amount of the organic silver salt, preferably 5 to 15 mass % based on the amount of the organic silver salt.

When the organic silver salt grains are dispersed in the presence of a photosensitive silver salt, the fogging is intensified and the sensitivity is remarkably reduced. Thus, in a preferable embodiment, substantially no photosensitive silver salts are present when the organic silver salt grains are dispersed. In the invention, the amount of photosensitive silver salts in the aqueous dispersion liquid of the organic silver salt is preferably 1 mol % or less, more preferably 0.1 mol % or less, per 1 mol of the organic silver salt. It is more preferable not to add photosensitive silver salts to the dispersion liquid actively.

In an embodiment, the photosensitive material is prepared by processes comprising mixing an aqueous organic silver salt dispersion liquid with an aqueous photosensitive silver salt dispersion liquid. The mixing ratio between the organic silver salt and the photosensitive silver salt may be selected depending on the use of the photosensitive material. The mole ratio of photosensitive silver salt to organic silver salt is preferably 1 mol % to 30 mol %, more preferably 2 to 20 mol %, particularly preferably 3 to 15 mol %. It is preferable to mix two or more aqueous organic silver salt dispersion liquids and two or more aqueous photosensitive silver salt dispersion liquids so as to adjust the photographic properties.

In addition to the above, the following documents can be referenced for the preparation and production of the organic silver salt: JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, the disclosures of which are incorporated herein by reference.

4) Addition Amount

The amount of the organic silver salt may be selected without particular restrictions, and the total amount of the applied silver (including the photosensitive silver halide) is preferably 0.1 g/m$^2$ to 5.0 g/m$^2$, more preferably 0.3 g/m$^2$ to 3.0 g/m$^2$, furthermore preferably 0.5 g/m$^2$ to 2.0 g/m$^2$. In order to improve the image storability, the total amount of the applied silver is preferably 1.8 g/m$^2$ or less, more preferably 1.6 g/m$^2$ or less.

2. Photothermographic Material

The photothermographic material according to the invention comprises a support and an image-forming layer provided on at least one side of the support. The image-forming layer comprises a non-photosensitive organic silver salt, a photosensitive silver halide, a reducing agent and a binder. The non-photosensitive organic silver salt is produced by the above production method.

The photothermographic material of the invention preferably contains at least one compound represented by the following formula (I) or (II).

In the invention, the binder of the image-forming layer has a proportion of hydrophilic binder of preferably 30 mass % or higher. The hydrophilic binder is preferably gelatin or a gelatin derivative.

In an embodiment, the photothermographic material has a non-photosensitive layer on the side of the image-forming layer which side is further from the support. The non-photosensitive layer preferably has a proportion of hydrophilic binder of 50 mass % or higher. The hydrophilic binder in the non-photosensitive layer is preferably gelatin or a gelatin derivative. Further, in the image-forming layer, the mass ratio of non-photosensitive organic silver salt to hydrophilic binder is preferably in the range of 1.0 to 2.5.

The photothermographic material of the invention includes a heat developing agent which is a reducing agent for the organic silver salt. The reducing agent is preferably a so-called hindered phenol reducing agent having a substituent at an ortho position relative to the phenolic hydroxyl group, or a bisphenol reducing agent, particularly preferably a compound represented by the following formula (R).

Formula (R)

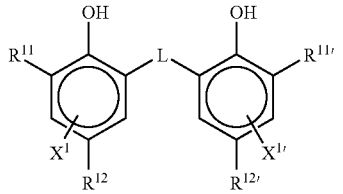

In the formula (R), $R^{11}$ and $R^{11'}$ each independently represent an alkyl group, and at least one of $R^{11}$ and $R^{11'}$ represents a secondary or tertiary alkyl group; $R^{12}$ and $R^{12'}$ each independently represent a hydrogen atom or a substituent which can be bonded to the benzene ring; L represents an —S— group or a —CHR$^{13}$— group, and $R^{13}$ represents a hydrogen atom or an alkyl group; $X^1$ and $X^{1'}$ each independently represent a hydrogen atom or a substituent which can be bonded to the benzene ring.

The formula (R) is described in detail below. In the following, the scope of the term "an alkyl group" encompasses "a cycloalkyl group" unless mentioned otherwise.

1) $R^{11}$ and $R^{11'}$ $R^{11}$ and $R^{11'}$ each independently represent a substituted or unsubstituted alkyl group having 1 to 20 carbon atoms. At least one of $R^{11}$ and $R^{11'}$ represents a secondary or tertiary alkyl group. There are no particular restrictions on the substituents on the alkyl group. Examples of preferred substituents on the alkyl group include aryl groups, a hydroxy group, alkoxy groups, aryloxy groups, alkylthio groups, arylthio groups, acylamino groups, sulfonamide groups, sulfonyl groups, phosphoryl groups, acyl groups, carbamoyl groups, ester groups, ureido groups, urethane groups, and halogen atoms.

2) $R^{12}$ and $R^{12'}$ and $X^1$ and $X^{1'}$ $R^{12}$ and $R^{12'}$ each independently represent a hydrogen atom or a substituent which can be bonded to the benzene ring. Also $X^1$ and $X^{1'}$ each independently represent a hydrogen atom or a substituent which can be bonded to the benzene ring. Examples of preferable substituents which can be bonded to the benzene ring include alkyl groups, aryl groups, halogen atoms, alkoxy groups, and acylamino groups.

3) L

L represents an —S— group or a —CHR$^{13}$— group. $R^{13}$ represents a hydrogen atom or an alkyl group having 1 to 20 carbon atoms, and the alkyl group may have a substituent. When $R^{13}$ represents an unsubstituted alkyl group, examples thereof include a methyl group, an ethyl group, a propyl group, a butyl group, a heptyl group, an undecyl group, an isopropyl group, a 1-ethylpentyl group, a 2,4,4-trimethylpentyl group, a cyclohexyl group, a 2,4-dimethyl-3-cyclohexenyl group, and a 3,5-dimethyl-3-cyclohexenyl group. Examples of the substituent on the alkyl group represented by $R^{13}$ include the substituents described above as examples of the substituents on $R^{11}$. The substituent on the alkyl group may be a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, or a sulfamoyl group.

4) Preferred Substituents $R^{11}$ and $R^{11'}$ are each preferably a secondary or tertiary alkyl group having 1 to 15 carbon atom. Specific examples of such an alkyl group include an isopropyl group, a t-butyl group, a t-octyl group, a cyclohexyl group, a cyclopentyl group, a 1-methyl cyclohexyl group, and a 1-methylcyclopropyl group. $R^{11}$ and $R^{11'}$ each are more preferably a t-butyl group, a t-amyl group, or a 1-methylcyclohexyl group, most preferably a t-butyl group.

$R^{12}$ and $R^{12'}$ are each preferably an alkyl group having 1 to 20 carbon atoms, and specific examples thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, and a methoxyethyl group. $R^{12}$ and $R^{12'}$ are each more preferably a methyl group, an ethyl group, a propyl group, an isopropyl group, or a t-butyl group, particularly preferably a methyl group or an ethyl group.

$X^1$ and $X^{1'}$ are each preferably a hydrogen atom, a halogen atom, or an alkyl group, more preferably a hydrogen atom.

L is preferably a —CHR$^{13}$— group.

R$^{13}$ is preferably a hydrogen atom or an alkyl group having 1 to 15 carbon atoms. The alkyl group may be a linear alkyl group or a cyclic alkyl group, and may have a C=C bond. The alkyl group is preferably a methyl group, an ethyl group, a propyl group, an isopropyl group, a 2,4,4-trimethylpentyl group, a cyclohexyl group, a 2,4-dimethyl-3-cyclohexenyl group, or a 3,5-dimethyl-3-cyclohexenyl group. R$^{13}$ is particularly preferably a hydrogen atom, a methyl group, an ethyl group, a propyl group, an isopropyl group, or a 2,4-dimethyl-3-cyclohexenyl group.

When R$^{11}$ and R$^{11'}$ are tertiary alkyl groups and R$^{12}$ and R$^{12'}$ are methyl groups, R$^{13}$ is preferably a primary or secondary alkyl group having 1 to 8 carbon atoms such as a methyl group, an ethyl group, a propyl group, an isopropyl group, or a 2,4-dimethyl-3-cyclohexenyl group.

When R$^{11}$ and R$^{11'}$ are tertiary alkyl groups and R$^{12}$ and R$^{12'}$ are alkyl groups other than methyl, R$^{13}$ is preferably a hydrogen atom.

When none of R$^{11}$ and R$^{11'}$ is a tertiary alkyl group, R$^{13}$ is preferably a hydrogen atom or a secondary alkyl group, particularly preferably a secondary alkyl group. The secondary alkyl group is preferably an isopropyl group or a 2,4-dimethyl-3-cyclohexenyl group.

The combination of R$^{11}$, R$^{11'}$, R$^{12}$, R$^{12'}$ and R$^{13}$ affects the heat developability of the resultant photothermographic material, the tone of the developed silver, and the like. It is preferable to use a combination of two or more reducing agents depending on the purpose since such properties can be adjusted by the combination of the reducing agents.

Examples of the reducing agent used in the invention, such as the compound represented by formula (R), are shown below. However, reducing agents usable in the invention are not limited to the examples.

R1-1

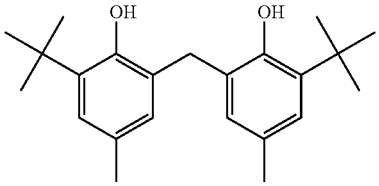

R1-2

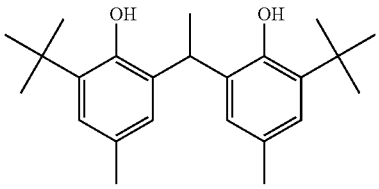

R1-3

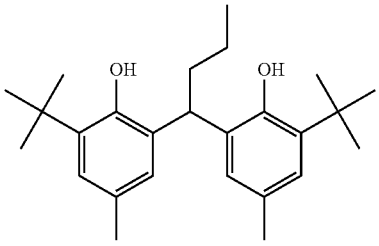

-continued

R1-4

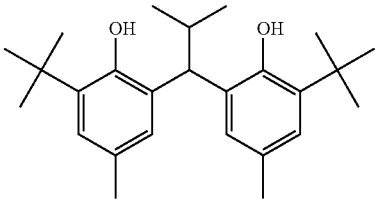

R1-5

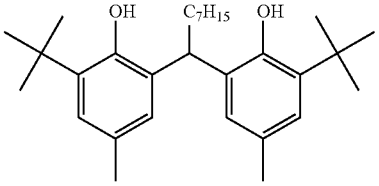

R1-6

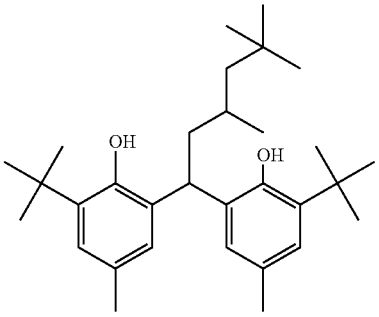

R1-7

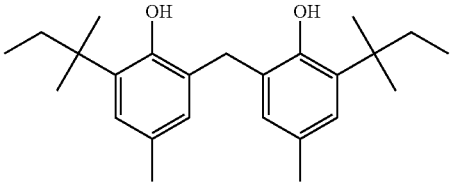

R1-8

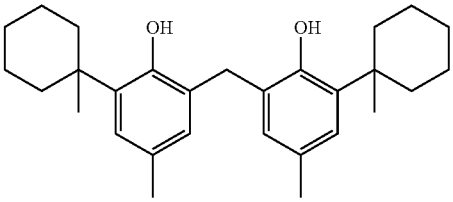

R1-9

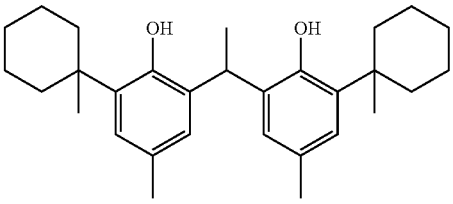

R1-10

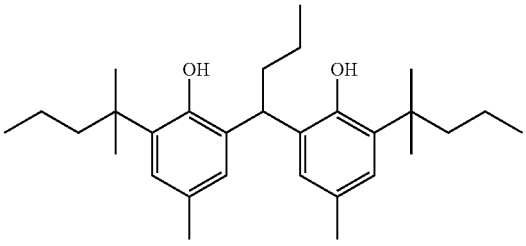

-continued
R1-11
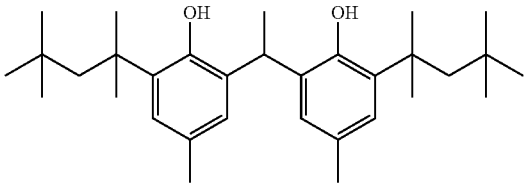
R1-12
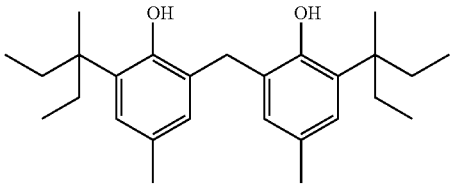
R1-13
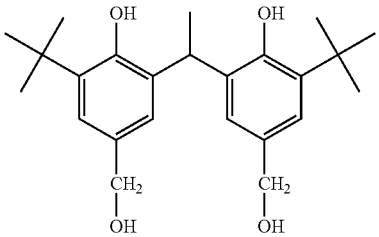
R1-14
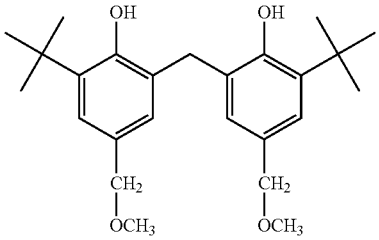
R1-15
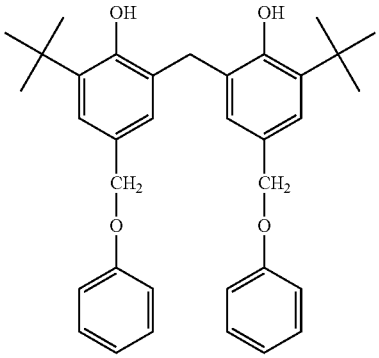
R1-16
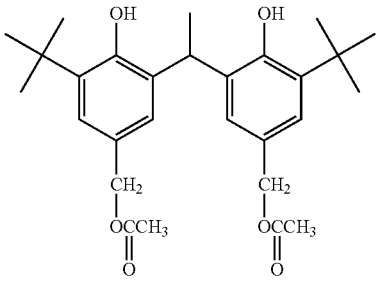
-continued
R1-17
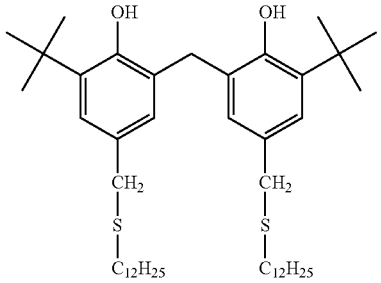
R1-18
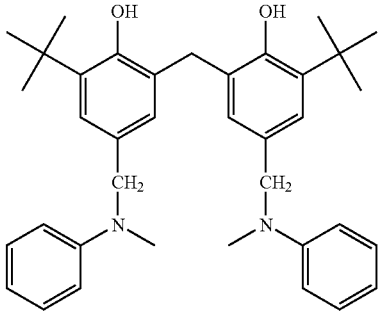
R1-19
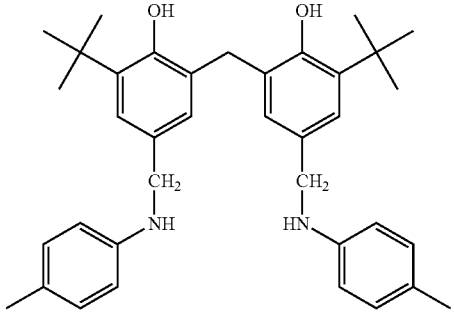
R1-20
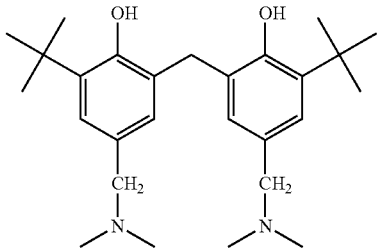
R1-21
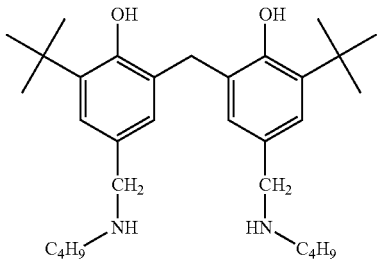

-continued
R1-22
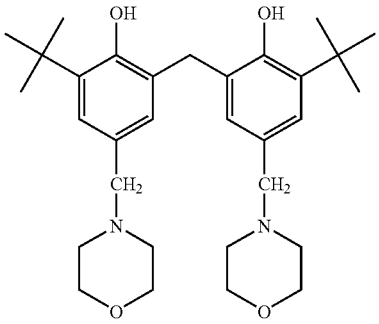
R1-23
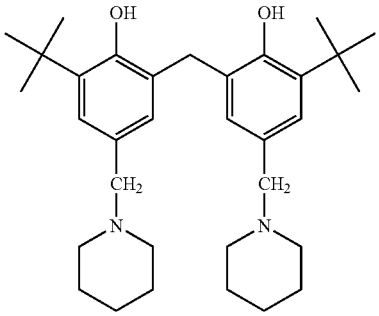
R1-24
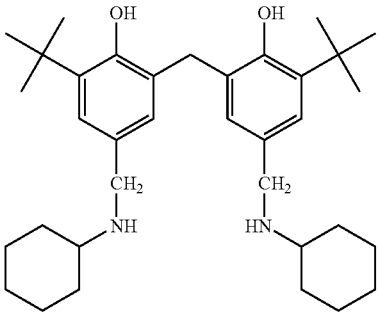
R1-25
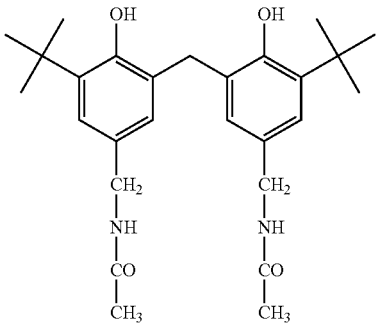
R1-26
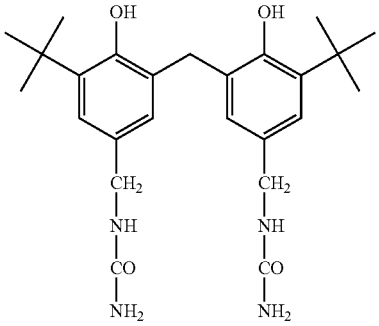
-continued
R1-27
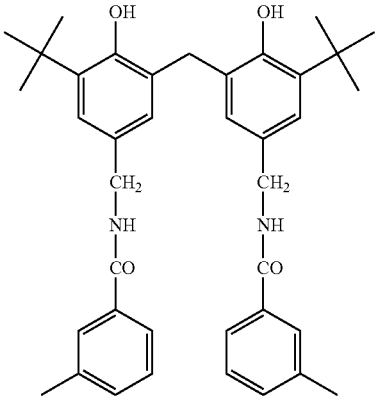
R1-28
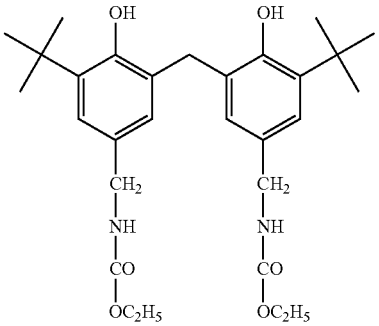
R1-29
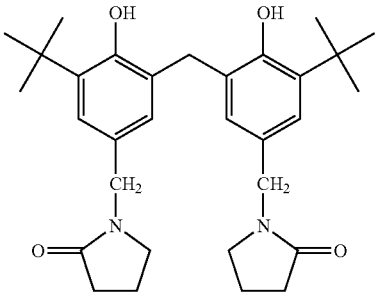
R1-30
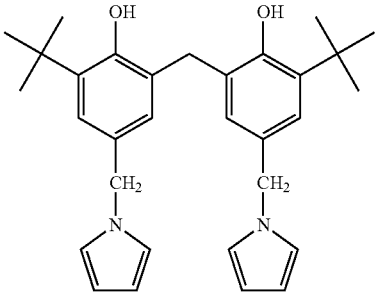

-continued

R1-31

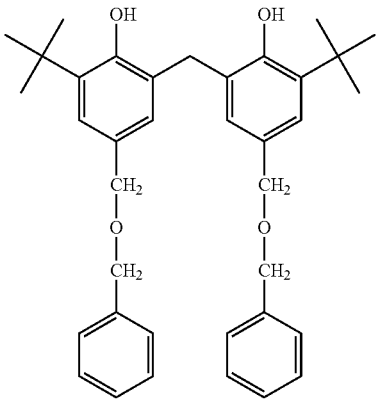

R1-32

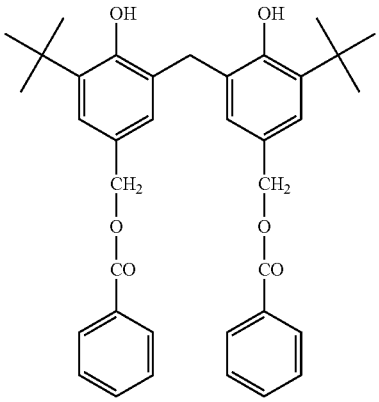

R1-33

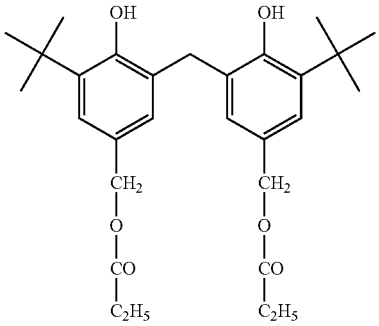

R1-34

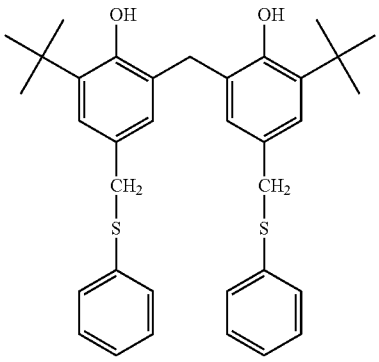

-continued

R1-35

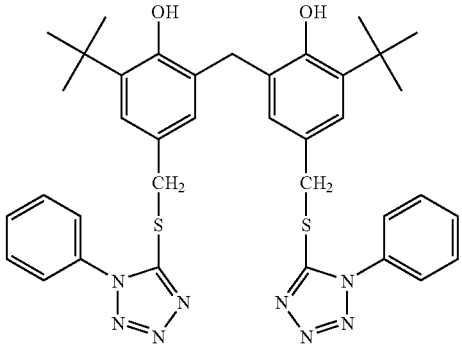

R1-36

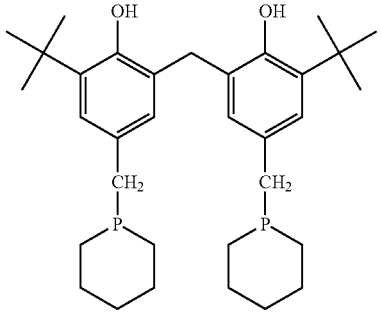

In addition, preferable reducing agents are also disclosed in JP-A Nos. 2001-188314, 2001-209145, 2001-350235, and 200-156727, and EP 1278101A2, the disclosures of which are incorporated herein by reference.

The amount of the reducing agent in the photothermographic material is preferably 0.1 to 3.0 g/m$^2$, more preferably 0.2 to 2.0 g/m$^2$, furthermore preferably 0.3 to 1.0 g/m$^2$. Further, the mole ratio of reducing agent to silver on the image-forming layer side is preferably 5 to 50 mol %, more preferably 8 to 30 mol %, further preferably 10 to 20 mol %.

The reducing agent may be added to any layer on the image-forming layer side, preferably to the image-forming layer.

The state of the reducing agent in the coating liquid may be any state such as a solution, an emulsion, a solid particle dispersion.

The emulsion of the reducing agent may be prepared by a well-known emulsifying method. The exemplary method comprises: dissolving the reducing agent in an oil such as dibutyl phthalate, tricresyl phosphate, dioctyl sebacate, or tri(2-ethylhexyl)phosphate, optionally using a cosolvent such as ethyl acetate or cyclohexanone; and then mechanically emulsifying the reducing agent in the presence of a surfactant such as sodium dodecylbenzene sulfonate, sodium oleoyl-N-methyltaurinate, or sodium di(2-ethylhexyl)sulfosuccinate. In this method, it is preferable to add a polymer such as α-methylstyrene oligomer or poly(t-butylacrylamide) to the emulsion in order to control the viscosity and the refractive index of the oil droplets.

In an embodiment, the solid particle dispersion is prepared by a method comprising dispersing powder of the reducing agent in an appropriate solvent such as water using a ball mill, a colloid mill, a vibration ball mill, a sand mill, a jet mill, a roll mill, or ultrasonic wave. A protective colloid (e.g. a polyvinyl alcohol) and/or a surfactant such as an anionic surfactant (e.g. a mixture of sodium triisopropylnaphthalenesulfonates each having a different combination of the substitution positions of the three isopropyl groups) may be used in the preparation. Beads of zirconia, etc. are commonly used as a dispersing medium in the above mills, and in some cases Zr, etc. is eluted from the beads and mixed with the dispersion. The amount of the eluted and mixed component depends on the dispersion conditions, and is generally within the range of 1 to 1,000 ppm. The eluted zirconia does not cause practical problems as long as the amount of Zr in the photothermographic material is 0.5 mg or smaller per 1 g of silver.

In a preferable embodiment, the aqueous dispersion includes an antiseptic agent such as a benzoisothiazolinone sodium salt.

The reducing agent is particularly preferably used in the state of a solid particle dispersion. The reducing agent is preferably added in the form of fine particles having an average particle diameter of 0.01 to 10 μm, more preferably 0.05 to 5 μm, further preferably 0.1 to 2 μm. In the invention, the particle diameters of particles in other solid dispersions are preferably in the above range.

(Development Accelerator)

The photothermographic material of the invention preferably includes a development accelerator, and preferred examples thereof include sulfonamidephenol compounds represented by the formula (A) such as described in JP-A Nos. 2000-267222 and 2000-330234; hindered phenol compounds such as hindered phenol compounds represented by the formula (II) described in JP-A No. 2001-92075; hydrazine compounds such as hydrazine compounds represented by the formula (I) described in JP-A Nos. 10-62895 and 11-15116; hydrazine compounds represented by the formula (D) described in JP-A No. 2002-156727; hydrazine compounds represented by the formula (1) described in JP-A No. 2002-278017; phenol compounds and naphthol compounds such as phenol compounds and naphthol compounds represented by the formula (2) described in JP-A No. 2001-264929; phenol compounds described in JP-A Nos. 2002-311533 and 2002-341484; and naphthol compounds described in JP-A No. 2003-66558. The disclosures of the above patent documents are incorporated herein by reference. Naphthol compounds described in JP-A No. 2003-66558 are preferable.

The mol ratio of development accelerator to reducing agent may be 0.1 to 20 mol %, preferably 0.5 to 10 mol %, more preferably 1 to 5 mol %.

The development accelerator may be added to the photothermographic material in any of the manners described above as examples of the method of adding the reducing agent. The development accelerator is particularly preferably added in the form of a solid dispersion or an emulsion. The emulsion of the development accelerator is preferably a dispersion prepared by emulsifying the development accelerator in a mixture of a high-boiling-point solvent that is solid at ordinary temperature and a low-boiling-point cosolvent, or a so-called oilless emulsion which includes no high-boiling-point solvents.

In the invention, the hydrazine compounds described in JP-A Nos. 2002-156727 and 2002-278017, and the naphthol compounds described in JP-A No. 2003-66558 are more preferable development accelerators.

In the invention, the development accelerator is particularly preferably a compound represented by the following formula (A-1) or (A-2).

Q1-NHNH-Q2 Formula (A-1);

In the formula (A-1), Q1 represents an aromatic group or a heterocyclic group each of which has a carbon atom bonded to the —NHNH-Q2 group. Q2 represents a carbamoyl group, an acyl group, an alkoxycarbonyl group, an aryloxycarbonyl group, a sulfonyl group, or a sulfamoyl group.

In the formula (A-1), the aromatic group or the heterocyclic group represented by Q1 preferably has a 5- to 7-membered unsaturated ring. Examples of the 5- to 7-membered unsaturated ring include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isoxazole ring, a thiophene ring, and condensed rings thereof.

The ring may have a substituent. When the ring has two or more substituents, they may be the same as each other or different from each other. Examples of the substituents include halogen atoms, alkyl groups, aryl groups, carbonamide groups, alkylsulfonamide groups, arylsulfonamide groups, alkoxy groups, aryloxy groups, alkylthio groups, arylthio groups, carbamoyl groups, sulfamoyl groups, a cyano group, alkylsulfonyl groups, arylsulfonyl groups, alkoxycarbonyl groups, aryloxycarbonyl groups, and acyl groups. These substituents may further have substituents, and preferred examples thereof include halogen atoms, alkyl groups, aryl groups, carbonamide groups, alkylsulfonamide groups, arylsulfonamide groups, alkoxy groups, aryloxy groups, alkylthio groups, arylthio groups, acyl groups, alkoxycarbonyl groups, aryloxycarbonyl groups, carbamoyl groups, a cyano group, sulfamoyl groups, alkylsulfonyl groups, arylsulfonyl groups, and acyloxy groups.

When Q2 represents a carbamoyl group, the carbamoyl group preferably has 1 to 50 carbon atoms, and more preferably has 6 to 40 carbon atoms. Examples of the carbamoyl group include unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphtylcarbamoyl, N-3-pyridylcarbamoyl, and N-benzylcarbamoyl.

When Q2 represents an acyl group, the acyl group preferably has 1 to 50 carbon atoms, and more preferably has 6 to 40 carbon atoms. Examples of the acyl group include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl.

When Q2 represents an alkoxycarbonyl group, the alkoxycarbonyl group preferably has 2 to 50 carbon atoms, and more preferably has 6 to 40 carbon atoms. Examples of the alkoxycarbonyl group include methoxycarbonyl, ethoxycarbonyl, isobutyloxycarbonyl, cyclohexyloxycarbonyl, dodecyloxycarbonyl, and benzyloxycarbonyl.

When Q2 represents an aryloxycarbonyl group, the aryloxycarbonyl group preferably has 7 to 50 carbon atoms, and more preferably has 7 to 40 carbon atoms. Examples of the aryloxycarbonyl group include phenoxycarbonyl, 4-octyloxyphenoxycarbonyl, 2-hydroxymethylphenoxycarbonyl, and 4-dodecyloxyphenoxycarbonyl.

When Q2 represents a sulfonyl group, the sulfonyl group preferably has 1 to 50 carbon atoms, and more preferably has 6 to 40 carbon atoms. Examples of the sulfonyl groups include methylsulfonyl, butylsulfonyl, octylsulfonyl, 2-hexadecylsulfonyl, 3-dodecyloxypropylsulfonyl, 2-octyloxy-5-tert-octylphenylsulfonyl, and 4-dodecyloxyphenylsulfonyl.

When Q2 represents a sulfamoyl group, the sulfamoyl group preferably has 0 to 50 carbon atoms, and more preferably has 6 to 40 carbon atoms. Examples of the sulfamoyl group include unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl.

The group represented by Q2 may have a substituent selected from the groups described above as examples of the substituent on the 5- to 7-membered unsaturated ring of Q1. When the group represented by Q2 has two or more substituents, the substituents may be the same as each other or different from each other.

Next, preferable range of the compound represented by formula (A-1) is described. The group represented by Q1 preferably has a 5- or 6-membered unsaturated ring, and more preferably has a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isoxazole ring, or a condensed ring in which any of the above rings is fused with a benzene ring or with an unsaturated heterocycle. Q2 represents preferably a carbamoyl group, particularly preferably a carbamoyl group having a hydrogen atom on the nitrogen atom.

Formula (A-2)

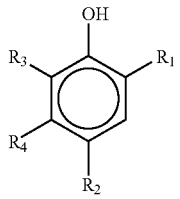

In the formula (A-2), $R_1$ represents an alkyl group, an acyl group, an acylamino group, a sulfonamide group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group, or a carbonic acid ester group. $R_3$ and $R_4$ each independently represent a substituent which can be bonded to the benzene ring, which may be selected from the substituents described above in the explanation on the formula (A-1). $R_3$ and $R_4$ may combine to form a condensed ring.

$R_1$ represents preferably: an alkyl group having 1 to 20 carbon atoms such as a methyl group, an ethyl group, an isopropyl group, a butyl group, a tert-octyl group, or a cyclohexyl group; an acylamino group such as an acetylamino group, a benzoylamino group, a methylureido group, or a 4-cyanophenylureido group; or a carbamoyl group such as an n-butylcarbamoyl group, an N,N-diethylcarbamoyl group, a phenylcarbamoyl group, a 2-chlorophenylcarbamoyl group, or a 2,4-dichlorophenylcarbamoyl group. $R_1$ represents more preferably an acylamino group, which may be an ureido group or a urethane group. $R_2$ represents preferably: a halogen atom (more preferably a chlorine atom or a bromine atom); an alkoxy group such as a methoxy group, a butoxy group, an n-hexyloxy group, an n-decyloxy group, a cyclohexyloxy group, or a benzyloxy group; or an aryloxy group such as a phenoxy group or a naphthoxy group.

$R_3$ represents preferably a hydrogen atom, a halogen atom, or an alkyl group having 1 to 20 carbon atoms, most preferably a halogen atom. $R_4$ represents preferably a hydrogen atom, an alkyl group, or an acylamino group, more preferably an alkyl group or an acylamino group. Preferred examples of the group represented by $R_3$ or $R_4$ are equal to the above-described examples of the group represented by $R_1$. When $R_4$ represents an acylamino group, $R_4$ and $R_3$ may be bound to each other to form a carbostyryl ring.

When $R_3$ and $R_4$ combine with each other to form a condensed ring in the formula (A-2), the condensed ring is particularly preferably a naphthalene ring. The naphthalene ring may have a substituent selected from the above-described examples of the substituents on the ring of Q1 in the formula (A-1). When the compound represented by the formula (A-2) is a naphthol-based compound, $R_1$ represents preferably a carbamoyl group, particularly preferably a benzoyl group. $R_2$ represents preferably an alkoxy group or an aryloxy group, particularly preferably an alkoxy group.

Preferable examples of the development accelerator are illustrated below without intention of restricting the scope of the present invention.

A-1

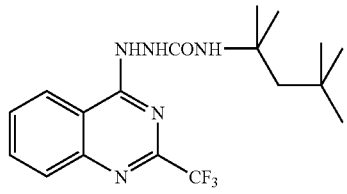

A-2

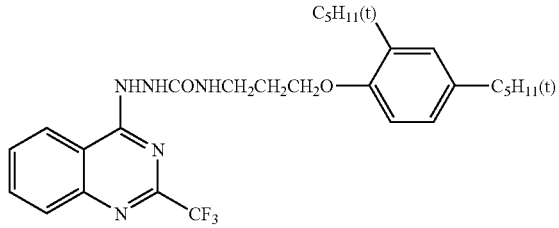

A-3

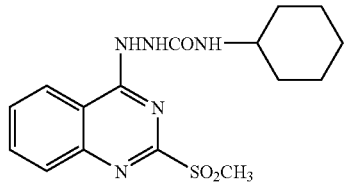

A-4

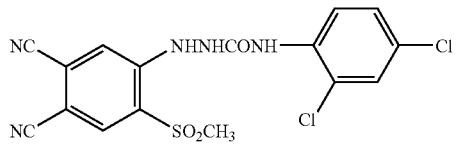

-continued

A-5

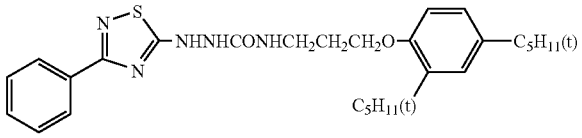

A-6

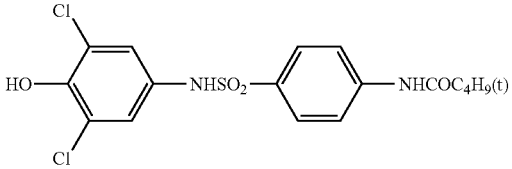

A-7

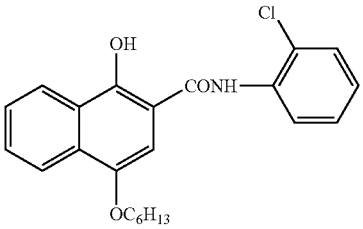

A-8

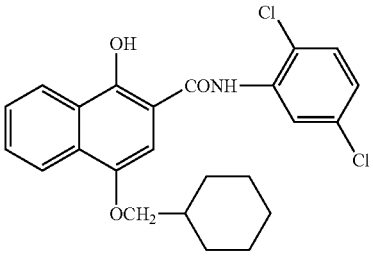

A-9

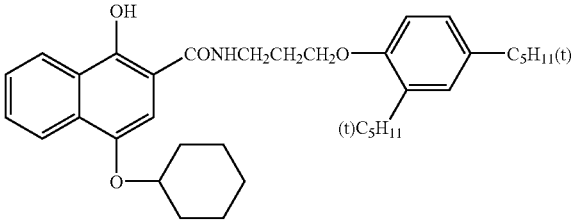

A-10

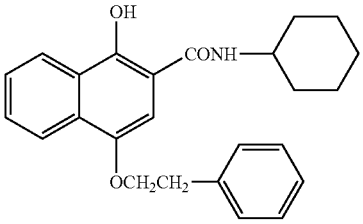

A-11

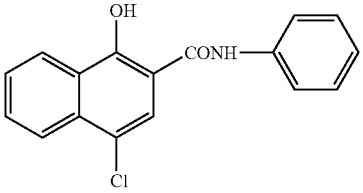

-continued

A-12

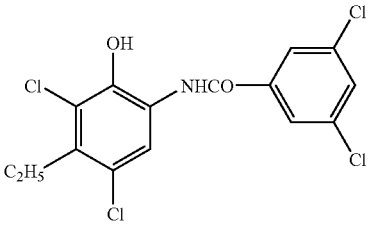

(Hydrogen-Bonding Compound)

When the reducing agent has an aromatic hydroxyl group (—OH) or amino group (—NHR, in which R represents a hydrogen atom or an alkyl group), particularly when the reducing agent is the above-mentioned bisphenol compound, it is preferable to use a non-reducing, hydrogen-bonding compound having a group capable of forming a hydrogen bond with the hydroxyl or amino group.

Examples of the group capable of forming a hydrogen bond with the hydroxyl or amino group include phosphoryl groups, sulfoxide groups, sulfonyl groups, carbonyl groups, amide groups, ester groups, urethane groups, ureido groups, tertiary amino groups, and nitrogen-containing aromatic groups. The group capable of forming a hydrogen bond with the hydroxyl or amino group is preferably a phosphoryl group; a sulfoxide group; an amide group having no >N—H groups, but the nitrogen atom being blocked as >N—Ra (in which Ra represents a substituent other than H); an urethane group having no >N—H groups, the nitrogen atom being blocked as >N—Ra (in which Ra represents a substituent other than H); and an ureido group having no >N—H group, but the nitrogen atom being blocked as >N—Ra (in which Ra represents a substituent other than H).

The hydrogen-bonding compound used in the invention is particularly preferably a compound represented by the following formula (D):

Formula (D)

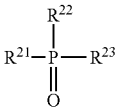

In the formula (D), $R^{21}$ to $R^{23}$ each independently represent an alkyl group, an aryl group, an alkoxy group, an aryloxy group, an amino group, or a heterocyclic group. These groups each may be unsubstituted or substituted.

When any of $R^{21}$ to $R^{23}$ has a substituent, examples of the substituent include halogen atoms, alkyl groups, aryl groups, alkoxy groups, amino groups, acyl groups, acylamino groups, alkylthio groups, arylthio groups, sulfonamide groups, acyloxy groups, oxycarbonyl groups, carbamoyl groups, sulfamoyl groups, sulfonyl groups, and phosphoryl groups. Preferred substituents are alkyl groups and aryl groups, and specific examples thereof include a methyl group, an ethyl group, an isopropyl group, a t-butyl group, a t-octyl group, a phenyl group, 4-alkoxyphenyl groups, and 4-acyloxyphenyl groups.

When any of $R^{21}$ to $R^{23}$ represents an alkyl group, examples thereof include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group, and a 2-phenoxypropyl group.

When any of $R^{21}$ to $R^{23}$ represents an aryl group, examples thereof include a phenyl group, a cresyl group, a xylyl group, a naphtyl group, a 4-t-butylphenyl group, a 4-t-octylphenyl group, a 4-anisidyl group, and a 3,5-dichlorophenyl group.

When any of $R^{21}$ to $R^{23}$ represents an alkoxy group, examples thereof include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, and a benzyloxy group.

When any of $R^{21}$ to $R^{23}$ represents an aryloxy group, examples thereof include a phenoxy group, a cresyloxy group, an isopropylphenoxy group, a 4-t-butylphenoxy group, a naphthoxy group, and a biphenyloxy group.

When any of $R^{21}$ to $R^{23}$ represents an amino group, examples thereof include a dimethylamino group, a diethylamino group, a dibutylamino group, a dioctylamino group, an N-methyl-N-hexylamino group, a dicyclohexylamino group, a diphenylamino group, and an N-methyl-N-phenylamino group.

$R^{21}$ to $R^{23}$ are each preferably an alkyl group, an aryl group, an alkoxy group, or an aryloxy group. In order to obtain the effects of the invention, in a preferable embodiment, at least one of $R^{21}$ to $R^{23}$ represents an alkyl group or an aryl group. In a more preferable embodiment, two or more of $R^{21}$ to $R^{23}$ represent groups selected from alkyl groups and aryl groups. Further, it is preferable to use a compound represented by the formula (D) in which $R^{21}$ to $R^{23}$ represent the same groups, from the viewpoint of reducing the cost.

Specific examples of the hydrogen-bonding compound (such as a compound represented by the formula (D)) are illustrated below without intention to restrict the scope of the present invention.

D-1

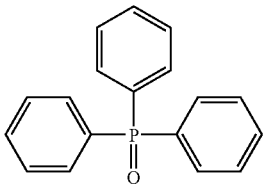

D-2

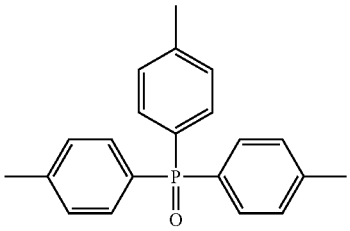

D-3

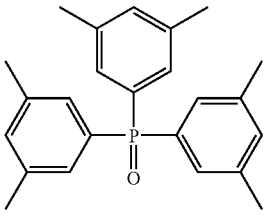

-continued

D-4

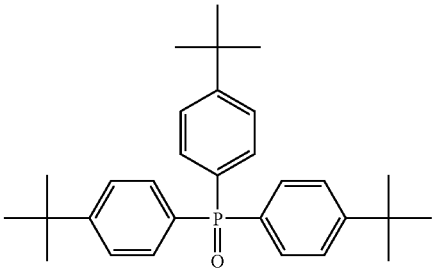

D-5

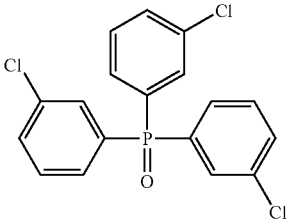

D-6

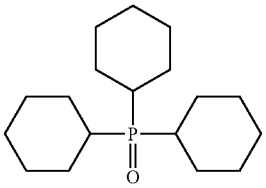

D-7

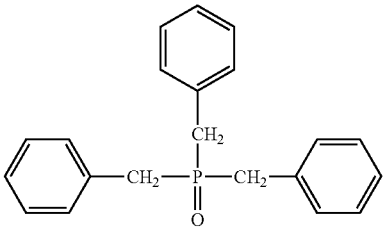

D-8

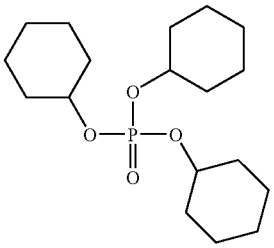

D-9

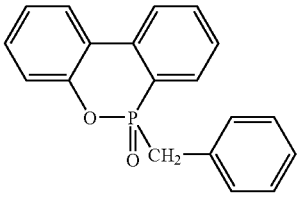

D-10

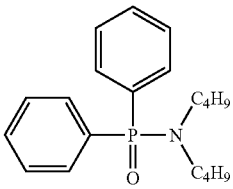

-continued

D-11

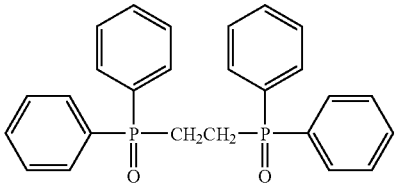

D-12

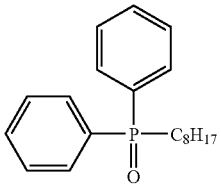

D-13

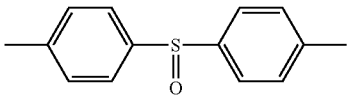

D-14

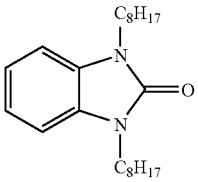

D-15

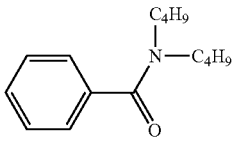

Specific examples of the hydrogen-bonding compound further include compounds disclosed in EP Patent No. 1096310, and JP-A Nos. 2002-156727 and 2002-318431, the disclosures of which are incorporated by reference herein.

The compound of the formula (D) may be added to the coating liquid and used in the photothermographic material in the form of a solution, an emulsion, or a solid particle dispersion. The specific manner of producing the solution, emulsion, or solid particle dispersion may be the same as in the case of the reducing agent. The compound is preferably used in the form of a solid dispersion. The hydrogen-bonding compound forms a hydrogen-bond complex with the reducing agent having a phenolic hydroxyl group or an amino group in the solution. The complex can be isolated as a crystal depending on the combination of the reducing agent and the compound of the formula (D).

It is particularly preferable to use the powder of the isolated crystal to form a solid particle dispersion, from the viewpoint of achieving stable performances. In a preferable embodiment, powder of the reducing agent and powder of the compound of the formula (D) are mixed, and then the mixture is dispersed in the presence of a dispersing agent by a sand grinder mill, etc., thereby forming the complex in the dispersing process.

The mole ratio of compound represented by the formula (D) to reducing agent is preferably 1 to 200 mol %, more preferably 10 to 150 mol %, further preferably 20 to 100 mol %.

(Silver Halide)

1) Halogen Composition

The halogen composition of the photosensitive silver halide used in the invention is not particularly restricted, and may be silver chloride, silver chlorobromide, silver bromide, silver iodobromide, silver iodochlorobromide, or silver iodide. Among them, silver bromide, silver iodobromide, and silver iodide are preferable. In a grain of the photosensitive silver halide, the halogen composition may be uniform in the entire grain, or may vary stepwise or steplessly. In an embodiment, the photosensitive silver halide grain has a core-shell structure. The core-shell structure is preferably a 2- to 5-layered structure, more preferably a 2- to 4-layered structure. It is also preferable to employ techniques for localizing silver bromide or silver iodide on the surface of the grain of silver chloride, silver bromide, or silver chlorobromide.

2) Method of Forming a Photosensitive Silver Halide Grain

Methods of forming the photosensitive silver halide grain are well known in the field. For example, the methods described in *Research Disclosure*, No. 17029, June 1978 (the disclosure of which is incorporated by reference) and U.S. Pat. No. 3,700,458 (the disclosure of which is incorporated by reference) may be used in the invention. In an embodiment, the photosensitive silver halide grains are prepared by: adding a silver source and a halogen source to a solution of gelatin or another polymer to form a photosensitive silver halide; and then mixing the silver halide with an organic silver salt. The methods disclosed in the following documents are also preferable: JP-A No. 11-119374, Paragraph 0217 to 0224, and JP-A Nos. 11-352627 and 2000-347335, the disclosures of which are incorporated by reference herein.

3) Grain Size

The grain size of the photosensitive silver halide grain is preferably small so as to suppress the clouding after image formation. Specifically, the grain size is preferably 0.20 μm or smaller, more preferably 0.01 μm to 0.15 μm, further preferably 0.02 μm to 0.12 μm. The grain size of the photosensitive silver halide grain is the average diameter of the circle having the same area as the projected area of the grain; in the case of tabular grain, the projected area refers to the projected area of the principal plane.

4) Shape of Photosensitive Silver Halide Grain

The photosensitive silver halide grain may be a cuboidal grain, an octahedral grain, a tabular grain, a spherical grain, a rod-shaped grain, a potato-like grain, etc. In the invention, the cuboidal grain is preferable. Silver halide grains with roundish corners are also preferable. The face index (Miller index) of the outer surface plane of the photosensitive silver halide grain is not particularly limited. In a preferable embodiment, the silver halide grains have a high proportion of {100} faces; a spectrally sensitizing dye adsorbed to the {100} faces exhibits a higher spectral sensitization efficiency. The proportion of the {100} faces is preferably 50% or higher, more preferably 65% or higher, further preferably 80% or higher. The proportion of the {100} faces according to the Miller indices can be determined by a method described in T. Tani, *J. Imaging Sci.*, 29, 165 (1985) (the disclosure of which is incorporated herein by reference) using adsorption dependency between {111} faces and {100} faces upon adsorption of a sensitizing dye.

5) Heavy Metal

The photosensitive silver halide grain used in the invention may include a metal selected from the metals of Groups 6 to 13 of the Periodic Table of Elements (having Groups 1 to 18)

or a complex thereof. The metal is more preferably selected from metals of Groups 6 to 10 of the Periodic Table of Elements. When the photosensitive silver halide grain includes a metal selected from the metals of Groups 6 to 13 of the Periodic Table of Elements or a metal complex containing a metal selected from the metals of Groups 6 to 13 as the central metal, the metal or the central metal is preferably rhodium, ruthenium, iridium, or iron. The metal complex may be used singly or in combination with another complex including the same or different metal. The amount of the metal or the metal complex is preferably $1\times10^{-9}$ mol to $1\times10^{-3}$ mol per 1 mol of silver. The heavy metals, the metal complexes, and methods of adding them are described, for example, in JP-A No. 7-225449, JP-A No. 11-65021, Paragraph 0018 to 0024, and JP-A No. 11-119374, Paragraph 0227 to 0240, the disclosures of which are incorporated by reference herein.

In the invention, the silver halide grain is preferably a silver halide grain having a hexacyano metal complex on its outer surface. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. The hexacyano metal complex is preferably a hexacyano Fe complex.

The counter cation of the hexacyano metal complex is not important because the hexacyano metal complex exists as an ion in an aqueous solution. The counter cation is preferably a cation which is highly miscible with water and suitable for an operation to precipitate the silver halide emulsion; examples thereof include: alkaline metal ions such as a sodium ion, a potassium ion, a rubidium ion, a cesium ion, and a lithium ion; and ammonium and alkylammonium ions such as a tetramethylammonium ion, a tetraethylammonium ion, a tetrapropylammonium ion, and a tetra-(n-butyl)-ammonium ion.

The hexacyano metal complex may be added in the form of a solution in water, or in a mixed solvent of water and a water-miscible organic solvent (e.g. an alcohol, an ether, a glycol, a ketone, an ester, an amide, etc.), or in a gelatin.

The amount of the hexacyano metal complex to be added is preferably $1\times10^{-5}$ mol to $1\times10^{-2}$ mol per 1 mol of silver, more preferably $1\times10^{-4}$ mol to $1\times10^{-3}$ mol per 1 mol of silver.

In order to allow the hexacyano metal complex to exist on the outer surface of the silver halide grains, the hexacyano metal complex may be directly added to the silver halide grains after the completion of the addition of an aqueous silver nitrate solution for grain formation but before the chemical sensitization (which may be chalcogen sensitization such as sulfur sensitization, selenium sensitization, or tellurium sensitization or may be noble metal sensitization such as gold sensitization). Specifically, the hexacyano metal complex may be directly added to the silver halide grains before the completion of the preparation step, in the water-washing step, in the dispersion step, or before the chemical sensitization step. It is preferable to add the hexacyano metal complex immediately after grain formation but before the completion of the preparation step so as to prevent excess growth of the silver halide grains.

In an embodiment, the addition of the hexacyano metal complex is started after 96% by mass of the total amount of silver nitrate for the grain formation is added. In a preferable embodiment, the addition is started after 98% by mass of the total amount of silver nitrate is added. In a more preferable embodiment, the addition is started after 99% by mass of the total amount of silver nitrate is added.

When the hexacyano metal complex is added after the addition of the aqueous silver nitrate solution but immediately before the completion of the grain formation, the hexacyano metal complex is adsorbed onto the outer surface of the silver halide grain, and most of the adsorbed hexacyano metal complex forms a hardly-soluble salt with silver ion on the surface. The silver salt of hexacyano iron (II) is less soluble than AgI and thus preventing redissolution of the fine grains, whereby the silver halide grains with a smaller grain size can be produced.

The metal atoms and metal complexes such as $[Fe(CN)_6]^{4-}$ which may be added to the silver halide grains, and the desalination methods and the chemical sensitization methods for the silver halide emulsion are described in JP-A No. 11-84574, Paragraph 0046 to 0050, JP-A No. 11-65021, Paragraph 0025 to 0031, and JP-A No. 11-119374, Paragraph 0242 to 0250, the disclosures of which are incorporated herein by reference.

6) Gelatin

In the invention, the gelatin contained in the photosensitive silver halide emulsion may be selected from various gelatins. The gelatin has a molecular weight of preferably 10,000 to 1,000,000 so as to maintain excellent dispersion state of the photosensitive silver halide emulsion in the coating liquid including the organic silver salt. Substituents on the gelatin are preferably phthalated. The gelatin may be added during the grain formation or during the dispersing process after the desalting treatment, and is preferably added during the grain formation.

7) Sensitizing Dye

The sensitizing dye used in the invention is a sensitizing dye which can spectrally sensitize the silver halide grains when adsorbed by the grains, so that the sensitivity of the silver halide is heightened in the desired wavelength range. The sensitizing dye may be selected from sensitizing dyes having spectral sensitivities which are suitable for spectral characteristics of the exposure light source. The sensitizing dyes and methods of adding them are described, for example, in JP-A No. 11-65021, Paragraph 0103 to 0109; JP-A No. 10-186572 (the compounds represented by the formula (II)); JP-A No. 11-119374 (the dyes represented by the formula (I) and Paragraph 0106); U.S. Pat. No. 5,510,236; U.S. Pat. No. 3,871,887 (the dyes described in Example 5); JP-A No. 2-96131; JP-A No. 59-48753 (the dyes disclosed therein); EP-A No. 0803764A1, Page 19, Line 38 to Page 20, Line 35; JP-A Nos. 2001-272747, 2001-290238, and 2002-23306, the disclosures of which are incorporated herein by reference. Only a single sensitizing dye may be used or two or more sensitizing dyes may be used. In an embodiment, the sensitizing dye is added to the silver halide emulsion after the desalination but before the coating. In a preferable embodiment, the sensitizing dye is added to the silver halide emulsion after the desalination but before the completion of the chemical ripening.

The amount of the sensitizing dye to be added may be selected in accordance with the sensitivity and the fogging properties, and is preferably $10^{-6}$ mol to 1 mol per 1 mol of the silver halide in the image-forming layer, more preferably $10^{-4}$ mol to $10^{-1}$ mol per 1 mol of the silver halide in the image-forming layer.

In the invention, a super-sensitizer may be used in order to increase the spectral sensitization efficiency. Examples of the super-sensitizer include compounds described in EP-A No. 587,338, U.S. Pat. Nos. 3,877,943 and 4,873,184, JP-A Nos. 5-341432, 11-109547, and 10-111543, the disclosures of which are incorporated herein by reference.

8) Chemical Sensitization

In a preferable embodiment, the photosensitive silver halide grains are chemically sensitized by methods selected from the sulfur sensitization method, the selenium sensitization method, and the tellurium sensitization method. Known compounds such as the compounds described in JP-A No. 7-128768 (the disclosure of which is incorporated herein by reference) may be used in the sulfur sensitization method, the selenium sensitization method, and the tellurium sensitization method. In the invention, the tellurium sensitization is preferred, and it is preferable to use a compound or compounds selected from the compounds described in JP-A No. 11-65021, Paragraph 0030 and compounds represented by the formula (II), (III), or (IV) described in JP-A No. 5-313284, the disclosures of which are incorporated by reference herein.

In a preferable embodiment, the photosensitive silver halide grains are chemically sensitized by the gold sensitization method, which may be conducted alone or in combination with the chalcogen sensitization. The gold sensitization method preferably uses a gold sensitizer having a gold atom with the valence of +1 or +3. The gold sensitizer is preferably a common gold compound. Typical examples of the gold sensitizer include chloroauric acid, bromoauric acid, potassium chloroaurate, potassium bromoaurate, auric trichloride, potassium auricthiocyanate, potassium iodoaurate, tetracyanoauric acid, ammonium aurothiocyanate, and pyridyltrichloro gold. Further, the gold sensitizers described in U.S. Pat. No. 5,858,637 and JP-A No. 2002-278016 (the disclosures of which are incorporated herein by reference) are also preferable in the invention.

In the invention, the chemical sensitization may be carried out at any time between grain formation and coating. The chemical sensitization may be carried out after desalination, for example, (I) before spectral sensitization, (2) during spectral sensitization, (3) after spectral sensitization, or (4) immediately before coating.

The amount of the sulfur, selenium, or tellurium sensitizer may be changed in accordance with the kind of the silver halide grains, the chemical ripening condition, and the like, and is generally $10^{-8}$ mol to $10^{-2}$ mol per 1 mol of silver halide, preferably $10^{-7}$ mol to $10^{-3}$ mol per 1 mol of silver halide.

The amount of the gold sensitizer to be added may be selected in accordance with the conditions, and is preferably $10^{-7}$ mol to $10^{-3}$ mol per 1 mol of silver halide, more preferably $10^{-6}$ mol to $5\times10^{-4}$ mol per 1 mol of silver halide.

The conditions for the chemical sensitization are not particularly restricted and are generally conditions in which pH is 5 to 8, pAg is 6 to 11, and temperature is 40 to 95° C.

A thiosulfonic acid compound may be added to the silver halide emulsion by a method described in EP-A No. 293,917, the disclosure of which is incorporated by reference herein.

In the invention, the photosensitive silver halide grains may be subjected to reduction sensitization using a reduction sensitizer. The reduction sensitizer is preferably selected from ascorbic acid, aminoiminomethanesulfinic acid, stannous chloride, hydrazine derivatives, borane compounds, silane compounds, and polyamine compounds. The reduction sensitizer may be added at any time between crystal growth and coating in the preparation of the photosensitive emulsion. It is also preferable to ripen the emulsion while maintaining the pH value of the emulsion at 7 or higher and/or maintaining the pAg value at 8.3 or lower, so as to reduction-sensitize the photosensitive emulsion. Further, it is also preferable to conduct reduction sensitization by introducing a single addition part of a silver ion during grain formation.

9) Combination of Silver Halides

In an embodiment, only one kind of photosensitive silver halide emulsion is used in the photothermographic material of the invention. In another embodiment, two or more kinds of photosensitive silver halide emulsions are used in the photothermographic material; the photosensitive silver halide emulsions may be different from each other in characteristics such as average grain size, halogen composition, crystal habit, and chemical sensitization condition. The image gradation can be adjusted by using two or more kinds of photosensitive silver halide emulsions having different sensitivities. The related techniques are described, for example in JP-A Nos. 57-119341, 53-106125, 47-3929, 48-55730, 46-5187, 50-73627, and 57-150841, the disclosures of which are incorporated herein by reference. The difference in sensitivity between the emulsions is preferably 0.2 logE or larger.

10) Application Amount

The amount of the photosensitive silver halide to be applied is, in terms of the applied silver amount per 1 $m^2$ of photothermographic material, preferably 0.03 to 0.6 $g/m^2$, more preferably 0.05 to 0.4 $g/m^2$, still more preferably 0.07 to 0.3 $g/m^2$. Further, the amount of the photosensitive silver halide per 1 mol of the organic silver salt is preferably 0.01 to 0.5 mol, more preferably 0.02 to 0.3 mol, further preferably 0.03 to 0.2 mol.

11) Mixing of Photosensitive Silver Halide and Organic Silver Salt

The methods and conditions of mixing the photosensitive silver halide and the organic silver salt, which are separately prepared, are not particularly restricted as long as the advantageous effects of the invention can be sufficiently obtained. In an embodiment, the silver halide and the organic silver salt are separately prepared and then mixed by a high-speed stirrer, a ball mill, a sand mill, a colloid mill, a vibrating mill, a homogenizer, etc. In another embodiment, the prepared photosensitive silver halide is added to the organic silver salt during the preparation of the organic silver salt, and the preparation of the organic silver salt is then completed. It is preferable to mix two or more aqueous organic silver salt dispersion liquids and two or more aqueous photosensitive silver salt dispersion liquids so as to adjust the photographic properties.

12) Addition of Silver Halide to Coating Liquid

The silver halide is added to the coating liquid for the image-forming layer preferably between 180 minutes before coating and immediately before coating, more preferably between 60 minutes before coating and 10 seconds before coating. There are no particular restrictions on the methods and conditions of the coating as long as the advantageous effects of the invention can be sufficiently obtained. In an embodiment, the silver halide is mixed with the coating liquid in a tank while controlling the addition flow rate and the feeding amount to the coater, such that the average retention time calculated from the addition flow rate and the feeding amount to the coater is the desired time. In another embodiment, the silver halide is mixed with the coating liquid by a method using a static mixer described, for example, in N. Hamby, M. F. Edwards, and A. W. Nienow, translated by Koji Takahashi, Ekitai Kongo Gijutsu, Chapter 8 (Nikkan Kogyo Shimbun, Ltd., 1989), the disclosure of which is incorporated herein by reference.

(Explanation of Binder)

As the binder in the image-forming layer in the invention, any polymer may be used. The binder is preferably hydrophilic. The polymer is preferably transparent or translucent, and generally colorless. The polymer may be a natural resin, polymer or copolymer, a synthetic resin, polymer or copolymer, or another film-forming medium, and specific examples thereof include gelatins, gums, polyvinyl alcohols, hydroxyethylcelluloses, cellulose acetates, polyvinylpyrrolidones, caseins, starches, polyacrylic acids, polymethylmethacrylic acids.

In a preferable embodiment, at least 50 mass % of the binder in the layer containing the organic silver salt is hydrophilic. In a more preferable embodiment, at least 70 mass % of the binder in the layer containing the organic silver salt is hydrophilic.

Examples of hydrophilic binders include: gelatin and gelatin derivatives such as alkali-treated or acid treated gelatins, acetylated gelatins, oxidized gelatins, phthalated gelatins, and deionized gelatins; polysilisic acid; acrylamide-methacrylamide copolymers; acryl/methacryl polymers; polyvinyl pyrrolidones; poly(vinylacetate)s; poly(vinylalcohol)s; poly(vinyllactam)s; polymers of sulfoalkyl acrylates or sulfoalkyl methacrylates; hydrolyzed poly(vinylacetate); polysaccharides such as dextrans and starch ethers; and intrinsically hydrophilic (defined above) synthetic or natural vehicles (see, for example, Research Disclosure item 38957, the disclosure of which is incorporated herein by reference). The binder is preferably gelatin, a gelatin derivative, or a poly(vinylalcohol), more preferably gelatin or a gelatin derivative.

In the invention, it is preferable to form the image-forming layer by applying and drying a coating liquid in which 30 mass % or more (preferably 50 mass % or more) of the solvent is water.

The aqueous solvent in which the binder may be soluble or dispersible is water or a mixed solvent of water and a water-miscible organic solvent, the mixed solvent having a content of the water-miscible organic solvent of 70% by mass or lower. Examples of the water-miscible organic solvent include: alcohol solvents such as methyl alcohol, ethyl alcohol, and propyl alcohol; cellosolve solvents such as methyl cellosolve, ethyl cellosolve, and butyl cellosolve; ethyl acetate; and dimethylformamide.

Binders other than hydrophilic binders to be used are preferably polymers which are dispersible in aqueous solvents. Preferred examples of the polymers dispersible in the aqueous solvents include hydrophobic polymers such as acrylic polymers, polyesters, rubbers (e.g. SBR resins), polyurethanes, polyvinyl chlorides, polyvinyl acetates, polyvinylidene chlorides, and polyolefins. The polymer may be linear, branched, or cross-linked, and may be a homopolymer derived form one monomer or a copolymer derived form two or more monomers. The copolymer may be a random copolymer or a block copolymer. The number-average molecular weight of the polymer is preferably 5,000 to 1,000,000, more preferably 10,000 to 200,000. When the number-average molecular weight is too small, the resultant image-forming layer tends to have insufficient strength. On the other hand, when the number-average molecular weight is too large, the polymer is poor in the film-forming properties. Further, cross-linkable polymer latexes are particularly preferable.

In the invention, in the layer containing the organic silver salt (the image-forming layer), the ratio of the mass of silver (including the organic silver and the silver halide) to the total mass of the binder is preferably in the range of 0.1 to 3.0, more preferably in the range of 0.3 to 1.5.

In the invention, the image-forming layer may further include a crosslinking agent for crosslinking or a surfactant for improving coating property.

(Preferred Solvent for Coating Liquid)

In the invention, the solvent of the coating liquid for the image-forming layer is preferably an aqueous solvent including 30% by mass or more of water. The term "solvent" used herein means a solvent or a dispersion medium. The aqueous solvent may include any water-miscible organic solvent such as methyl alcohol, ethyl alcohol, isopropyl alcohol, methyl cellosolve, ethyl cellosolve, dimethylformamide, and ethyl acetate. The water content of the solvent for the coating liquid is preferably 50% by mass or higher, more preferably 70% by mass or higher. Examples of preferred solvents include water, 90/10 mixture of water/methyl alcohol, 70/30 mixture of water/methyl alcohol, 80/15/5 mixture of water/methyl alcohol/dimethylformamide, 85/10/5 mixture of water/methyl alcohol/ethyl cellosolve, and 85/10/5 mixture of water/methyl alcohol/isopropyl alcohol, the numerals representing the mass ratios (% by mass).

(Antifoggant)

Examples of antifoggants, stabilizers, and stabilizer precursors usable in the invention include compounds disclosed in JP-A No. 10-62899, Paragraph 0070 and EP-A No. 0803764A1, Page 20, Line 57 to Page 21, Line 7; compounds described in JP-A Nos. 9-281637 and 9-329864; and compounds described in U.S. Pat. No. 6,083,681 and EP No. 1048975. The disclosures of the above patent documents are incorporated herein by reference.

(1) Polyhalogen Compound

Organic polyhalogen compounds, which can be preferably used as the antifoggant in the invention, are described in detail below. The antifoggant is preferably an organic polyhalogen compound represented by the following formula (H):

$$Q\text{-}(Y)_n\text{—}C(X1)(X2)Z. \qquad \text{Formula (H)}$$

In the formula (H), Q represents an alkyl group, an aryl group, or a heterocyclic group, Y represents a divalent linking group, n represents 0 to 1, X1 and X2 each independently represent a hydrogen atom or an electron-withdrawing group, and Z represents a halogen atom.

In the formula (H), Q represents preferably an alkyl group having 1 to 6 carbon atoms, an aryl group having 6 to 12 carbon atoms, or a heterocyclic group including at least one nitrogen atom such as a pyridyl group and a quinolyl group.

When Q represents an aryl group, the aryl group is preferably a phenyl group substituted by an electron-withdrawing group with a positive Hammett's substituent constant $\sigma p$. The Hammett's substituent constant is described, for example, in *Journal of Medicinal Chemistry,* 1973, Vol. 16, No. 11, 1207-1216, the disclosure of which is incorporated herein by reference. Examples of such an electron-withdrawing group include halogen atoms, alkyl groups having substituents of electron-withdrawing groups, aryl groups substituted by electron-withdrawing groups, heterocyclic groups, alkyl sulfonyl groups, aryl sulfonyl groups, acyl groups, alkoxycarbonyl groups, carbamoyl groups, and sulfamoyl groups. The electron-withdrawing group is preferably a halogen atom, a carbamoyl group, or an arylsulfonyl group, particularly preferably a carbamoyl group.

In a preferable embodiment, at least one of X1 and X2 represents an electron-withdrawing group. The electron-withdrawing group is preferably a halogen atom, an aliphatic, aryl, or heterocyclyl sulfonyl group, an aliphatic, aryl, or heterocyclyl acyl group, an aliphatic, aryl, or heterocyclyl oxycarbonyl group, a carbamoyl group, or a sulfamoyl group, more preferably a halogen atom or a carbamoyl group, particularly preferably a bromine atom.

Z represents preferably a bromine atom or an iodine atom, more preferably a bromine atom.

Y represent preferably —C(=O)—, —SO—, —$SO_2$—, —C(=O)N(R)—, or —$SO_2$N(R)—, more preferably —C(=O)—, —$SO_2$—, or —C(=O)N(R)—, particularly preferably —$SO_2$— or —C(=O)N(R)—, in which R represents a hydrogen atom, an aryl group, or an alkyl group, preferably a hydrogen atom or an alkyl group, particularly preferably a hydrogen atom.

In the formula (H), n represents 0 or 1, preferably 1.

In the formula (H), Y represents preferably —C(=O)N(R)— when Q represents an alkyl group, and Y represents preferably —$SO_2$— when Q represents an aryl group or a heterocyclic group.

In an embodiment, the antifoggant is a compound including two or more units represented by the formula (H), wherein each unit is bound to another unit, and a hydrogen atom in the formula (H) is substituted with the bond in each unit. Such a compound is referred to as a bis-, tris-, or tetrakis-type compound.

The compound represented by (H) is preferably substituted by a dissociative group (such as a COOH group, a salt of a COOH group, an $SO_3H$ group, a salt of an $SO_3H$ group, a $PO_3H$ group, or a salt of a $PO_3H$ group); a group containing a quaternary nitrogen cation, such as an ammonium group or a pyridinium group; a polyethyleneoxy group; a hydroxyl group; or the like.

Specific examples of the compounds represented by the formula (H) are shown below.

H-1

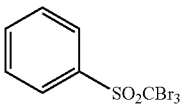

H-2

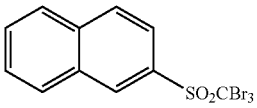

H-3

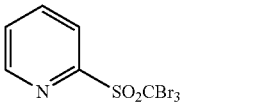

H-4

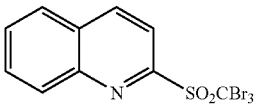

H-5

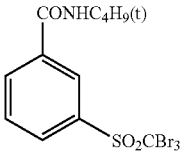

H-6

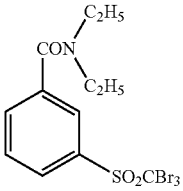

-continued

H-7

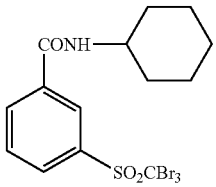

H-8

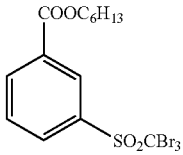

H-9

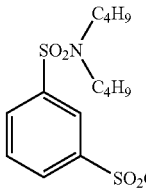

H-10

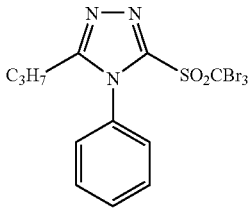

H-11

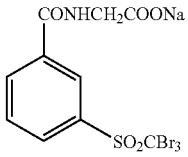

H-12

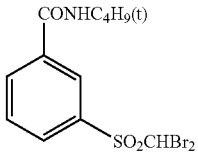

H-13

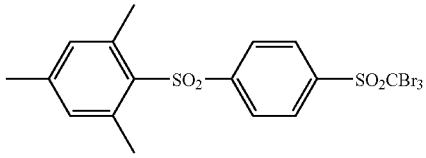

H-14

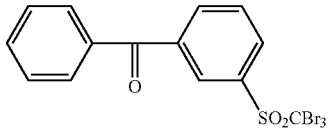

H-15

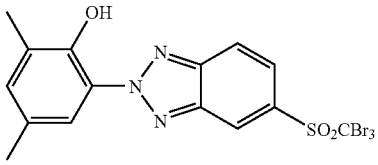

-continued

H-16

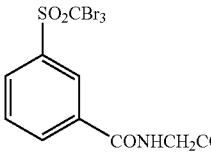

H-17

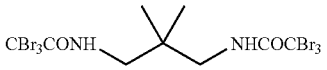

H-18

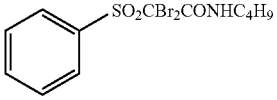

H-19

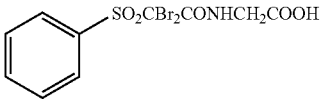

H-20

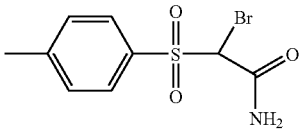

H-21

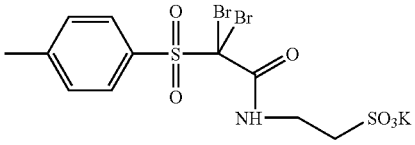

Examples of polyhalogen compounds usable in the invention include, in addition to the above compounds, compounds described in U.S. Pat. Nos. 3,874,946, 4,756,999, 5,340,712, 5,369,000, 5,464,737, and 6,506,548, and JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441, the disclosures of which are incorporated herein by reference. The compounds described in JP-A Nos. 7-2781, 2001-33911, and 2001-312027 are particularly preferred.

The amount of the polyhalogen compound is preferably $10^{-4}$ mol to 1 mol, more preferably $10^{-3}$ mol to 0.5 mol, further preferably mol $10^{-2}$ to 0.2 mol, per 1 mol of the non-photosensitive silver salt.

The antifoggant may be added to the photosensitive material in any of the manners described above as examples of the method of adding the reducing agent. The organic polyhalogen compound is preferably added in the state of a solid particle dispersion.

(2) Other Antifoggants

Examples of other antifoggants usable in the invention include mercury (II) salts described in JP-A No. 11-65021, Paragraph 0113; benzoic acid compounds described in JP-A No. 11-65021, Paragraph 0114; salicylic acid derivatives described in JP-A No. 2000-206642; formalin scavenger compounds represented by the formula (S) described in JP-A No. 2000-221634; triazine compounds disclosed in claim 9 of JP-A No. 11-352624; compounds represented by the formula (III) described in JP-A No. 6-11791; and 4-hydroxy-6-methyl-1,3,3a,7-tetrazaindene. The disclosures of the above patent documents are incorporated herein by reference.

The photothermographic materials of the invention may further include an azolium salt for the purpose of preventing the fogging. Examples of the azolium salt include compounds represented by the formula (XI) described in JP-A No. 59-193447; compounds described in JP-B No. 55-12581; and compounds represented by the formula (II) described in JP-A No. 60-153039. The disclosures of the above patent documents are incorporated herein by reference. In an embodiment, the azolium salt is added to a layer on the same side as the image-forming layer. The layer to which the azolium salt may be added is preferably the image-forming layer. However, the azolium salt may be added to any portion of the material. The azolium salt may be added in any step in the preparation of the coating liquid. When the azolium salt is added to the image-forming layer, the azolium salt may be added in any step between the preparation of the organic silver salt and the preparation of the coating liquid. In an embodiment, the azolium salt is added during the period after the preparation of the organic silver salt but before the application of the coating liquid. The azolium salt may be added in the form of powder, a solution, a fine particle dispersion, etc. Further, the azolium salt may be added in the form of a solution which further contains other additives such as sensitizing dyes, reducing agents, and toning agents. The amount of the azolium salt to be added per 1 mol of silver is not particularly limited, and is preferably $1\times10^{-6}$ mol to 2 mol, more preferably $1\times10^{-3}$ mol to 0.5 mol.

(Description of the Compound of the Formula (I) or (II))

Formula (I)

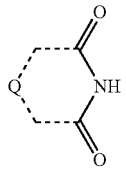

Formula (II)

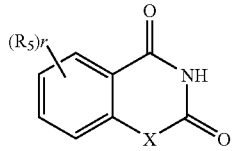

In the formula (I), Q represents an atomic group required for forming a 5- or 6-membered imide ring. In the formula (II), $R_5$ represents a hydrogen atom, an alkyl group, a cycloalkyl group, an alkoxy group, an alkylthio group, an arylthio group, a hydroxyl group, a halogeno group or a $N(R_8R_9)$ group, wherein $R_8$ and $R_9$ each independently represents a hydrogen atom, an alkyl group, an aryl group, a cycloalkyl group, an alkenyl group or a heterocyclic group, or $R_5$ and $R_9$ may join to each other to represent an atomic group necessary for forming a substituted or non-substituted 5-membered to 7-membered heterocyclic ring. When there are two $R_5$'s, they may be the same as each other or different from each other, and they may join to each other to form an atomic group required for forming aromatic, hetero aromatic, alicyclic or heterocyclic condensed ring. X represents O, S, Se, or $N(R_6)$, wherein $R_6$ represents a hydrogen atom, an alkyl group, an aryl group, a cycloalkyl group, an alkenyl group, or a heterocyclic group. In the formula (I), r represents 0, 1, or 2.

1) Description of Formula (I)

The nitrogen atom(s) and the carbon atom(s) constituting Q may have a hydrogen atom, an amino group, an alkyl group of 1 to 4 carbon atoms, a halogen atom, a keto oxygen atom, an aryl group, or the like bonded as a branch thereto. Specific examples of the compound having the imide ring represented by the formula (I) include uracil, 5-bromouracil, 4-methyluracil, 5-methyluracil, 4-carboxyuracil, 4,5-dimethyluracil, 5-aminouracil, dihyrouracil, 1-ethyl-6-methyluracil, 5-carboxymethylaminouracil, barbituric acid, 5-phenylbarbituric acid, cyanulic acid, urazole, hydantoin, 5,5-dimethyl hydantoin, glutal imide, glutacon imide, citrazinic acid, succinic imide, 3,4-dimethyl siccunic imide, maleimide, phthalimide, and naphthal imide. In the invention, among the compounds having the imide group represented by the formula (I), succinimide, phthalimide, naphthalimide, and 3,4-dimethyl succinine imide are preferred, and succine imide is particularly preferred.

2) Description of Formula (II)

In the formula (II), $R_5$ represents a hydrogen, an alkyl group, a cycloalkyl group, an alkoxy group, an alkylthio group, an arylthio group, a hydroxyl group, a halogen group, or a $N(R_8R_9)$ group. Further, When there are two $R_5$'s, they may be the same as each other or different from each other, and they may join to each other to form an atomic group required for forming aromatic, hetero aromatic, alicyclic or heterocyclic condensed ring. In a case where $R_5$ represents an amino group $[N(R_8R_9)]$, $R_8$ and $R_9$ each independently represents a hydrogen atom, an alkyl group, an aryl group, a cycloalkyl group, an alkenyl group, or a heterocyclic ring.

Further, $R_8$ and $R_9$ may join to each other to represent an atomic group required for forming a substituted or not-substituted 5-membered to 7-membered heterocyclic ring. In the formula (II), X represents O, S, Se, or $N(R_6)$ in which $R_6$ represents a hydrogen atom, an alkyl group, an aryl group, a cycloalkyl group, an alkenyl group, or a heterocyclic group. r represents 0, 1 or 2.

An alkyl group useful as $R_5$, $R_6$, $R_8$, or $R_9$ is a linear, branched or cyclic alkyl groups which may have 1 to 20 carbon atoms, preferably 1 to 5 carbon atoms. Alkyl groups having 1 to 4 carbon atoms (for example, methyl, ethyl, iso-propyl, n-butyl, t-butyl, and sec-butyl) are particularly preferred.

An aryl group useful as $R_5$, $R_6$, $R_8$, or $R_9$ may have 6 to 14 carbon atoms in its aromatic ring(s). Preferred aryl group is a phenyl group or a substituted phenyl group.

A cycloalkyl group useful as $R_5$, $R_6$, $R_8$, or $R_9$ may have 5 to 14 carbon atoms in its central ring system. The cycloalkyl group is preferably a cyclopentyl groups or a cyclohexyl group.

A useful alkenyl group or alkynyl group may be branched or linear and may have 2 to 20 carbon atoms. The alkenyl group is preferably an allyl group.

A heterocyclic group useful as $R_5$, $R_6$, $R_8$, or $R_9$ may have 5 to 10 atoms selected from carbon atoms, oxygen atoms, sulfur atoms and nitrogen atoms in its central ring system and may have a condensed ring.

The alkyl, aryl, cycloalkyl, or heterocyclic group may be further substituted, for example, by one or more groups selected from halo groups, alkoxycarbonyl groups, hydroxyl groups, alkoxy groups cyano groups, acyl groups, acyloxy groups, carbonyloxyester groups, sulfonic acid ester groups, alkylthio groups, dialkylamino groups, carboxy groups, sulfo groups, phosphono groups, and other groups known in the art.

An alkoxy, alkylthio, or arylthio group useful as $R_5$ has such an alkyl or aryl group as described above. The halogen group is preferably a chloro group or a bromo group. Representative examples of compounds represented by the formula (II) include the following compounds II-1 to II-10. The compound II-1 is most preferred.

(II-1)

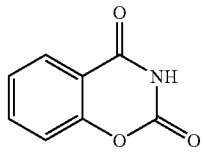

(II-2)

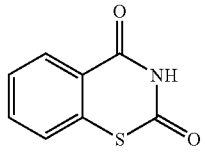

(II-3)

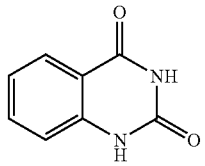

(II-4)

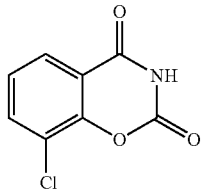

(II-5)

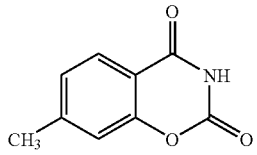

(II-6)

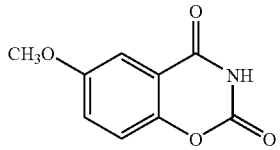

(II-7)

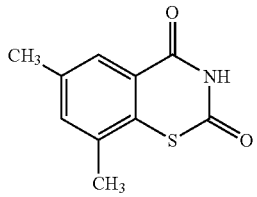

(II-8)

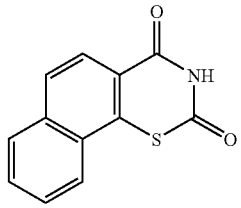

-continued (II-9)

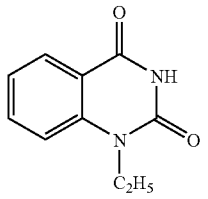

(II-10)

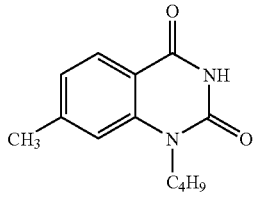

Other useful substituted benzoxadinediones are described in U.S. Pat. No. 3,951,660 (Hagemann, et al.), the disclosure of which is incorporated herein by reference. Compounds of the formulae (I) and (II) are preferably used as toning agents. The compounds of the formulae (I) and (II) may be used in combination with other toning agents such as phthalazinone, phthalazinone derivatives, and metal salts of derivatives of phthaladinone. Examples thereof include: 4-(1-naphthyl)phthalazinone; 6-chlorophthalazinone; 5,7-dimethoxyphthalazinone; and 2,3-dihydro-1,4-phthalazinedione; and a combination of phthalazine or a phthalazine derivative (such as 5-isopropylphthalazine) with a phthalic acid derivative (such as phthalic acid, 4-methyl phthalic acid, 4-nitro phthalic acid, or tetrachloro phthalic acid).

(Plasticizer and Lubricant)

In the invention, known plasticizers and lubricants can be used for improving the physical property of films. Particularly, it is preferred to use a lubricant such as liquid paraffin, a long-chain fatty acid, a fatty acid amide, or a fatty acid ester, for the purpose of improving the handling property at production and the scratch resistance at heat development. The lubricant is preferably liquid paraffin from which low-boiling ingredients have been removed, or a fatty acid ester with a molecular weight of 1,000 or more having a branched structure.

The plasticizer and lubricant that can be used in the image-forming layer and the non-photosensitive layer are preferably selected from the compounds described in JP-A No. 11-65021, paragraph 0117, JP-A Nos. 2000-5137, 2004-219794, 2004-219802, and 2004-334077, the disclosures of which are incorporated herein by reference.

(Dye and Pigment)

In the invention, the image-forming layer may further comprise various dyes and pigments (for example, C. I. Pigment Blue 60, C. I. Pigment Blue 64, and C. I. Pigment Blue 15:6) from the viewpoint of improving the tone, preventing occurrence of interference fringe and irradiation upon laser exposure. The dyes and pigments are described, for example, in WO98/36322 and JP-A Nos. 10-268465 and 11-338098, the disclosures of which are incorporated herein by reference.

(Nucleating Agent)

It is preferable to incorporate a nucleating agent into the image-forming layer. Examples of the nucleating agents, examples of the methods for adding them, and examples of the amount thereof are described in JP-A No. 11-65021, Paragraph 0118; JP-A No. 11-223898, Paragraph 0136 to 0193; JP-A No. 2000-284399 (the compounds each represented by any one of the formulae (H), (1) to (3), (A), and (B)); JP-A No. 2000-347345 (the compounds represented by the formulae (III) to (V) and the example compounds of Chemical Formula 21 to 24); etc. Further, examples of nucleation promoting agents are described in JP-A No. 11-65021, Paragraph 0102, and JP-A No. 11-223898, Paragraphs 0194 and 0195.

Formic acid or a formate salt may be used as a strong fogging agent. The amount of the formic acid or the formate salt per 1 mol of silver is preferably 5 mmol or smaller, more preferably 1 mmol or smaller, on the image-forming layer side.

In the photothermographic material of the invention, the nucleating agent is preferably used in combination with an acid generated by hydration of diphosphorus pentaoxide or a salt thereof. Examples of the acid and the salt include metaphosphoric acid, pyrophosphoric acid, orthophosphoric acid, triphosphoric acid, tetraphosphoric acid, hexametaphosphoric acid, and salts thereof. Particularly preferred are orthophosphoric acid, hexametaphosphoric acid, and salts thereof. Specific examples of the salts include sodium orthophosphate, sodium dihydrogen orthophospate, sodium hexametaphosphate, and ammonium hexametaphosphate.

The amount of the acid generated by the hydration of diphosphorus pentaoxide or the salt thereof may be selected depending on the sensitivity, the fogging properties, etc. The amount of the acid or the salt to be applied per 1 $m^2$ of the photosensitive material is preferably 0.1 to 500 $mg/m^2$, more preferably 0.5 to 100 $mg/m^2$.

(Layer Structure and Components)

The photothermographic material of the invention may have a non-photosensitive layer or non-photosensitive layers, in addition to the image-forming layer. The non-photosensitive layers can be classified, based on the configuration thereof, as (a) a surface protecting layer provided on the image-forming layer (on the side farther from the support), (b) intermediate layer(s) provided between plural image-forming layers and/or between the image-forming layer and a surface protecting layer, (c) an undercoating layer provided between the image-forming layer and the support, and (d) a back layer provided on the side of the support opposite to the image-forming layer.

In addition, a layer serving as an optical filter may be provided as a non-photosensitive layer (a) or (b). An antihalation layer may be provided as a non-photosensitive layer (c) or (d).

1) Outermost Layer (Hydrophilic Polymer)

In the non-photosensitive layer, the ratio of hydrophilic polymer to the total binder is preferably at least 40 mass %, more preferably at least 60 mass %, still more preferably at least 90 mass %.

The hydrophilic polymer may be either a hydrophilic polymer derived from animal protein or a hydrophilic polymer not derived from animal protein, preferably a water-soluble polymer derived from animal protein in view of the setting property and efficient trapping of the generated organic acid.

<Hydrophilic Polymer Derived from Animal Protein>

In the invention, the hydrophilic polymer derived from animal protein is a natural or chemically modified polymer such as glue, casein, gelatin, or albumen.

The hydrophilic polymer derived from animal protein is preferably a gelatin. Gelatins may be classified to acid-processed gelatins and alkali-processed gelatins such as lime-treated gelatins according to the synthesis methods; gelatins of both classes are usable in the invention. The gelatin used as the hydrophilic polymer preferably has a molecular weight of 10,000 to 1,000,000. The hydrophilic polymer may be a modified gelatin such as a phthalated gelatin, which is prepared by modifying the amino or carboxyl group of a gelatin.

An aqueous gelatin solution is converted to a sol when heated to a temperature of 30° C. or higher, and is converted to a gel and loses its fluidity when cooled to a temperature which is lower than 30° C. Since the sol-gel transformation occurs reversibly depending on the temperature, the aqueous gelatin solution of the coating liquid has a setting property, whereby it loses the fluidity when cooled to a temperature which is lower than 30° C.

The hydrophilic polymer derived from animal protein may be used in combination with a hydrophilic polymer not derived from animal protein and/or a hydrophobic polymer described below.

<Hydrophilic Polymer not Derived from Animal Protein>

The hydrophilic polymer not derived from animal protein is a natural polymer other than animal protein (a polysaccharide, a microbial polymer, an animal polymer, etc.; for example a gelatin), a semisynthetic polymer (a cellulose-based polymer, a starch-based polymer, alginic-acid-based polymer, etc.), or a synthetic polymer (a vinyl-based polymer, etc.). Examples of the hydrophilic polymer not derived from animal protein include synthetic polymers such as polyvinyl alcohols, and natural or semisynthetic polymers derived from plant cellulose, to be hereinafter described. The hydrophilic polymer not derived from animal protein is preferably a polyvinyl alcohol or an acrylic acid-vinyl alcohol copolymer.

The hydrophilic polymer not derived from animal protein does not have a setting property. Therefore, when the hydrophilic polymer not derived from animal protein is used in a layer adjacent to the outermost layer, it is preferable to use the hydrophilic polymer not derived from animal protein in combination with a gelling agent.

The hydrophilic polymer not derived from animal protein is preferably a polyvinyl alcohol (PVA). Specific examples of the polyvinyl alcohols include polyvinyl alcohols having various saponification degrees, polymerization degrees, and neutralization degrees, modified polyvinyl alcohols, and copolymers of polyvinyl alcohols with other monomers.

The modified polyvinyl alcohol may be a cation-modified, anion-modified, SH-compound-modified, alkylthio-compound-modified, or silanol-modified polyvinyl alcohol. Further, the modified polyvinyl alcohols described in Koichi Nagano, et al., *Poval*, Kobunshi Kanko Kai may be used in the invention, the disclosures of which is incorporated herein by reference.

The viscosity of the aqueous solution of the polyvinyl alcohol can be adjusted or stabilized by adding trace of a solvent or inorganic salt, which is described in detail in Koichi Nagano, et al., *Poval*, Kobunshi Kanko Kai, Page 144 to 154. The disclosure of this literature is incorporated by reference herein in its entirety. As a typical example, it is preferable to add boric acid to the polyvinyl alcohol so as to improve the coating surface state. The mass ratio of boric acid to polyvinyl alcohol is preferably 0.01 mass % to 40 mass %.

The crystallinity of the polyvinyl alcohol can be increased by a heat treatment, thereby improving the waterproofness, as described in the above reference *Poval*. Accordingly, it is preferable to improve the waterproofness by heating the polyvinyl alcohol at the coating and drying or after the drying.

In order to further improve the waterproofness, a waterproofing agent such as those described in the above reference *Poval*, Page 256 to 261 is preferably added to the polyvinyl alcohol. Examples of the waterproofing agents include aldehydes; methylol compounds such as N-methylol urea and N-methylol melamine; activated vinyl compounds such as divinylsulfone and derivatives thereof; bis(β-hydroxyethylsulfone); epoxy compounds such as epichlorohydrin and derivatives thereof, polyvalent carboxylic acids such as dicarboxylic acids and polycarboxylic acids including polyacrylic acids, methyl vinyl ether-maleic acid copolymers, and isobutylene-maleic anhydride copolymers; diisocyanates; and inorganic crosslinking agents such as compounds of Cu, B, Al, Ti, Zr, Sn, V, Cr, etc.

In the invention, the waterproofing agent is preferably an inorganic crosslinking agent, more preferably boric acid or a derivative thereof, particularly preferably boric acid.

The hydrophilic polymer not derived from animal protein may be a water-soluble polymer other than polyvinyl alcohol. Specific examples thereof include: plant polysaccharides such as gum arabics, κ-carrageenans, τ-carrageenans, λ-carrageenans, guar gums (e.g. SUPERCOL manufactured by Squalon), locust bean gums, pectins, tragacanths, corn starches (e.g. PURITY-21 manufactured by National Starch & Chemical Co.), and phosphorylated starches (e.g. NATIONAL 78-1898 manufactured by National Starch & Chemical Co.);

microbial polysaccharides such as xanthan gums (e.g. KELTROL T manufactured by Kelco) and dextrins (e.g. NADEX 360 manufactured by National Starch & Chemical Co.);

animal polysaccharides such as sodium chondroitin sulfates (e.g. CROMOIST CS manufactured by Croda);

cellulose-based polymers such as ethylcelluloses (e.g. CELLOFAS WLD manufactured by I.C.I.), carboxymethylcelluloses (e.g. CMC manufactured by Daicel), hydroxyethylcelluloses (e.g. HEC manufactured by Daicel), hydroxypropylcelluloses (e.g. KLUCEL manufactured by Aqualon), methylcelluloses (e.g. VISCONTRAN manufactured by Henkel), nitrocelluloses (e.g. Isopropyl Wet manufactured by Hercules), and cationated celluloses (e.g. CRODACEL QM manufactured by Croda);

alginic acid-based compounds such as sodium alginates (e.g. KELTONE manufactured by Kelco) and propylene glycol alginates; and other polymers such as cationated guar gums (e.g. HI-CARE 1000 manufactured by Alcolac) and sodium hyaluronates (e.g. HYALURE manufactured by Lifecare Biomedial).

Specific examples of the hydrophilic polymer not derived from animal protein further include agars, furcellerans, guar gums, karaya gums, larch gums, guar seed gums, psyllium seed gums, quince seed gums, tamarind gums, gellan gums, and tara gums. Among them, polymers which are highly water-soluble are preferable. The hydrophilic polymer not derived from animal protein is preferably such a polymer that the aqueous solution thereof undergoes sol-gel transformation by temperature change between 5 to 95° C. within 24 hours.

Further, the hydrophilic polymer not derived from animal protein may be a synthetic polymer, and specific examples thereof include acrylic polymers such as sodium polyacrylate, polyacrylic acid copolymers, polyacrylamide, and polyacrylamide copolymers; vinyl polymers such as polyvinylpyrrolidone and polyvinylpyrrolidone copolymers; and other synthetic polymers such as polyethylene glycol, polypropylene glycol, polyvinyl ether, polyethyleneimine, polystyrene sulfonate and copolymers thereof, polyvinyl sulfonate and copolymers thereof, polyacrylic acids and copolymers thereof, maleic acid copolymers, maleic monoester copolymers, and acryloylmethylpropanesulfonic acid polymers and copolymers thereof.

Further, polymers with high water absorption described in U.S. Pat. No. 4,960,681, JP-A No. 62-245260 (the disclosures of which are incorporated herein by reference), etc. may be used as the hydrophilic polymer derived from animal protein. Examples of the polymers with high water absorption include homopolymers of vinyl monomers having a —COOM or —$SO_3M$ group (in which M is a hydrogen or alkaline metal atom) such as sodium methacrylate, ammonium methacrylate, and SUMIKA Gel L-5H available from Sumitomo Chemical Co., Ltd, and copolymers of such vinyl monomers with other vinyl monomers.

Preferred water-soluble polymer among them is SUMIKA GEL L-5H available from Sumitomo Chemical Co., Ltd.

<Gelling Agent and Gelation Accelerator>

The gelling agent used in the invention is such a substance that, when it is added to the aqueous solution of the hydrophilic polymer not derived from animal protein and the solution is cooled, the solution is gelated, or a substance which cause gelation when used in combination with a gelation accelerator. The fluidity of the solution is remarkably reduced by the gelation.

The gelling agent may be a water-soluble polysaccharide, and specific examples thereof include agars, κ-carrageenans, τ-carrageenans, alginic acid, alginate salts, agaroses, furcellerans, gellan gums, glucono delta lactones, azotobacter vinelandii gums, xanthan gums, pectins, guar gums, locust bean gums, tara gums, cassia gums, glucomannans, tragacanth gums, karaya gums, pullulans, arabic gums, arabinogalactans, dextrans, carboxymethylcellulose sodium salt, methylcelluloses, psyllium seed gums, starches, chitins, chitosans, and curdlans.

The agars, carrageenans, gellan gums, etc. can form the gel when they are cooled after heating and melting.

More preferred among these gelling agents are K-carrageenans (e.g., K-9F available from Taito Co., Ltd., K-15, K-21 to 24, and I-3 available from Nitta Gelatin Inc., etc.), κ-carrageenans, and agars, and particularly preferred are K-carrageenans.

The mass ratio of gelling agent to binder polymer is preferably 0.01 to 10.0 mass %, more preferably 0.02 to 5.0 mass %, further preferably 0.05 to 2.0 mass %.

The gelling agent is preferably used in combination with a gelation accelerator. The gelation accelerator used in the invention is such a substance that the gelation accelerator enhances the gelation when brought into contact with a specific gelling agent. A specific combination of the gelling agent and the gelation accelerator enables the gelation accelerator to perform its function. Examples of the combinations of the gelling agent and the gelation accelerator usable in the invention include the following ones:

a combination of a gelation accelerator selected from alkaline metal ions such as a potassium ion and alkaline earth metal ions such as a calcium ion and magnesium ion, and a gelling agent selected from carrageenan, alginate salts, gellan gum, azotobacter vinelandii gum, pectin, carboxymethylcellulose sodium salt, etc.;

a combination of a gelation accelerator selected from boron compounds such as boric acid, and a gelling agent selected from guar gum, locust bean gum, tara gum, cassia gum, etc.;

a combination of a gelation accelerator selected from acids and alkalis, and a gelling agent selected from alginate salts, glucomannan, pectin, chitin, chitosan, curdlan, etc.; and a combination of a gelling agent and a gelation accelerator selected from water-soluble polysaccharides capable of reacting with the gelling agent to form a gel, such as a combination of xanthan gum as a gelling agent and cassia gum as a gelation accelerator, and a combination of carrageenan as a gelling agent and locust bean gum as a gelation accelerator.

Specific examples of the combinations of the gelling agent and the gelation accelerator include the following combinations:

a) combination of κ-carrageenan and potassium;

b) combination of τ-carrageenan and calcium;

c) combination of low methoxyl pectin and calcium;

d) combination of sodium alginate and calcium;

e) combination of gellan gum and calcium;

f) combination of gellan gum and an acid; and g) combination of locust bean gum and xanthan gum.

A plurality of the combinations may be used simultaneously.

The gelation accelerator and the gelling agent are preferably added to different layers though they may be added to the same layer. In an embodiment, the gelation accelerator is added to a layer which is not in contact with a layer containing the gelling agent. In this embodiment, a layer free from both of the gelling agent and the gelation accelerator is disposed between the layer containing the gelling agent and the layer containing the gelation accelerator.

The mass ratio of gelation accelerator to gelling agent is preferably 0.1 to 200 mass %, more preferably 1.0 to 100 mass %.

<Combination of Hydrophilic Polymers>

In addition to the above hydrophilic polymers, the binder of the non-photosensitive layer may further include 30 mass % or less of a hydrophobic polymer. The hydrophobic polymer is preferably a polymer dispersible in an aqueous solvent.

Preferred examples of the polymers dispersible in an aqueous solvent include synthetic resins, polymers, and copolymers, and other film-forming media, such as cellulose acetates, cellulose acetate butyrates, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, cellulose esters, and polyamides.

<Coating Amount of Binder>

The total coating amount of binder (including hydrophilic polymer and latex polymer) of the non-photosensitive layer is preferably 1.0 g/$m^2$ to 6.0 g/$m^2$, more preferably 0.5 g/$m^2$ to 4.0 g/$m^2$.

The non-photosensitive layer may further include other additives such as a surfactant, a pH adjuster, a preservative, and a fungicide.

When the non-photosensitive layer is a surface protective layer, it is preferable to use a lubricant such as liquid paraffin and a fatty acid ester. The amount of the lubricant may be 1 mg/$m^2$ to 200 mg/$m^2$, preferably 10 mg/m to 150 mg/$m^2$ more preferably 20 mg/$m^2$ to 100 mg/$m^2$.

2) Antihalation Layer

In the photothermographic material of the invention, an antihalation layer may be disposed such that the antihalation layer is farther from the exposure light source than the image-forming layer is.

The antihalation layer is described, for example, in JP-A No. 11-65021, Paragraphs 0123 to 0124, JP-A Nos. 11-223898, 9-230531, 10-36695, 10-104779, 11-231457, 11-352625, and 11-352626, the disclosures of which are incorporated herein by reference.

The antihalation layer includes an antihalation dye having absorption in the exposure wavelength range. When the exposure wavelength is within the infrared range, an infrared-absorbing dye may be used as the antihalation dye, and the infrared-absorbing dye is preferably a dye which does not absorb visible light.

When a dye having absorption in the visible light range is used to prevent the halation, in a preferable embodiment, the color of the dye does not substantially remain after image formation. It is preferable to achromatize the dye by heat at the heat development. In a more preferable embodiment, a base precursor and a thermally-achromatizable dye are added to a non-photosensitive layer so as to impart the antihalation function to the non-photosensitive layer. These techniques are described, for example in JP-A No. 11-231457, the disclosure of which is incorporated by reference herein.

The amount of the achromatizable dye to be applied may be determined depending on the purpose. Generally, the amount of the achromatizable dye is selected such that the optical density (the absorbance) exceeds 0.1 at the desired wavelength. The optical density is preferably 0.15 to 2, more preferably 0.2 to 1. The amount of the dye required for obtaining such an optical density is generally 0.001 to 1 g/m$^2$.

When the dye is achromatized in this manner, the optical density after the heat development can be lowered to 0.1 or lower. In an embodiment, two or more achromatizable dyes are used in combination in a thermally achromatizable recording material or a photothermographic material. Similarly, two or more base precursors may be used in combination.

In the thermal achromatization, it is preferable to use an achromatizable dye, a base precursor, and a substance which can lower the melting point of the base precursor by 3° C. or more when mixed with the base precursor, in view of the thermal achromatizability, as described in JP-A No. 11-352626, the disclosure of which is incorporated by reference herein. Examples of the substance include diphenylsulfone, 4-chlorophenyl(phenyl)sulfone, and 2-naphtyl benzoate.

3) Back Layer

Examples of the back layer usable in the invention are described in JP-A No. 11-65021, Paragraphs 0128 to 0130, the disclosure of which is incorporated herein by reference.

In the invention, a coloring agent having an absorption peak within the wavelength range of 300 to 450 nm may be added to the photosensitive material so as to improve the color tone of silver and to suppress the image deterioration with time. Examples of the coloring agent are described in JP-A Nos. 62-210458, 63-104046, 63-103235, 63-208846, 63-306436, 63-314535, 01-61745, and 2001-100363, the disclosures of which are incorporated by reference herein.

Such a coloring agent is generally added in an amount in the range of 0.1 mg/m$^2$ to 1 g/m$^2$. In an embodiment, a coloring agent is added to a back layer disposed on the opposite side to the image-forming layer.

It is preferable to use a dye having an absorption peak at 580 to 680 nm in order to control base color tone. Preferable examples of the dye include azomethine type oil-soluble dyes such as described in JP-A Nos. 4-359967 and 4-359968, and phthalocyanine type water-soluble dyes such as described in JP-A No. 2003-295388, which each have a small absorption intensity in the shorter wavelength range. The disclosures of the above patent documents are incorporated herein by reference. The dye for this purpose may be added to any layer, preferably to a non-photosensitive layer on the image-forming layer side or to a layer on the back side.

The photothermographic material of the invention is preferably a so-called single-sided photosensitive material, which comprises at least one image-forming layer including the silver halide emulsion on one side of the support, and a back layer on the other side of the support.

4) Matting Agent

In the invention, a matting agent is preferably added to improve the conveyability. The matting agent is described in JP-A No. 11-65021, Paragraphs 0126 and 0127, the disclosure of which is incorporated herein by reference. The amount of the matting agent to be applied per 1 m$^2$ of the photosensitive material is preferably 1 to 400 mg/m$^2$, more preferably 5 to 300 mg/m$^2$.

The matting agent may be delomorphous or amorphous, and is preferably delomorphous. The matting agent is preferably in a sphere shape.

The volume-weighted average equivalent sphere diameter of the matting agent provided on the emulsion surface is preferably 0.3 to 10 μm, more preferably 0.5 to 7 μm. The variation coefficient of the particle diameter distribution of the matting agent is preferably 5 to 80%, more preferably 20 to 80%. The variation coefficient is obtained according to the equation:

$$\text{variation coefficient}=(\text{standard deviation of particle diameter})/(\text{average particle diameter})\times 100.$$

Further, two or more types of the matting agents having different average particle diameters may be provided on the surface on the image-forming layer side. In this case, the difference of the average particle diameters between the smallest matting agent and the largest matting agent is preferably 2 to 8 μm, more preferably 2 to 6 μm.

The volume-weighted average equivalent sphere diameter of the matting agent provided on the back surface is preferably 1 to 15 μm, more preferably 3 to 10 μm. The variation coefficient of the particle diameter distribution of the matting agent is preferably 3 to 50%, more preferably 5 to 30%. Further, two or more types of the matting agents having different average particle diameters may be provided on the back surface. In this case, the difference of the average particle diameters between the smallest matting agent and the largest matting agent is preferably 2 to 14 μm, more preferably 2 to 9 μm.

The mattness of the emulsion surface is not limited as long as star defects are not caused. The Bekk smoothness of the surface is preferably 30 to 2,000 seconds, particularly preferably 40 to 1,500 seconds. The Bekk smoothness can be easily obtained by *Method for testing smoothness of paper and paperboard by Bekk tester* according to JIS P8119, or TAPPI standard method T479, the disclosures of which are incorporated by reference herein.

The mattness of the back layer is preferably such that the Beck smoothness is 10 to 1,200 seconds. The Beck smoothness is more preferably 20 to 800 seconds, further preferably 40 to 500 seconds.

In the invention, the matting agent is preferably included in a layer or layers selected from the outermost layer, the layer functioning as the outermost layer, and a layer near the outermost layer. The matting agent is preferably contained in a layer functioning as a protective layer.

5) Polymer Latex

When the photothermographic material of the invention is used for printing, in which dimensional change is problematic, it is preferable to use a polymer latex in a surface protective layer and/or a back layer. Such a polymer latex is described, for example, in *Gosei Jushi Emulsion*, (compiled by Taira Okuda and Hiroshi Inagaki, issued by Kobunshi Kanko Kai (1978)); *Gosei Latex no Oyo*, (compiled by Takaaki Sugimura, Yasuo Kataoka, Souichi Suzuki, and Keishi Kasahara, issued by Kobunshi Kanko Kai (1993); *Gosei Latekkusu no Kagaku* (written by Soichi Muroi, issued by Kobunshi Kanko Kai (1970)), the disclosures of which are incorporated herein by reference. Specific examples thereof include latex of methyl methacrylate (33.5 mass %)-ethyl acrylate (50 mass %)-methacrylic acid (16.5 mass %) copolymer, latex of methyl methacrylate (47.5 mass %)-butadiene (47.5 mass %)-itaconic acid (5 mass %) copolymer, latex of ethyl acrylate-methacrylic acid copolymer, latex of methyl methacrylate (58.9 mass %)-2-ethylhexyl acrylate (25.4 mass %)-styrene (8.6 mass %)-2-hydroxyethyl methacrylate (5.1 mass %)-acrylic acid (2.0 mass %) copolymer, and latex of methyl methacrylate (64.0 mass %)-styrene (9.0 mass %)-butyl acrylate (20.0 mass %)-2-hydroxyethyl methacrylate (5.0 mass %)-acrylic acid (2.0 mass %) copolymer. Further, regarding the binder for the surface protective layer, the combinations of polymer latexes described in JP-A No. 2000-267226, the technique described in paragraph Nos. 0021 to 0025 of JP-A No. 2000-267226, the technique described in paragraph nos. 0027 to 0028 of Japanese Patent Application No. 11-6872, and the technique described in paragraph Nos. 0023 to 0041 of JP-A No. 2000-19678 may also be applied, the disclosures of which are incorporated herein by reference. The proportion of amount of the polymer latex to the total amount of binder in the surface protective layer is preferably 10 mass % to 90 mass %, more preferably 20 mass % to 80 mass %.

6) Film Surface pH

The photothermographic material of the invention before heat development preferably has a film surface pH of 7.0 or lower. The film surface pH is more preferably 6.6 or lower. The lower limit of the film surface pH may be approximately 3, though it is not particularly restricted. The film surface pH is still more preferably 4 to 6.2. It is preferable to adjust the film surface pH using an organic acid such as a phthalic acid derivative, a nonvolatile acid such as sulfuric acid, or a volatile base such as ammonia, from the viewpoint of lowering the film surface pH. In order to achieve a low film surface pH, it is preferable to use ammonia since ammonia is high in volatility and can be removed during coating or before heat development. It is also preferable to use ammonia in combination with a nonvolatile base such as sodium hydroxide, potassium hydroxide, or lithium hydroxide. Methods for measuring the film surface pH are described in JP-A No. 2000-284399, Paragraph 0123, the disclosure of which is incorporated herein by reference.

7) Film Hardener

A film hardener may be included in layers such as the image-forming layer, the protective layer, and the back layer. Examples of the film hardeners are described in T. H. James, *The Theory of the Photographic Process, Fourth Edition*, Page 77 to 87 (Macmillan Publishing Co., Inc., 1977), the disclosure of which is incorporated by reference herein. Preferred examples of the film hardeners include: chromium alums; 2,4-dichloro-6-hydroxy-s-triazine sodium salt; N,N-ethylenebis(vinylsulfonacetamide); N,N-propylenebis(vinylsulfonacetamide); polyvalent metal ions described in Page 78 of the above reference; polyisocyanates described in U.S. Pat. No. 4,281,060, JP-A No. 6-208193, etc.; epoxy compounds described in U.S. Pat. No. 4,791,042, etc.; and vinylsulfone compounds described in JP-A No. 62-89048, etc. The disclosures of the above patent documents are incorporated herein by reference.

The film hardener is added in the form of a solution, and the solution is added to the coating liquid for the protective layer preferably in the period of 180 minutes before coating to immediately before coating, more preferably in the period of 60 minutes before coating to 10 seconds before coating. The method and conditions of mixing the film hardener into the coating liquid are not particularly limited as long as the advantageous effects of the invention can be sufficiently obtained. In an embodiment, the film hardner is mixed with the coating liquid in a tank while controlling the addition flow rate and the feeding amount to the coater, such that the average retention time calculated from the addition flow rate and the feeding amount to the coater is the desired time. In another embodiment, the film hardner is mixed with the coating liquid by a method using a static mixer described, for example, in N. Hamby, M. F. Edwards, and A. W. Nienow, translated by Koji Takahashi, *Ekitai Kongo Gijutsu*, Chapter 8 (Nikkan Kogyo Shimbun, Ltd., 1989), the disclosure of which is incorporated herein by reference.

8) Surfactant

Surfactants described in JP-A No. 11-65021 (the disclosure of which is incorporated herein by reference in its entirety), Paragraph 0132, solvents described in ibid, Paragraph 0133, supports described in ibid, Paragraph 0134, antistatic layers and conductive layers described in ibid, Paragraph 0135, methods for forming color images described in ibid, Paragraph 0136, and slipping agents described in JP-A No. 11-84573 (the disclosure of which is incorporated herein by reference in its entirety), Paragraph 0061 to 0064 and JP-A No. 2001-83679 (the disclosure of which is incorporated herein by reference in its entirety) Paragraph 0049 to 0062, can be used in the invention.

In the invention, it is preferable to use a fluorochemical surfactant. Specific examples of the fluorochemical surfactants include compounds described in JP-A Nos. 10-197985, 2000-19680, and 2000-214554, the disclosures of which are incorporated herein by reference. Further, fluorine-containing polymer surfactants described in JP-A No. 9-281636 (the disclosure of which is incorporated herein by reference) are also preferable in the invention. In an embodiment, the fluorochemical surfactants described in JP-A Nos. 2002-82411, 2003-057780, and 2003-149766 (the disclosures of which are incorporated herein by reference) are used in the photothermographic material of the invention. The fluorochemical surfactants described in JP-A Nos. 2003-057780 and 2003-149766 are particularly preferred from the viewpoints of the electrification control, the stability of the coating surface, and the slipping properties in the case of using an aqueous coating liquid. The fluorochemical surfactants described in JP-A No. 2003-149766 are most preferred because they are high in the electrification control ability and are effective even when used in a small amount.

In the invention, the fluorochemical surfactant may be used in the image-forming layer side and/or the back side, and is preferably used in both the image-forming layer side and/or the back side. It is particularly preferable to use a combination of the fluorochemical surfactant and the above-described conductive layer including a metal oxide. In this case, sufficient performance can be achieved even if the fluorochemical surfactant in the electrically conductive layer side is reduced or removed.

The amount of the fluorochemical surfactant used in each of the emulsion surface and the back surface is preferably 0.1 to 100 mg/m$^2$, more preferably 0.3 to 30 mg/m$^2$, further preferably 1 to 10 mg/m$^2$. In particular, the fluorochemical surfactants described in JP-A No. 2003-149766 can exhibit excellent effects, whereby the amount thereof is preferably 0.01 to 10 mg/m$^2$, more preferably 0.1 to 5 mg/m$^2$.

9) Antistatic Agent

The photothermographic material of the invention preferably comprises an electrically conducting layer including an electrically conductive material such as a metal oxide or an electrically conductive polymer. The electrically conducting layer (antistatic layer) may be the same layer as a layer selected from the undercoat layer, the back surface protective layer, and the like, or may be provided as a separate layer which is different from those layers. The conductive material in the antistatic layer is preferably a metal oxide whose conductivity has been heightened by incorporation of oxygen defects and/or hetero-metal atoms.

The metal oxide is preferably ZnO, $TiO_2$, or $SnO_2$. It is preferable to add Al or In to ZnO. It is preferable to add Sb, Nb, P, a halogen atom, or the like to $SnO_2$. It is preferable to add Nb, Ta, or the like to $TiO_2$. $SnO_2$ to which Sb has been added is particularly preferable conductive substance for the electrically conducting layer. The amount of the hetero atom is preferably 0.01 to 30 mol %, more preferably 0.1 to 10 mol %. The particles of the metal oxide may be in a spherical shape, in a needle shape, or in a plate shape. The metal oxide particles are preferably needle-shaped particles with the ratio of the major axis to the minor axis of 2.0 or higher in view of the conductivity, and the ratio is more preferably 3.0 to 50. The amount of the metal oxide is preferably 1 to 1,000 mg/m$^2$, more preferably 10 to 500 mg/m$^2$, furthermore preferably 20 to 200 mg/m$^2$. The antistatic layer may be provided on the image-forming layer side or on the back side. In a preferable embodiment, the antistatic layer is provided between the support and the back layer. Specific examples of the antistatic layer are described in JP-A No. 11-65021, Paragraph 0135; JP-A Nos. 56-143430, 56-143431, 58-62646, and 56-120519; JP-A No. 11-84573, Paragraph 0040 to 0051; U.S. Pat. No. 5,575,957; and JP-A No. 11-223898, Paragraph 0078 to 0084; the disclosures of which are incorporated herein by reference.

10) Support

The support comprises preferably a heat-treated polyester, particularly a polyethylene terephthalate, which is subjected to a heat treatment at 130 to 185° C. so as to relax the internal strains of the film generated during biaxial stretching, thereby eliminating the heat shrinkage strains during heat development. In the case of a photothermographic material for medical use, the support may be colored with a blue dye (e.g., Dye-1 described in Examples of JP-A No. 8-240877, the disclosure of which is incorporated herein by reference) or uncolored. The support is preferably undercoated, for example, with a water-soluble polyester described in JP-A No. 11-84574, a styrene-butadiene copolymer described in JP-A No. 10-186565, a vinylidene chloride copolymer described in JP-A No. 2000-39684 or Japanese Patent Application No. 11-106881, Paragraph 0063 to 0080, the disclosures of which are incorporated herein by reference. When the support is coated with the image-forming layer or the back layer, the support preferably has a moisture content of 0.5% by mass or lower.

11) Other Additives

The photothermographic material of the invention may further include additives such as antioxidants, stabilizing agents, plasticizers, UV absorbers, and coating aids. The additives may be added to any one of the image-forming layer and the non-photosensitive layers. The additives may be used with reference to WO 98/36322, EP 803764A1, JP-A Nos. 10-186567 and 10-18568, the disclosures of which are incorporated herein by reference.

12) Coating Method

The photothermographic material of the invention may be formed by any coating method. Specific examples of the coating method include extrusion coating methods, slide coating methods, curtain coating methods, dip coating methods, knife coating methods, flow coating methods, extrusion coating methods using a hopper described in U.S. Pat. No. 2,681,294, the disclosure of which is incorporated herein by reference. The coating method is preferably an extrusion coating method described in Stephen F. Kistler and Petert M. Schweizer, *Liquid Film Coating*, Page 399 to 536 (CHAPMAN & HALL, 1997) (the disclosure of which is incorporated herein by reference), or a slide coating method, more preferably a slide coating method. Examples of slide coaters for the slide coating methods are described in the above reference, Page 427, FIG. 11b.1. Two or more layers may be simultaneously formed by any of methods described in the above reference, Page 399 to 536, and methods described in U.S. Pat. No. 2,761,791 and British Patent No. 837,095, the disclosures of which are incorporated herein by reference. Particularly preferred coating methods used in the invention include those described in JP-A Nos. 2001-194748, 2002-153808, 2002-153803, and 2002-182333, the disclosures of which are incorporated herein by reference.

In the invention, the coating liquid for the image-forming layer is preferably a so-called thixotropy fluid. The thixotropy fluid may be used with reference to JP-A No. 11-52509, the disclosure of which is incorporated herein by reference. The viscosity of the coating liquid for the image-forming layer is preferably 400 to 100,000 mPa·s at a shear rate of 0.1 $S^{-1}$, more preferably 500 to 20,000 mPa·s at a shear rate of 0.1 $S^{-1}$. Further, the viscosity of the coating liquid is preferably 1 to 200 mPa·s at a shear rate of 1,000 $S^{-1}$, more preferably 5 to 80 mPa·s at the shear rate of 1,000 $S^{-1}$.

In the preparation of the coating liquid, it is preferable to use a known in-line mixing apparatus or a known in-plant mixing apparatus when two or more liquids are mixed. An in-line mixing apparatus described in JP-A No. 2002-85948 and an in-plant mixing apparatus described in JP-A No. 2002-90940 can be preferably used in the invention. The disclosures of the above patent documents are incorporated by reference herein.

The coating liquid is preferably subjected to a defoaming treatment to obtain an excellent coating surface. Preferred methods for the defoaming treatment are described in JP-A No. 2002-66431, the disclosure of which is incorporated herein by reference.

In or before the application of the coating liquid, the support is preferably subjected to electrical neutralization so as to prevent adhesion of dusts, dirts, etc. caused by the electrification of the support. Preferred examples of the neutralizing methods are described in JP-A No. 2002-143747, the disclosure of which is incorporated herein by reference.

When a non-setting type coating liquid for the image-forming layer is dried, it is important to precisely control drying air and drying temperature. Preferred drying methods are described in detail in JP-A Nos. 2001-194749 and 2002-139814, the disclosures of which are incorporated herein by reference.

The photothermographic material of the invention is preferably heat-treated immediately after coating and drying, so as to increase the film properties. In a preferable embodiment, the heating temperature of the heat treatment is controlled such that the film surface temperature is 60 to 100° C. The heating time is preferably 1 to 60 seconds. The film surface temperature in the heat treatment is more preferably 70 to 90° C., and the heating time is more preferably 2 to 10 seconds. Preferred examples of the heat treatments are described in JP-A No. 2002-107872, the disclosure of which is incorporated herein by reference.

Further, the production methods described in JP-A Nos. 2002-156728 and 2002-182333 (the disclosures of which are incorporated herein by reference) can be preferably used to stably produce the photothermographic material of the invention continuously.

The photothermographic material of the invention is preferably a monosheet type material, which can form an image on the material without using another sheet such as an image-receiving material.

13) Packaging Material

It is preferable to pack the photosensitive material of the invention in a packaging material having a low oxygen permeability and/or a low water permeability so as to prevent deterioration of the photographic properties during storage or to prevent curling. The oxygen permeability is preferably 50 ml/atm·m$^2$·day or lower at 25° C., more preferably 10 ml/atm·m$^2$·day or lower at 25° C., furthermore preferably 1.0 ml/atm·m$^2$·day or lower at 25° C. The water permeability is preferably 10 g/atm·m$^2$·day or lower, more preferably 5 g/atm·m$^2$·day or lower, furthermore preferably 1 g/atm·m$^2$·day or lower.

Specific examples of the packaging material having a low oxygen permeability and/or a low water permeability include materials described in JP-A Nos. 8-254793 and 2000-206653, the disclosures of which are incorporated herein by reference.

14) Other Technologies

Other technologies usable for the photothermographic material of the invention include those described in EP 803764A1, EP 883022A1, WO 98/36322, and JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, 2001-348546, and 2000-187298, the disclosures of which are incorporated herein by reference.

In the case a multi-color photothermographic material, the image-forming layers are generally separated from each other by providing functional or non-functional barrier layers between them as described in U.S. Pat. No. 4,460,681, the disclosure of which is incorporated herein by reference.

The multicolor photothermographic material may comprise a combination of two layers for each color or a single layer including all the components as described in U.S. Pat. No. 4,708,928, the disclosure of which is incorporated herein by reference.

3. Image Forming Method

1) Exposure

The exposure light source may be a red to infrared emission laser such as an He—Ne laser and a red semiconductor laser, or a blue to greed emission laser such as an $Ar^+$ laser, an He—Ne laser, an He—Cd laser, and a blue semiconductor laser. The laser is preferably a red to infrared emission semiconductor laser, and the peak wavelength of the laser is 600 to 900 nm, preferably 620 to 850 nm. The laser is more preferably an infrared semiconductor laser (780 mm, 810 nm) because such a laser has high power and because the photothermographic material of the invention can be transparent.

In recent years, a blue semiconductor laser and a module comprising an SHG (Second Harmonic Generator) and a semiconductor laser have been developed, and thus laser output units with short wavelength ranges have attracted a lot of attention. Blue semiconductor lasers can form a highly fine image, can increase recording density, is long-lived, and has stable output, whereby the demand for blue semiconductor lasers is expected to be increased. The peak wavelength of the blue laser is preferably 300 to 500 nm, more preferably 400 to 500 nm.

In a preferable embodiment, the laser light is emitted in vertical multimode by high frequency superposition, etc.

2) Heat Development

The photothermographic material of the invention may be developed by any method, but is generally exposed image-wise and then heat-developed. The development temperature is preferably 80 to 250° C., more preferably 100 to 140° C., further preferably 110 to 130° C. The development time is preferably 1 to 60 seconds, more preferably 3 to 30 seconds, furthermore preferably 5 to 25 seconds, particularly preferably 7 to 15 seconds.

Heat development may be conducted by a drum heater or a plate heater, preferably by a drum heater. Further, when a protective layer is present on or over the image-forming layer, it is preferable to conduct a heat treatment by bringing the surface on the protective layer side into contact with a heating device in view of uniform heating, heat efficiency and operation efficiency.

3) System

Fuji Medical Dry Laser Imager FM-DPL and DRYPIX 7000 and Kodak DRYVIEW 8700 Laser Imager Plus are known as laser imagers for medical use comprising an exposure region and a heat developing region. FM-DPL is described in Fuji Medical Review, No. 8, Page 39 to 55 (the disclosure of which is incorporated herein by reference), and the technologies disclosed therein can be applied to the invention. The photothermographic material of the invention can be used for the laser imager in AD Network, proposed by Fuji Film Medical Co., Ltd. as a network system according to DICOM Standards.

(Application of the Invention)

The photothermographic material of the invention forms black and white images of silver and is preferably used as a photothermographic material for medical diagnosis, industrial photography, printing, or COM. The photothermographic material of the invention is particularly preferably used as a photothermographic material for medical diagnosis.

EXAMPLES

The present invention is to be described specifically by way of Examples. However, Examples should not be construed as limiting the invention.

Example 1

1. Preparation of Organic Silver Salt Dispersion

1) Preparation of Dispersion (1) of a Comparative Example 100 kg of behenic acid manufactured by Henkel Co. (trade name of product; EDENOR C 22-85R) was mixed with 1200 kg of isopropyl alcohol, and dissolved at 50° C., filtered through a 10 μm filter, and then cooled to 30° C. to be recrystallized. The cooling rate at recrystallization was adjusted to 3° C./hr. The resultant crystal was centrifugally filtered, washed with shower of 100 kg of isopropyl alcohol and then dried. When the obtained crystal was esterified and measured by GC-FID, it was found that behenic acid content was 94.9 mol %, lignoceric acid content was 2 mol %, arachidic acid content was 3 mol %, stearic acid content was 0.1 mol %, and erucic acid content was 0.001 mol %.

88 kg of the recrystallized behenic acid, 422 L of distilled water, 49.2 L of a 5 mol/L aqueous solution of NaOH and 120 L of t-butyl alcohol were mixed and allowed to react at 75° C. for one hour under stirring to form a sodium behenate solution. Separately, 206.2 L of an aqueous solution (pH 4.0) containing 40.4 kg of silver nitrate was prepared and kept at 10° C. To a mixture of 635 L of distilled water and 30 L of t-butyl alcohol contained in a reaction vessel kept at 30° C. were added the entire volume of the above-mentioned sodium behenate solution and the entire volume of the aqueous silver nitrate solution under sufficient stirring at constant flow rates over the periods of 93 minutes and 15 seconds, and 90 minutes, respectively; in this operation, only the aqueous silver nitrate solution was added during a period within 11 minutes from the initiation of the addition of the aqueous silver nitrate solution, and then the addition of the sodium behenate solution was started, and then the addition of the aqueous silver nitrate solution was completed, so that only the sodium behenate solution was added during a period within 14 minutes and 15 seconds from the completion of the addition of the aqueous silver nitrate solution. In this operation, the outside temperature was controlled so that the temperature in the reaction vessel was maintained at 30° C. and the liquid temperature was kept constant. The pipe of the addition system for the sodium behenate solution was warmed by circulating warmed water in the space between the outer pipe and the inner pipe of a double pipe, and temperature was controlled such that the liquid temperature at the outlet orifice of the addition nozzle was 75° C. The pipe of the addition system for the aqueous silver nitrate solution was maintained at a constant temperature by circulating cold water in the space between the outer pipe and the inner pipe of a double pipe. The addition position of the sodium behenate solution and the addition position of the aqueous silver nitrate solution were arranged symmetrically with respect to the stirring axis as a center, and the positions had such heights as not to contact with the reaction solution.

After finishing the addition of the sodium behenate solution, the mixture was left under stirring for 20 minutes at the same temperature, and then the temperature was increased to 35° C. over 30 minutes, followed by aging for 210 minutes. After finishing the aging, the solid content was immediately separated by centrifugal filtration and washed with water until an electric conductivity of the filtrate became 30 μS/cm. Thus, a fatty acid silver salt was obtained. The obtained solid content was stored as a wet cake without being dried.

When the shape of the obtained silver behenate grains was evaluated by electron microscopic photography, it was found that the grains were crystals having a=0.23 μm, b=0.63 μm, and c=0.86 μm in average values, an average aspect ratio of 2.4, and an average equivalent-sphere diameter variation coefficient of 35% (a, b and c have the meanings defined above).

To the wet cake corresponding to 260 kg of the dry solid content were added 19.3 kg of polyvinyl alcohol (trade name: PVA-217) and water to make the total amount 1000 kg, and the mixture was made into slurry by a dissolver fin and further pre-dispersed by a pipeline mixer (PM-10 type, manufactured by Mizuho Industrial Co., Ltd.).

Then, the pre-dispersed stock solution was dispersed three times by using a disperser (trade name: Microfluidizer M-610, manufactured by Microfluidex International Corporation, using Z type interaction chamber) with a pressure controlled at 1150 kg/cm$^2$ to obtain a silver behenate dispersion. A dispersion temperature of 18° C. was achieved by providing coiled heat exchangers fixed in front of and behind the interaction chamber and controlling the temperature of refrigerant.

2) Preparation of Dispersion (2) of Comparative Example

First, deionized water, a 10 mass % solution of dodecylthiopolyacrylamide surfactant (72 g) and the purified behenic acid described above (in an amount corresponding to 0.137 mol) were charged in a reactor. The content in the reactor was stirred at 150 rpm, and heated to 70° C. during which a 10 mass % KOH solution (70.6 g) was charged in a reactor. Then, the content in the reactor was heated to 80° C. and kept for 30 min till it turns into a cloudy solution. Then, the reaction mixture was cooled to 70° C. and a silver nitrate solution (50 mass % solution, 21.3 g) was added to the reactor over 30 min while controlling the addition rate. Then, the content in the reactor was kept at the reaction temperature for 30 min, cooled to room temperature and then subjected to decantation. As a result, a dispersion of nano-particles of silver behenate having a median particle diameter of 150 nm was obtained (with a solid content of 3%).

The dispersion of the nano particles of silver behenate with a solid content of 3 mass % (12 kg) was charged in a diafiltration/ultra filtration apparatus (having a osmotic membrane cartridge of Osmonics model 21-HZ20-S8J with an effective surface area of 0.34 m$^2$ and a nominal cut-off molecular weight of 50,000). The apparatus was operated such that the pressure on the osmotic membrane was 3.5 kg/cm$^2$ (50 lb/in$^2$) and the pressure of the downstream of the osmotic membrane was 1.4 kg/cm$^2$ (20 lb/in$^2$). The osmotic liquid was replaced with deionized water till 24 g of permeate was removed from the dispersion. Water for substitution was stopped at this stage, and the apparatus was operated till the solid content of the dispersion reached 28 mass %, to obtain a dispersion of extremely fine grains of silver behenate.

When the shape of the obtained silver behenate grains was evaluated by electron microscopic photography, it was found that the grains were crystals having a=0.3 μm, b=1.0 μm, and c=1.8 μm in average values, an average aspect ratio of 6.1, and an average equivalent-sphere diameter variation coefficient of 43% (a, b and c have the meanings defined above).

3) Preparation of Dispersions (3) to (11) of the Invention 100 kg of behenic acid manufactured by Henkel Co. (trade name of product; EDENOR C 22-85R) was mixed with 1200 kg of isopropyl alcohol, and dissolved at 50° C., filtered through a 10 μm filter, and then cooled to 30° C. to be recrystallized. The cooling rate at recrystallization was set at 3° C./hr. The resultant crystal was centrifugally filtered, washed with shower of 100 kg of isopropyl alcohol and then dried. When the obtained crystal was esterified and measured by GC-FID, it was found that behenic acid content was 94.9 mol %, lignoceric acid content was 2 mol %, arachidic acid content was 3 mol %, stearic acid content was 0.1 mol %, and erucic acid content was 0.001 mol %.

88 kg of the recrystallized behenic acid, 461 L of distilled water, 49.2 L of a 5 mol/L aqueous solution of NaOH and 40.3 L of a 10 mass % solution of dodecylthiopolyacrylamide surfactant (BUN-1) were mixed and allowed to react at 80° C. for one hour under stirring to form a sodium behenate solution. Separately, 206.2 L of an aqueous solution (pH 4.0) containing 40.4 kg of silver nitrate was prepared and kept at 10° C. To 635 L of distilled water contained in a reaction vessel kept at 30° C. were added the entire volume of the above-mentioned sodium behenate solution and the entire volume of the aqueous silver nitrate solution under sufficient stirring at constant flow rates over the periods of 93 minutes and 15 seconds, and 90 minutes, respectively; in this operation, only the aqueous silver nitrate solution was added during a period within 11 minutes from the initiation of the addition of the aqueous silver nitrate solution, and then the addition of the sodium behenate solution was started, and then the addition of the aqueous silver nitrate solution was completed, so that only the sodium behenate solution was added during a period within 14 minutes and 15 seconds from the completion of the addition of the aqueous silver nitrate solution. In this operation, the outside temperature was controlled so that the temperature in the reaction vessel was maintained at 30° C. and the liquid temperature was kept constant. The pipe of the addition system for the sodium behenate solution was warmed by circulating warmed water in the space between the outer pipe and the inner pipe of a double pipe, and temperature was controlled such that the liquid temperature at the outlet orifice of the addition nozzle was 75° C. The pipe of the addition system for the aqueous silver nitrate solution was maintained at a constant temperature by circulating cold water in the space between the outer pipe and the inner pipe of a double pipe. The addition position of the sodium behenate solution and the addition position of the aqueous silver nitrate solution were arranged symmetrically with respect to the stirring axis as a center, and the positions had such heights as not to contact with the reaction solution.

After finishing the addition of the sodium behenate solution, the mixture was left under stirring for 20 minutes at the same temperature, and then the temperature was increased to 35° C. over 30 minutes, followed by aging for 210 minutes.

The dispersion of the nano particles of silver behenate with a solid content of 3 mass % (12 kg) was charged in a diafiltration/ultra filtration apparatus (having a osmotic membrane cartridge of Osmonics model 21-HZ20-S8J with an effective surface area of 0.34 $m^2$ and a nominal cut-off molecular weight of 50,000). The apparatus was operated such that the pressure on the osmotic membrane was 3.5 $kg/cm^2$ (50 $lb/in^2$) and the pressure of the downstream of the osmotic membrane was 20 $kg/cm^2$ (50 $lb/in^2$). The osmotic liquid was replaced with deionized water till 24 g of permeate was removed from the dispersion. Water for substitution was stopped at this stage, and the apparatus was operated till the solid content of the dispersion reached 28 mass %, to obtain a dispersion of nano grains of silver behenate.

Then, dispersions (4) and (5) were prepared in the same manner as the preparation of the dispersion (3) except for changing the amount of the dodecylthio polyacrylamide surfactant (10 mass %) from 40.3 L to 79.3 L and 119.3 L respectively, and for changing the amount of distilled water, in the preparation of the sodium behenate solution described above.

Further, dispersions (6) to (8) were prepared in the same manner as the preparation of the dispersion (3) except for using polyacrylamide derivatives BUN-2, -3, and -4 respectively instead of the dodecylthio polyacrylamide surfactant (BUN-1) in the preparation of the sodium behenate solution described above.

Further, comparative dispersions (9) to (11) were obtained in the same manner as the preparation of the dispersion (3) except for replacing 40.3 L of the dodecylthio polyacrylamide surfactant (10 mass %) and 461 L of distilled water with 80.6 L, 126.6 L, and 190.6 L of aerosol OT (manufactured by American Cyanamide Co.) (5 mass %) respectively, and for changing the amount of distilled water, in the preparation of the solution of sodium behenate.

2. Evaluation for Dispersion

The particle size, stability to pH fluctuation or salts, etc. of each dispersion were evaluated.

1) Measurement of Particle Size

The equivalent sphere diameter of particles was obtained by: determining the projection area of each particle by directly photographing samples using an electron microscope, determining the particle thickness based on the angle of shadowing to calculate the volume of each particle, and then calculating the number average particle volume (average particle size and size distribution are as defined in the specification).

2) Stability of Solution at Low pH

The aggregation stability of the organic silver salt particles was evaluated by filtration property when the pH of the dispersion was set at 6.0.

The test solution was filtered at a flow rate of 20 mL/min per 0.5 $cm^2$ of a 3 μm pole filter, and the time the pressure increase takes to reach 1.0 $kg/cm^2$ was measured to evaluate the filtration resistance.

As the time is longer, the aggregation stability is better.

The obtained results are shown in Table 1.

As shown in Table 1, the dispersions (3) to (8) of the invention had uniform particle size, favorable filtration property, and excellent aggregation stability.

TABLE 1

| Sample No. | Average particle size (μm) | Size distribution (%) | Aggregation stability at low pH | Remarks |
|---|---|---|---|---|
| Comparative dispersion (1) | 0.501 | 36 | 35 min | Comp. Example |
| Comparative dispersion (2) | 0.814 | 43 | 6 min | Comp. Example |
| Dispersion of invention (3) | 0.176 | 26 | 120 min or longer | Invention |
| Dispersion of invention (4) | 0.161 | 20 | 120 min or longer | Invention |
| Dispersion of invention (5) | 0.132 | 16 | 120 min or longer | Invention |
| Dispersion of invention (6) | 0.151 | 25 | 120 min or longer | Invention |

TABLE 1-continued

| Sample No. | Average particle size (μm) | Size distribution (%) | Aggregation stability at low pH | Remarks |
|---|---|---|---|---|
| Dispersion of invention (7) | 0.135 | 18 | 120 min or longer | Invention |
| Dispersion of invention (8) | 0.120 | 12 | 120 min or longer | Invention |
| Comparative dispersion (9) | 0.412 | 34 | 51 min | Comp. Example |
| Comparative dispersion (10) | 0.400 | 33 | 55 min | Comp. Example |
| Comparative dispersion (11) | 0.385 | 32 | 64 min | Comp. Example |

Example 2

(Preparation of PET Support)

1) Film Preparation

PET with an inherent viscosity IV=0.66 (measured in phenol/tetrachloroethane=6/4 (weight ratio) at 25° C.) was prepared using terephthalic acid and ethylene glycol in accordance with a usual method. After pelleting the product, it was dried at 130° C. for 4 hours, melted at 300° C., and then extruded from a T die and cooled rapidly to prepare a non-stretched film.

The film was stretched longitudinally by 3.3 times at 110° C. using rolls of different circumferential speeds and then stretched laterally by 4.5 times at 130° C. by a tenter. Subsequently, it was thermally set at 240° C. for 20 sec and then relaxed by 4% in the lateral direction at the same temperature. Then, after slitting the chuck portion of the tenter, both ends thereof were knurled, and the film was taken up under 4 kg/cm$^2$, to obtain a roll with a thickness of 175 μm.

2) Surface Corona Treatment

Both surfaces of the support were treated by a solid state corona processing machine model 6 KVA manufactured by Pillar Co. at room temperature at 20 m/min. Based on the measured current and voltage, it was found that a treatment at 0.375 kV·A·min/m$^2$ was applied to the support. The processing frequency was 9.6 kHz and the gap clearance between the electrode and the dielectric roll was 1.6 mm.

3) Undercoating

| Preparation of undercoating layer coating liquid | |
|---|---|
| Formulation (1) (for undercoating layer on the image-forming layer side) | |
| PESRESIN A-520 (30 mass % solution) manufactured by Takamatsu Oils and Fats Co., Ltd. | 46.8 g |
| VYLONAL MD-1200 manufactured by Toyo Boseki Co. | 10.4 g |
| 1 mass % solution of polyethylene glycol mono nonyl phenyl ether (average ethylene oxide number = 8.5) | 11.0 g |
| MP-1000 (PMMA fine polymer particles, average particle diameter 0.4 μm) manufactured by Soken Kagaku Co. | 0.91 g |
| Distilled water | 931 ml |
| Formulation (2) (for first layer on back surface) | |
| Styrene-butadiene copolymer latex (solid content 40 mass %, styrene/butadiene mass ratio = 68/32) | 130.8 g |
| Aqueous 8 mass % solution of sodium salt of 2.4-dichloro-6-hydroxy-S-triazine | 5.2 g |

-continued

| Preparation of undercoating layer coating liquid | |
|---|---|
| Aqueous 1 mass % solution of sodium lauryl benzene sulfonate | 10 ml |
| Polystyrene particle dispersion (average particle diameter 2 μm, 20 mass %) | 0.5 g |
| Distilled water | 854 ml |
| Formulation (3) (for second layer on back surface) | |
| $SnO_2$/SbO (9/1 mass ratio, average particle diameter 0.5 μm, 17 mass % dispersion) | 84 g |
| Gelatin | 7.9 g |
| METROSE TC-5 (aqueous 2 mass % solution) manufactured by Shinetsu Chemical Industry Co. | 10 g |
| Aqueous 1 mass % solution of sodium dodecylbenzene sulfonate | 10 ml |
| NaOH (1 mass %) | 7 g |
| PROXEL (manufactured by Avecia Co.) | 0.5 g |
| Distilled water | 881 ml |

Undercoating

After applying the corona discharging treatment described above to both surfaces of the biaxially stretched polyethylene terephthalate support having a thickness of 175 μm, the undercoating coating liquid formulation (1) described above was coated on one side (side on which image-forming layer was to be provided) by a wire bar in a wet coating amount of 6.6 ml/m$^2$ (per one side), and then dried at 180° C. for 5 min. Then, the undercoating coating liquid formulation (2) described above was coated on the rear face (back side) thereof by a wire bar in a wet coating amount of 5.7 ml/m$^2$ and dried at 180° C. for 5 min. Further, the undercoating coating liquid formulation (3) described above was coated on the rear face (back side) by a wire bar in a wet coating amount of 8.4 ml/m$^2$, and dried at 180° C. for 6 min to prepare an undercoated support.

Back Layer

1) Preparation of Back Layer Coating Liquid (Preparation of Solid Fine Particle Dispersion Liquid (a) of Base Precursor)

2.5 kg of a base precursor compound 1, 300 g of a surfactant (trade name: DEMOL N, manufactured by Kao Corporation), 800 g of diphenylsulfone, 1.0 g of a benzoisothiazolinone sodium salt, and distilled water to make the total amount to 8.0 kg were mixed, and the mixed solution was dispersed with beads by using a lateral sand mill (UVM-2, manufactured by Aimex Co., Ltd.). In the dispersing, the mixed solution was fed into UVM-2 charged with zirconia beads having a mean diameter of 0.5 mm by a diaphragm pump and dispersed at an inner pressure of 50 hPa or more until a desired mean particle size was obtained.

The dispersing operation was continued until the dispersion liquid, when subjected to spectral absorption measurement, had a ratio of absorbance at 450 nm to absorbance at 650 nm ($D_{450}/D_{650}$) of 3.0. The resulting dispersion liquid was diluted with distilled water such that the concentration of the base precursor became 25 mass %. In order to eliminate contaminants, the diluted dispersion liquid was filtered (by using a polypropylene-made filter having an average pore size of 3 μm) and then put into practical use.

2) Preparation of Dye Dispersion Liquid 6.0 kg of a cyanine dye compound 1, 3.0 kg of sodium p-dodecylbenzene sulfonate, 0.6 kg of a surfactant DEMOL SNB (manufactured by Kao Corporation), and 0.15 kg of a defoaming agent (a trade name: SURFYNOL 104E, manufactured by Nissin Chemical Industry Co., Ltd.) were mixed with distilled water to make the total liquid amount to 60 kg. The mixed solution was dispersed with 0.5-mm zirconia beads by using a lateral sand mill (UVM-2, manufactured by Aimex Co., Ltd.).

The dispersing operation was continued until the dispersion, when subjected to spectral absorption measurement, had a ratio of absorbance at 650 nm to absorbance at 750 m ($D_{650}/D_{750}$) of 5.0 or higher. The resulting dispersion was diluted with distilled water such that the concentration of the cyanine dye became 6 mass %. In order to eliminate contaminants, the diluted dispersion was filtered by using a filter (average pore size: 1 μm) and then put into practical use.

3) Preparation of Antihalation Layer Coating Liquid

A vessel was kept at a temperature of 40° C. 40 g of gelatin, 20 g of monodispersed polymethyl methacrylate particles (average particle size: 8 μm, standard deviation of particle diameter: 0.4), 0.1 g of benzoisothiazolinone and 490 ml of water were added to the vessel, and the gelatin was dissolved. Further, 2.3 ml of 1 mol/l aqueous sodium hydroxide solution, 40 g of the foregoing dye solid fine particle dispersion liquid, 90 g of the foregoing solid fine particle dispersion liquid (a) of base precursor, 12 ml of an aqueous 3 mass % solution of sodium polystyrene sulfonate, and 180 g of a 10 mass % liquid of SBR latex, were added thereto and mixed. 80 ml of a 4 mass % aqueous solution of N,N-ethylenebis(vinylsulfonacetamide) was added to and mixed with the above mixture immediately before coating, to give an anantihalation layer coating liquid.

4) Preparation of Back Surface Protective Layer Coating Liquid

A vessel was kept at a temperature of 40° C. 40 g of gelatin, 35 mg of benzoisothiazolinone and 840 ml of water were added to the vessel and the gelatin was dissolved. Further, 5.8 ml of a 1 mol/L aqueous solution of sodium hydroxide, 5 g of a 10 mass % emulsion of liquid paraffin, 5 g of a 10 mass % emulsion of trimethylolpropane triisostearate, 10 ml of an aqueous 5 mass % solution of sodium salt of di(2-ethylhexyl) sulfosuccinate, 20 ml of an aqueous 3 mass % solution of sodium polystyrene sulfonate, 2.4 ml of a 2 mass % solution of a fluorine-based surfactant (F-1), 2.4 ml of a 2 mass % solution of a fluorine-based surfactant (F-2), and 32 g of a 19 mass % liquid of a latex of methyl methacrylate/styrene/butyl acrylate/hydroxyethyl methacrylate/acrylic acid copolymer (copolymerization mass ratio 57/8/28/5/2) were mixed with the gelatin solution. Just before coating, 25 ml of an aqueous 4 mass % solution of N,N-ethylenebis(vinylsulfone acetamide) was added thereto to form a back surface protective layer coating liquid.

5) Coating of Back Layer

On the back surface of the undercoated support, the antihalation layer coating liquid and the back surface protective layer coating liquid were simultaneously coated by multilayer coating method, and then dried to form a back layer. The coating amount of the antihalation layer coating liquid was such an amount that the gelatin coating amount was 0.52 g/m$^2$. The coating amount of the back surface protective layer coating liquid was such an amount that the gelatin coating amount was 1.7 g/m$^2$.

(Image-Forming Layer and Surface Protective Layer)

1. Preparation of Coating Material

1) Silver Halide Emulsion

<Preparation of Silver Halide Emulsion 1>

3.1 ml of 1 mass % potassium bromide solution was added to 1421 ml of distilled water. Then, 3.5 ml of sulfuric acid at 0.5 mol/l concentration and 31.7 g of phthalated gelatin were added thereto. The mixture was stirred in a stainless steel reaction pot while its temperature was kept at 30° C. Separately, a solution A was prepared by adding distilled water to 22.22 g of silver nitrate such that the total volume became 95.4 ml. A solution B was prepared by adding distilled water to 15.3 g of potassium bromide and 0.8 g of potassium iodide such that the total volume became 97.4 ml. The entire solution A and the entire solution B were added to the reaction pot at a constant flow rate over 45 sec.

Then, 10 ml of an aqueous 3.5 mass % hydrogen peroxide solution was added thereto and, further, 10.8 ml of an aqueous 10 mass % benzimidazole solution was added thereto. Separately, a solution C was prepared by adding distilled water to 51.86 g of silver nitrate such that the total volume became 317.5 ml. A solution D was prepared by adding distilled water to 44.2 g of potassium bromide and 2.2 g of potassium iodide such that the total volume became 400 ml. The solutions C and D were added to the above mixture by a controlled double jet method; the entire solution C was added at a constant flow rate over 20 min, and the solution D was added while pAg of the solution D was maintained at 8.1.

Potassium hexachloroiridate (III) was added to the above mixture 10 min after the start of addition of the solutions C and D such that its concentration became $1\times10^{-4}$ mol per one mol of silver. Further, an aqueous solution of potassium hexacyano ferrate (II) was added in an amount of $3\times10^{-4}$ mol per one mol of silver 5 sec after the completion of addition of the solution C. The pH of the mixture was adjusted to 3.8 using sulfuric acid at 0.5 mol/L concentration, and stirring was stopped. Then, sedimentation, desalting, and water washing were conducted. The pH was adjusted to 5.9 using sodium hydroxide at 1 mol/L concentration to prepare a silver halide dispersion having a pAg of 8.0.

The silver halide dispersion was kept at 38° C. while stirred. 5 ml of 0.34 mass % solution of 1,2-benzoisothiazoline-3-one in methanol was added thereto. 40 min later, the temperature of the dispersion was elevated to 47° C. 20 min after the temperature elevation, a solution of sodium benzenethiosulfonate in methanol was added thereto such that the concentration of sodium benzenethiosulfonate became $7.6\times10^{-5}$ mol per one mol of silver. 5 min later, a solution of a tellurium sensitizer C in methanol was added thereto such that the concentration of tellurium sensitizer C became $2.9\times10^{-4}$ mol per one mol of silver. Then, the dispersion was subjected to aging for 91 min.

Then, a methanol solution of spectral sensitizing dyes A and B in a molar ratio of 3:1 was added to the dispersion such that the total quantity of the sensitizing dyes A and B became $1.2\times10^{-3}$ mol per one mol of silver. One min later, 1.3 ml of a 0.8 mass % solution of N,N'-dihydroxy-N"-ethylmelamine in methanol was added to the dispersion. 4 min later, a solution of 5-methyl-2-mercaptobenzimidazole in methanol, a solution of 1-phenyl-2-heptyl-5-mercapto-1,3,4-triazole in methanol, and a solution of 1-(3-methylureidophenyl)-5-mercaptotetrazole in water were added to the dispersion such that the concentration of 5-methyl-2-mercaptobenzimidazole became $4.8\times10^{-3}$ mol per one mol of silver, the concentration of 1-phenyl-2-heptyl-5-mercapto-1,3,4-triazole became $5.4\times10^{-3}$ mol per one mol of silver, and the concentration of an aqueous solution of 1-(3-methylureidophenyl)-5-mercaptotetrazole was $8.5\times10^{-3}$ mol per one mol of silver. In this way, a silver halide emulsion 1 was obtained.

The grains in the silver halide emulsion thus prepared were silver iodobromide grains with an average equivalent sphere diameter of 0.042 μm and a variation coefficient of equivalent sphere diameter of 20% homogeneously containing 3.5 mol % of iodide. The grain diameter and the like were determined based on the average of 1000 grains using an electron microscope. The [100] face ratio of the grain was determined by the Kubelka-Munk method, and was found to be 80%.

<Preparation of Silver Halide Emulsion 2>

A silver halide emulsion 2 was prepared in the same manner as in the preparation of the silver halide emulsion 1 except that the liquid temperature upon grain formation was changed from 30° C. to 47° C., that the solution B was obtained by adding distilled water to 15.9 g of potassium bromide to make the total volume 97.4 ml, that the solution D was obtained by adding distilled water to 45.8 g of potassium bromide to make the total volume 400 ml, that the addition time of the solution C was changed to 30 min, and that potassium hexacyano ferrate (II) was omitted. Sedimentation, desalting, water washing, and dispersing operations were conducted in the same manner as in the preparation of the silver halide emulsion 1. Spectral sensitization, chemical sensitization, and addition of 5-methyl-2-mercaptobenzimidazole and 1-phenyl-2-heptyl-5-mercapto-1,3,4-triazole was conducted in the same manner as in the preparation of the silver halide emulsion 1 except that the addition amount of the tellurium sensitizer C was changed to $1.1\times10^{-4}$ mol per one mol of silver, that the addition amount of the methanol solution of the spectral sensitizing dyes A and B in the molar ratio of 3:1 was changed to $7.0\times10^{-4}$ mol per one mol of silver in terms of the total amount of the sensitizing dyes A and B, that the addition amount of 1-phenyl-2-heptyl-5-mercapto-1,3,4-triazole was changed to $3.3\times10^{-3}$ mol per one mol of silver, and that the addition amount of 1-(3-methylureidophenyl)-5-mercaptotetrazole was changed to $4.7\times10^{-3}$ mol per one mol of silver. The silver halide emulsion 2 was obtained in this manner.

The emulsion grains of the silver halide emulsion 2 were pure silver bromide cubic grains with an average equivalent sphere diameter of 0.080 μm and a variation coefficient of the equivalent sphere diameter of 20%.

<Preparation of Silver Halide Emulsion 3>

A silver halide emulsion 3 was prepared in the same manner as in the preparation of the silver halide emulsion 1 except for changing the liquid temperature upon grain formation from 30° C. to 27° C.

Sedimentation, desalting, water washing, and dispersion operations were conducted in the same manner as in the preparation of the silver halide emulsion 1. A silver halide emulsion 3 was obtained in the same manner as in the preparation of the silver halide emulsion 1 except that the addition amount of the tellurium sensitizer C was changed to $5.2\times10^{-4}$ mol per one mol of silver, that a solid dispersion (in aqueous gelatin solution) of the spectral sensitizing dyes A and B in the molar ratio of 1:1 was added in an amount of $6.0\times10^{-3}$ mol per one mol of silver in terms of the total amount of the sensitizing dyes A and B instead of the methanol solution of the spectral sensitizing dyes A and B, that $5\times10^{-4}$ mol of bromoauric acid per one mol of silver and $2\times10^{-3}$ mol of potassium thiocyanate per one mol of silver were added 3 min after the addition of the tellurium sensitizer. The emulsion grains of the silver halide emulsion 3 were silver iodobromide grains with an average equivalent sphere diameter of 0.034 μm and with a variation coefficient of the equivalent sphere diameter of 20% homogeneously containing 3.5 mol % of iodide.

(Preparation of Mixed Emulsion A for Coating Liquid)

70 mass % of the silver halide emulsion 1, 15 mass % of the silver halide emulsion 2, and 15 mass % of the silver halide emulsion 3 were mixed, and an aqueous 1 mass % solution of benzothiazolium iodide was added thereto such that the concentration of the benzothiazolium iodide became $7\times10^{-3}$ mol per one mol of silver.

Thereafter, water was added such that the content of the silver halide per 1 kg of the mixed emulsion for coating liquid was 38.2 g in terms of the silver amount. Further, 1-(3-methylureidophenyl)-5-mercaptotetrazole in an amount of 0.34 g per 1 kg of the mixed emulsion for coating liquid was further added.

2) Preparation of Reducing Agent Dispersion 10 kg of water was added to a mixture of 10 kg of a reducing agent 1 (6,6'-di-t-butyl-4,4'-dimethyl-2,2'-butylidenediphenol) and 16 kg of an aqueous 10 mass % solution of modified polyvinyl alcohol (POVAL MP203, manufactured by Kuraray Co.) and they were mixed thoroughly to form a slurry. The slurry was fed by a diaphragm pump, and was dispersed for 3 hrs by a horizontal sand mil (UVM-2; manufactured by Imex Co.) filled with zirconia beads with an average diameter of 0.5 mm. Then 0.2 g of sodium salt of benzoisothiazolinone and water were added thereto such that the concentration of the reducing agent became 25 mass %. The obtained dispersion was heated to and kept at 60° C. for 5 hours to form a reducing agent 1 dispersion. The reducing agent particles contained in the thus obtained reducing agent dispersion had a median diameter of 0.40 μm and a maximum particle diameter of 1.4 μm or less. The obtained reducing agent dispersion was filtered through a polypropylene filter of 3.0 μm pore size so that contaminants such as dusts were removed. The reducing agent dispersion was then stored.

3) Preparation of Polyhalogen Compounds

<Preparation of Organic Polyhalogen Compound 1 Dispersion>

10 kg of an organic polyhalogen compound 1 (tribromomethanesulfonylbenzene), 10 kg of a 20 mass % aqueous solution of a modified polyvinyl alcohol POVAL MP203 available from Kuraray Co., Ltd., 0.4 kg of a 20 mass % aqueous solution of sodium triisopropylnaphthalenesulfonate, and 14 kg of water were sufficiently mixed to obtain a slurry. The slurry was transported by a diaphragm pump to a horizontal-type sand mill UVM-2 manufactured by Imex Co. which was packed with zirconia beads having an average diameter of 0.5 mm, and dispersed for 5 hours. Then, 0.2 g of benzoisothiazolinone sodium salt and water were added to the dispersed slurry such that the content of the organic polyhalogen compound was 26 mass %, to obtain an organic polyhalogen compound 1 dispersion. The organic polyhalogen compound 1 dispersion included organic polyhalogen compound particles having a median size of 0.41 μm and a maximum particle size of 2.0 μm or less. The organic polyhalogen compound 1 dispersion was filtrated by a polypropylene filter having a pore diameter of 10.0 μm to remove extraneous substances such as dust, and then stored.

<Preparation of Organic Polyhalogen Compound 2 Dispersion>

10 kg of an organic polyhalogen compound 2 (N-butyl-3-tribromomethanesulfonylbenzoamide), 20 kg of a 10 mass % aqueous solution of a modified polyvinyl alcohol POVAL MP203 available from Kuraray Co., Ltd., and 0.4 kg of a 20 mass % aqueous solution of sodium triisopropylnaphthalenesulfonate were sufficiently mixed to obtain a slurry. The slurry was transported by a diaphragm pump to a horizontal-type sand mill UVM-2 manufactured by Imex Co. which was packed with zirconia beads having an average diameter of 0.5 mm, and dispersed for 5 hours. Then, 0.2 g of benzoisothiazolinone sodium salt and water were added to the dispersed slurry such that the content of the organic polyhalogen compound was 30 mass %, and the liquid was maintained at 40° C. for 5 hours to obtain an organic polyhalogen compound 2 dispersion. The organic polyhalogen compound 2 dispersion included organic polyhalogen compound particles having a median size of 0.40 μm and a maximum particle size of 1.3 μm or smaller. The organic polyhalogen compound 2 dispersion was filtrated by a polypropylene filter having a pore diameter of 3.0 μm to remove extraneous substances such as dust, and then stored.

4) Preparation of Pigment 1 Dispersion 250 g of water was sufficiently mixed with 64 g of C. I. Pigment Blue 60 and 6.4 g of DEMOL N available from Kao Corporation, to obtain a slurry. The slurry was placed in a vessel together with 800 g of zirconia beads having an average diameter of 0.5 mm, and dispersed for 25 hours by a dispersion apparatus 1/4G sand grinder mill manufactured by Imex Co. The pigment content of the dispersed slurry was adjusted to 5 mass % by addition of water, to prepare a pigment 1 dispersion. The pigment 1 dispersion comprised pigment particles having an average particle diameter of 0.21 μm.

5) Preparation of Aqueous Solution

The aqueous solutions of the following compounds were prepared and added.

Compound of the Formula (I) or (II)

An aqueous 5 mass % solution of succinimide was prepared.

Preparation of an Aqueous Solution of 4-Methylphthalic Acid

A 5 mass % aqueous solution of 4-methylphthalic acid was prepared.

2. Preparation of Coating Liquid

1) Preparation of Image-Forming Layer Coating Liquids 1 to 27

Gelatin and 450 ml of water were charged in a vessel kept at a temperature of 40° C. The gelatin was dissolved, and then the fatty acid silver salt dispersion, the pigment 1 dispersion, the organic polyhalogen compound 1 dispersion, the organic polyhalogen compound 2 dispersion, the aqueous solution of succinimide, the reducing agent dispersion, the aqueous solution of 4-methylphthalic acid and sodium iodide were added successively to the gelatin solution. The mixed silver halide emulsion A was mixed thoroughly with the above mixture immediately before coating to form an image-forming layer coating liquid. The image-forming layer coating liquid was directly fed to a coating die.

The amount of zirconium in the coating liquid was 0.18 mg per 1 g of silver.

The pH of the coating liquid was set at the value shown in Table 2.

2) Preparation of Surface Protective Layer Coating Liquid 2400 ml of water and 300 g of gelatin were charged in a vessel kept at a temperature of 40° C. The gelatin was dissolved, and 60 g of an aqueous 5 mass % solution of sodium salt of di(2-ethylhexyl)sulfosuccininate and 900 g of the aqueous succinimide solution were added successively to the gelatin solution. The mixture was stirred thoroughly to form a surface protective layer coating liquid.

3. Preparation of Photothermographic Materials 1 to 27

On the undercoated surface on the opposite side to the back side, the image-forming layer coating liquid and the surface protective layer coating liquid were simultaneously coated in this order in a simultaneous multi-coating manner by a slide bead coating method to form a sample of a photothermographic material. In the coating operation, the temperatures of the image-forming layer coating liquid and the surface protective layer coating liquid were adjusted to 37° C.

The type of the organic silver salt dispersion used and the amount of gelatin are shown in Table 2.

The coating amount of the organic silver salt was 1.3 g/m$^2$ in terms of silver amount. Further, the surface protective layer was coated such that the dry coating amount of gelatin was 2.0 (g/m$^2$).

The coating amounts (g/m$^2$) of other compounds in the image-forming layer are shown below.

| | |
|---|---|
| Gelatin | 3.90 |
| Pigment (C.I. Pigment Blue 60) | 0.036 |
| Polyhalogen compound 1 | 0.10 |
| Polyhalogen compound 2 | 0.34 |
| 4-methylphthalic acid | 0.08 |
| Succinimide | 0.54 |
| Sodium iodide | 0.04 |
| Reducing agent 1 | 0.75 |
| Silver halide (in terms of silver amount) | 0.10 |

TABLE 2

| Sample No. | Organic silver salt dispersion No. | Coating solution pH | Coated surface state | Granularity RMS | Dmin (1), (2) Just after coating | Dmin (1), (2) After 2 month | Δ Dmin | Remark |
|---|---|---|---|---|---|---|---|---|
| 1 | Comparative dispersion (1) | 7.0 | C | 0.016 | 0.18 | 0.25 | 0.07 | Comp. Ex. |
| 2 | Comparative dispersion (1) | 6.0 | C | 0.016 | 0.17 | 0.23 | 0.06 | Comp. Ex. |
| 3 | Comparative dispersion (1) | 5.0 | C | 0.02 | 0.19 | 0.27 | 0.08 | Comp. Ex. |
| 4 | Comparative dispersion (2) | 7.0 | D | 0.024 | 0.24 | 0.3 | 0.06 | Comp. Ex. |
| 5 | Comparative dispersion (2) | 6.0 | D | 0.024 | 0.22 | 0.28 | 0.06 | Comp. Ex. |
| 6 | Comparative dispersion (2) | 5.0 | D | 0.028 | 0.25 | 0.32 | 0.07 | Comp. Ex. |
| 7 | Dispersion (3) of Invention | 7.0 | A | 0.007 | 0.16 | 0.18 | 0.02 | Invention |
| 8 | Dispersion (3) of Invention | 6.0 | A | 0.007 | 0.15 | 0.17 | 0.02 | Invention |
| 9 | Dispersion (3) of Invention | 5.0 | A | 0.007 | 0.16 | 0.19 | 0.03 | Invention |
| 10 | Dispersion (4) of Invention | 7.0 | A | 0.006 | 0.17 | 0.19 | 0.02 | Invention |
| 11 | Dispersion (4) of Invention | 6.0 | A | 0.006 | 0.16 | 0.18 | 0.02 | Invention |
| 12 | Dispersion (4) of Invention | 5.0 | A | 0.006 | 0.17 | 0.19 | 0.02 | Invention |
| 13 | Dispersion (5) of Invention | 7.0 | A | 0.006 | 0.17 | 0.19 | 0.02 | Invention |
| 14 | Dispersion (5) of Invention | 6.0 | A | 0.006 | 0.16 | 0.18 | 0.02 | Invention |
| 15 | Dispersion (5) of Invention | 5.0 | A | 0.006 | 0.17 | 0.19 | 0.02 | Invention |

TABLE 2-continued

| Sample No. | Organic silver salt dispersion No. | Coating solution pH | Coated surface state | Granularity RMS | Dmin (1), (2) Just after coating | After 2 month | Δ Dmin | Remark |
|---|---|---|---|---|---|---|---|---|
| 16 | Dispersion (6) of Invention | 7.0 | A | 0.006 | 0.15 | 0.17 | 0.02 | Invention |
| 17 | Dispersion (6) of Invention | 6.0 | A | 0.006 | 0.14 | 0.16 | 0.02 | Invention |
| 18 | Dispersion (7) of Invention | 7.0 | A | 0.005 | 0.15 | 0.18 | 0.03 | Invention |
| 19 | Dispersion (7) of Invention | 6.0 | A | 0.005 | 0.14 | 0.16 | 0.02 | Invention |
| 20 | Dispersion (8) of Invention | 7.0 | A | 0.005 | 0.16 | 0.18 | 0.02 | Invention |
| 21 | Dispersion (8) of Invention | 6.0 | A | 0.005 | 0.15 | 0.18 | 0.03 | Invention |
| 22 | Comparative dispersion (9) | 7.0 | B | 0.012 | 0.28 | 0.41 | 0.13 | Comp. Ex. |
| 23 | Comparative dispersion (9) | 6.0 | B | 0.012 | 0.26 | 0.39 | 0.13 | Comp. Ex. |
| 24 | Comparative dispersion (10) | 7.0 | B | 0.012 | 0.26 | 0.38 | 0.12 | Comp. Ex. |
| 25 | Comparative dispersion (10) | 6.0 | B | 0.012 | 0.25 | 0.38 | 0.13 | Comp. Ex. |
| 26 | Comparative dispersion (11) | 7.0 | B | 0.011 | 0.26 | 0.39 | 0.13 | Comp. Ex. |
| 27 | Comparative dispersion (11) | 6.0 | B | 0.011 | 0.26 | 0.39 | 0.13 | Comp. Ex. |

The chemical structures of the compounds used in the examples are shown below.

Spectral Sensitizing Dye A

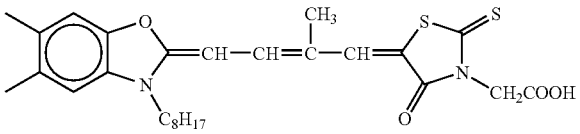

Spectral Sensitizing Dye B

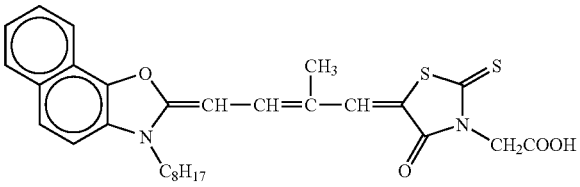

Tellurium Sensitizer C

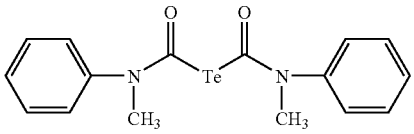

Base Precursor Compound 1

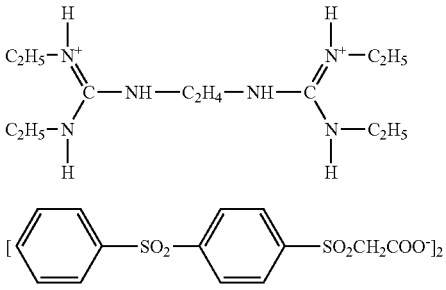

-continued

Cyanine Dye Compound 1

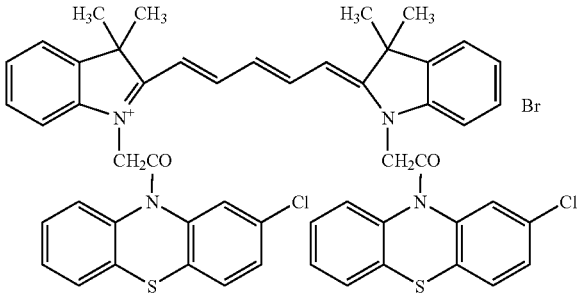

Reducing Agent 1

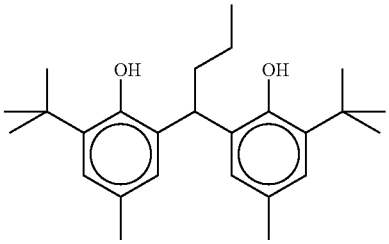

Polyhalogen Compound 1

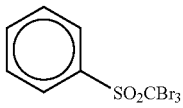

Polyhalogen Compound 2

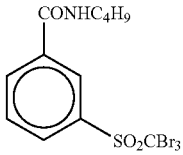

-continued (F-1)

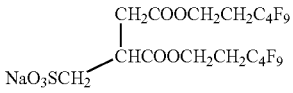

(F-2)

Mixture of the following compounds

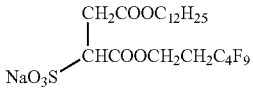

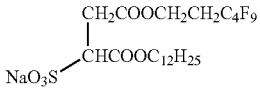

4. Evaluation of Performance 4-1 Evaluation of Coated Surface State

Each of the photothermographic materials manufactured as described above was left in an atmosphere of 25° C. and 40% RH for 16 hours, and the photothermographic materials were exposed and thermally developed by using a Fuji medical dry laser imager-FM-DPL (equipped with a 660 nm semiconductor laser with a maximum power of 60 mW (IIIB)). In the thermal development, the photothermographic materials were developed by using 4 panel heaters respectively set at 112° C.-119° C.-121° C.-121° C., and the developing time was 14 sec in total.

Uniform images having a density of 1.0 obtained by uniform exposure were visually observed and the coated surface state was evaluated.

A: No unevenness is observable;

B: Slight unevenness is observable;

C: Moderate unevenness is observable;

D: Severe unevenness is observable.

4-2 Photographic Property

1) Preparation

The obtained sample was cut into the half size (43 cm in length×35 cm in width), packed in the following packaging material under an atmosphere of 25° C. and 50% RH. The packed photothermographic material was stored at normal temperature for 2 weeks, and the following evaluations were conducted.

<Packaging Material>

Laminate film of (PET 10 μm)-(PE 12 μm)-(aluminum foil 9 μm)-(Ny 15 μm)-(polyethylene 50 μm containing 3 mass % carbon):

oxygen permeability: 0.02 ml/atm·$m^2$·25° C.·day, moisture permeability: 0.10 g/atm·$m^2$·25° C.·day.

2) Evaluation for Pre-Use Storability

Each photothermographic material was exposed and thermally developed by using a Fuji medical dry laser imager-FM-DPL (equipped with 660 nm semiconductor laser with a maximum power of 60 mW (IIIB)). In the thermal development, the photothermographic materials were developed by using 4 panel heaters respectively set at 112° C.-119° C.-121° C.-121° C., and the developing time was 14 sec in total. The image density of the obtained image was measured by a densitometer. The minimum density was referred to as "Dmin (1)."

Separately, each photothermographic material was left in an atmosphere of 25° C. and 50% RH for 16 hours, and then packed in a moisture-proof packaging. The packaging was sealed and stored at room temperature for 2 months. Then, exposure and thermal development were conducted in the same manner as described above. The image density of the obtained image was measured in the same manner as described above, and the minimum density was referred to as "Dmin(2)." A fog increase during pre-use storage (ΔDmin) was defined as the difference between Dmin(2) and Dmin(1).

$$\Delta D\text{min}=D\text{min}(2)-D\text{min}(1)$$

3) Evaluation of Graininess

Each photothermographic material was exposed and thermally developed by using a Fuji medical dry laser imager-FM-DPL (equipped with a 660 nm semiconductor laser with a maximum power of 60 mW (IIIB)). In the thermal development, the photothermographic materials were developed by using 4 panel heaters respectively set at 112° C.-119° C.-121° C.-121° C., and the developing time was 15 sec in total. The density of the uniform image having a density of 1.0 obtained by uniform exposure was measured by a microdensitometer at an aperture size of 0.1 mm×0.1 mm. The graininess was evaluated based on the RMS (Root-Mean-Square) value.

4) Results

The results are shown in Table 2. As shown in Table 2, the samples (7) to (21) of the invention had superior coated surface state and graininess, and exhibited smaller fog increase during pre-use storage.

What is claimed is:

1. A method of producing an organic silver salt dispersion, the method comprising:

mixing a first aqueous solution including a water-soluble silver ion supplier and a second aqueous solution including an alkali metal salt of an organic acid to form an organic silver salt dispersion;

wherein, the second aqueous solution further includes at least one compound selected from polyacrylamide and derivatives of polyacrylamide, and at least 10 mass %, in terms of silver quantity, of the organic silver salt in the organic silver salt dispersion is formed by simultaneous addition of the first aqueous solution and the second aqueous solution to an aqueous medium followed by mixing.

2. The method of producing an organic silver salt dispersion according to claim 1, the method further comprising adding at least one compound selected from polyacrylamide and derivatives of polyacrylamide to the aqueous medium after the simultaneous addition of the first and second aqueous solutions.

3. The method of producing an organic silver salt dispersion according to claim 1, wherein the compound selected from polyacrylamide and derivatives of polyacrylamide is a compound represented by formula (W1) or (W2):

Formula (W1)

Formula (W2)

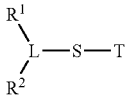

wherein in formulae (W1) and (W2), R represents a hydrophobic group, $R_1$ and $R_2$ each independently represent a hydrogen atom or a hydrophobic group, at least one of $R_1$ and $R_2$ is a hydrophobic group, L represents a divalent connecting group, T represents an oligomer moiety, and the hydrophobic group is a saturated or unsaturated alkyl group, an arylalkyl group, or an alkylaryl group.

4. The method of producing an organic silver salt dispersion according to claim 2, wherein the compound selected from polyacrylamide and derivatives of polyacrylamide added after the simultaneous addition is a compound represented by formula (W1) or (W2):

Formula (W1)

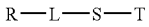

Formula (W2)

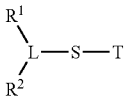

wherein in formulae (W1) and (W2), R represents a hydrophobic group, $R_1$ and $R_2$ each independently represent a hydrogen atom or a hydrophobic group, at least one of $R_1$ and $R_2$ is a hydrophobic group, L represents a divalent connecting group, T represents an oligomer moiety, and the hydrophobic group is a saturated or unsaturated alkyl group, an arylalkyl group, or an alkylaryl group.

5. The method of producing an organic silver salt dispersion according to claim 1, wherein particles of the organic silver salt are nano particles.

6. The method of producing an organic silver salt dispersion according to claim 5, wherein an average particle size of the nano particles is 5 nm to 400 nm.

7. The method of producing an organic silver salt dispersion according to claim 1, wherein a standard deviation of a particle size distribution of the organic silver salt particles is 10% to 30%.

8. The method of producing an organic silver salt dispersion according to claim 1, the method further comprising desalinating the organic silver salt dispersion by an ultrafiltration method or by an electrodialysis method after formation of particles of the organic silver salt.

9. The method of producing an organic silver salt dispersion according to claim 1, wherein at least 25 mass % of silver in the first aqueous solution and at least 25 mass % of the organic acid in the second aqueous solution are added to the aqueous medium during a period in which the first and second aqueous solutions are simultaneously added to the aqueous medium.

10. A photothermographic material comprising a support and an image-forming layer provided on at least one side of the support, wherein the image-forming layer includes a photosensitive silver halide, a reducing agent, a binder, and the non-photosensitive organic silver salt produced by the method of claim 1.

11. The photothermographic material according to claim 10, wherein the photothermographic material further include a compound represented by formula (I) or (II):

Formula (I)

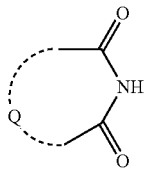

wherein in formula (I), Q represents an atomic group required for forming a 5- or 6-membered imide ring;

Formula (II)

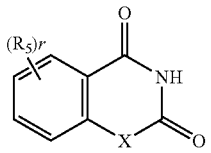

wherein in formula (II), $R_5$ represents a hydrogen atom, an alkyl group, a cycloalkyl group, an alkoxy group, an alkylthio group, an arylthio group, a hydroxy group, a halogen atom, or $N(R_8R_9)$; $R_8$ and $R_9$ each independently represent a hydrogen atom, an alkyl group, an aryl group, a cycloalkyl group, an alkenyl group, or a heterocyclyl group; r represents 0, 1 or 2; $R_8$ and $R_9$ may be bonded to each other to form a substituted or unsubstituted 5- to 7-membered heterocyclic ring; when there are two $R_5$s, they may be the same as each other or different from each other, and they may be bonded to each other to form an aromatic, heteroaromatic, alicyclic, or heterocyclic condensed ring; X represents O, S, Se, or $N(R_6)$; and $R_6$ represents a hydrogen atom, an alkyl group, an aryl group, a cycloalkyl group, an alkenyl group, or a heterocyclyl group.

12. The photothermographic material according to claim 10, wherein at least 30 mass % of the binder of the image-forming layer is a hydrophilic binder.

13. The photothermographic material according to claim 12, wherein the hydrophilic binder is gelatin or a derivative of gelatin.

14. The photothermographic material according to claim 12, wherein the photothermographic material further comprises a non-photosensitive layer and at least 50 mass % of the binder of the non-photosensitive layer is a hydrophilic binder.

15. The photothermographic material according to claim 14, wherein the hydrophilic binder in the non-photosensitive layer is gelatin or a derivative of gelatin.

16. The photothermographic material according to claim 12, wherein in the image-forming layer, the ratio of the non-photosensitive organic silver salt to the hydrophilic binder is in a range of 1.0 to 2.5.

* * * * *